US007262002B2

(12) United States Patent
Ohzeki et al.

(10) Patent No.: US 7,262,002 B2
(45) Date of Patent: Aug. 28, 2007

(54) SILVER HALIDE EMULSION AND SILVER HALIDE COLOR PHOTOGRAPHIC LIGHT-SENSITIVE MATERIAL

(75) Inventors: Katsuhisa Ohzeki, Minami-ashigara (JP); Hiroyuki Suzuki, Minami-ashigara (JP); Toshihiro Kariya, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 11/072,244

(22) Filed: Mar. 7, 2005

(65) Prior Publication Data

US 2005/0202354 A1 Sep. 15, 2005

(30) Foreign Application Priority Data

Mar. 11, 2004 (JP) ..... 2004-068408
Mar. 25, 2004 (JP) ..... 2004-089336

(51) Int. Cl.
*G03C 1/005* (2006.01)
*G03C 1/494* (2006.01)
*G03C 1/06* (2006.01)

(52) U.S. Cl. ..... 430/567; 430/569; 430/603; 430/605

(58) Field of Classification Search ..... 430/567, 430/569, 603, 605
See application file for complete search history.

(56) References Cited

U.S. PATENT DOCUMENTS

| | | | | |
|---|---|---|---|---|
| 4,789,618 | A | 12/1988 | Inoue et al. | |
| 5,328,820 | A | 7/1994 | Klaus et al. | |
| 5,360,712 | A | 11/1994 | Olm et al. | |
| 5,418,127 | A | 5/1995 | Budz et al. | |
| 5,547,829 | A | 8/1996 | Kojima et al. | |
| 5,750,324 | A | 5/1998 | Mydlarz et al. | |
| 5,853,951 | A | 12/1998 | Yasuda et al. | |
| 5,945,269 | A * | 8/1999 | Nakatsu | 430/567 |
| 5,985,508 | A | 11/1999 | Ito et al. | |

FOREIGN PATENT DOCUMENTS

| | | |
|---|---|---|
| DE | 43 44 164 A1 | 5/1995 |
| EP | 0 349 286 A1 | 1/1990 |
| EP | 0 573 854 A1 | 12/1993 |
| EP | 627657 A2 | 12/1994 |
| EP | 0 95 558 A1 | 3/1999 |
| EP | 0 905 558 A1 | 3/1999 |
| JP | 4-335336 | 11/1992 |
| JP | 6-35147 | 2/1994 |
| JP | 6-202265 | 7/1994 |
| JP | 6-308652 | 11/1994 |
| JP | 7-140579 | 6/1995 |
| JP | 8-95184 | 4/1996 |
| JP | 10-31279 | 2/1998 |
| JP | 2000-338641 | 12/2000 |

* cited by examiner

*Primary Examiner*—Geraldina Visconti
(74) *Attorney, Agent, or Firm*—Sughrue Mion, PLLC

(57) ABSTRACT

A silver halide emulsion containing silver halide grains with a silver chloride content of at least 95 mole %, being sensitized with selenium and gold, and further containing at least two compounds each having a function of oxidizing metallic silver clusters; a silver halide photographic material containing the same; and a silver halide photographic material having red-, green, and blue-sensitive silver halide emulsion layers, wherein one of the emulsion layers contains a silver halide emulsion with a silver chloride content of at least 95 mole %, and the silver halide emulsion contains a selenium compound and a metal complex of formula (D1);

$$[M^{D1}X^{D1}_{n}L^{D1}_{(6-n)}]^{m} \qquad \text{formula (D1)}$$

wherein $M^{D1}$ represents Cr, Mo, Re, Fe, Ru, Os, Co, Rh, Pd, or Pt; $X^{D1}$ represents a halogen ion; $L^{D1}$ represents a ligand other than $X^{D1}$; n represents 3, 4, 5, or 6; and m represents 4−, 3−, 2−, 1−, 0, or 1+.

20 Claims, No Drawings

SILVER HALIDE EMULSION AND SILVER HALIDE COLOR PHOTOGRAPHIC LIGHT-SENSITIVE MATERIAL

FIELD OF THE INVENTION

The present invention relates to a silver halide emulsion and a silver halide color photographic light-sensitive material. Specifically, the present invention relates to a silver halide emulsion and a silver halide color photographic light-sensitive material that can ensure high sensitivity, low fog, and hard gradation. Moreover, the present invention relates to a silver halide color photographic light-sensitive material capable of ensuring hard gradation and suitable for rapid processing, and more specifically, to a silver halide color photographic light-sensitive material capable of ensuring high sensitivity, hard gradation, and excellent latent-image stability even when undergoes high-illumination exposure.

BACKGROUND OF THE INVENTION

With the recent widespread proliferation of digital cameras and personal computers, silver halide photographic light-sensitive materials have been used as print materials of digital image information with growing frequency. As to the print materials of digital image information, recent years have also seen widespread use of image output materials other than silver halide photographic light-sensitive materials, typified by inkjet printers. To compete against these output materials, the field of silver halide photographic light-sensitive materials including color photographic paper, has been ever more strongly required to increase the speed of photographic processing, to enhance image quality, and to improve processing stability (consistency).

Further, in recent years, digitalization has been remarkably propagated also in the field of a color print using a color photographic paper. For example, a digital exposure system by laser scanning exposure has been rapidly spread in comparison with a conventional analog exposure system of directly conducting a printing from a processed color negative film using a color printer. The digital exposure system is characterized in that a high image quality is obtained by conducting image processing, and it greatly contributes to improvement of qualities of color prints using a color photographic paper. Further, it is also considered to be an important factor that a color print with a high image quality is easily obtained from these electronic recording media such as digital cameras. It is believed that they will lead to further remarkable popularization.

On the other hand, as a color print method, techniques, such as an ink jet method, a sublimated type method, and color xerography have each progressed and are recognized for their ability of providing comparable image qualities to photography. Compared with these techniques, characteristics of the digital exposure method using color photographic paper reside in high image quality, high throughput, and high solidity (fastness) of an image. It is desired to further develop these characteristics and to provide high image quality photographs more easily and with lower cost. If so-called one-stop service of a color print becomes possible (i.e., one shop receives a recording medium of a digital camera from a customer and finishes processing, to return a high image-quality print to the customer in a short time such as a few minutes), the predominance of the color print using color photographic paper will further increase. If rapid processing suitability of color photographic paper is raised, a printing apparatus which is smaller in size and lower in costs while having high productivity, can be used, and thus the one-stop service of a color print is expected to spread further. From these points, in particular, it is important to raise the rapid processing suitability of color photographic paper. To realize the one-stop service of the color print using color photographic paper, analyses from various viewpoints, such as shortening of exposure time, shortening of so-called latent image time from the exposure to the initiation of the processing, and shortening of time period from the processing to the drying are required. Thus, conventionally, various kinds of proposals have been proposed based on such viewpoints.

Silver halide emulsions for use in color photographic paper must meet various requirements as mentioned above. As such silver halide emulsion for use in color photographic paper, a silver halide emulsion of a high silver chloride content has been used primarily because of a demand for rapid processing.

In addition, it is desirable for further rapid processing that silver halide emulsions be reduced in grain size. Especially, there is an intense demand on color photographic paper, to reduce the grain size of a yellow-dye-forming silver halide emulsion, which has the greatest grain size of all the silver halide emulsions in the color photographic paper, and the grain size of a silver halide emulsion in the emulsion layer nearest to the support, which emulsion is slow in progress of development. As to spectrally sensitized emulsions, grain size reduction generally results in lowering of sensitivity, because the emulsion sensitivity is proportional to the surface area of silver halide grains. Aimed at further increasing the sensitivity, therefore, various improvements have been made to methods of chemical sensitization and methods for forming silver halide emulsion grains.

Representatives of known methods for chemically sensitizing silver halide emulsions are sulfur sensitization, selenium sensitization, tellurium sensitization, precious-metal sensitization, including gold sensitization; reduction sensitization, and combinations of two or more of these. To mention selenium sensitization, in particular, of those sensitization methods, it is known that selenocarboxylic acid esters, i.e. seleno esters, are usable as selenium sensitizers (e.g. in U.S. Pat. Nos. 3,297,446 and 3,297,447, and JP-B-57-22090 ("JP-B" means examined Japanese patent publication)).

Although there are cases in which selenium sensitization can produce a greater sensitization effect than sulfur sensitization generally performed in the field, selenium sensitization tends to cause heavy fogging and soft gradation. In addition, the combined use of selenium sensitization and gold sensitization can bring about a remarkable increase in sensitivity, but at the same time it causes increased fogging and tends to enhance soft gradation. Therefore, there has been a strong need for development of selenium sensitization methods capable of ensuring reduced fogging and hard gradation.

JP-A-7-140579 ("JP-A" means unexamined published Japanese patent application) proposes chemical sensitization of silver chloride emulsions by use of selenium compounds, aiming to increase the sensitivity and reduce fogging when the emulsions undergo 1/10-second exposure. Such a chemical sensitization method is too high in fog density to be applied to color photographic paper, and therefore development of methods capable of achieving further reduction in fogging and improvement in sensitivity is expected.

On the other hand, specified disulfide compounds, sulfinate compounds, combinations of specified disulfide compounds and sulfinate or seleninate compounds, and combinations of specified selenium compounds and radical scavengers are proposed in European Patent No. 627657, JP-A-6-35147, JP-A-6-202265, and JP-A-10-31279. However, these references are silent on the fogging problem in selenium sensitization.

Further, when silver halide emulsions having high silver chloride contents undergo high-illumination exposure, such as laser exposure, there results a sensitivity reduction and soft gradation enhancement, or so-called high illumination intensity reciprocity law failure. It is known that such failure can be improved by incorporating metal complexes into silver halide grains (as disclosed, e.g., in U.S. Pat. No. 5,360,712).

However, in the case of enhancing hard gradation by use of metal complexes, there is a requirement to enhance the hard gradation characteristics under conditions of low illumination intensity, in addition to enhancing the hard gradation characteristics under conditions of high illumination intensity by the foregoing improvement of reciprocity law failure. When metal complexes are used to satisfy those requirements, a desensitization problem arises, and latent-image stability becomes insufficient.

Arts of using selenium (Se) sensitization compounds in silver halide emulsions having high silver chloride contents are known (e.g. in JP-A-2003-287838). However, such arts are insufficient to ensure high sensitivity, hard gradation, and latent-image stability, regardless of what the illumination intensity of exposure may be (i.e. in any of illumination intensities ranging from low illumination intensity to high illumination intensity). As such, those arts are in need of improvements.

JP-A4-335336 proposes the art of improving reciprocity characteristics, latent-image stability, and pressure immunity by using an emulsion that has a high silver chloride content, is incorporated a metal complex having at least two CN ligands, and further is subjected to selenium sensitization. However, metal complexes having many CN ligands are unsuccessful at imparting satisfactory hard gradation characteristics under conditions of low illumination intensity to the emulsions. JP-A-6-308652 proposes improvement of storage stability by emulsions having high silver chloride contents, containing metal complexes, and further, having undergone selenium sensitization. However, this reference provides no suggestion about the art of improving the desensitization caused by metal complexes used for obtaining hard photosensitive materials.

Further, there are suggestions that performances can be improved by incorporating small amounts of silver bromide and/or silver iodide into emulsion grains having high silver chloride contents. For instance, it is suggested that high sensitivity can be obtained by localizing phases having high silver bromide content in a wide variety of forms in emulsion grains having high silver chloride contents (U.S. Pat. No. 5,399,475); and that emulsions increased in sensitivity and reduced in high illumination intensity reciprocity law failure can be obtained by incorporating iodide into emulsions high in silver chloride content so as to have a maximum iodide concentration at a sub-surface of the emulsion grains (e.g. U.S. Pat. Nos. 5,726,005 and 5,736,310); and that emulsions having excellent performances with respect to reciprocity law failure, temperature dependence at the time of exposure, and pressure immunity can be obtained by incorporating specified compounds into grains having iodide bands formed at the time when 93% of grain formation is completed (EP 0928988A).

On the other hand, there is a proposal to impart super-hard photographic characteristics, developability at low pH, and satisfactory storability to black-and-white silver halide light-sensitive materials, by using a combination of a metal complex, such as a Rh complex, and a selenium or tellurium compound having a specific structure, in photosensitive materials that can form halftone dot images for printing (graphic arts) (JP-A-8-95184). However, the reference does not apply such a combination to a silver halide color photographic light-sensitive material, and the adoption of the method specifically described in JP-A-8-95184 becomes a cause of considerable desensitization.

SUMMARY OF THE INVENTION

The present invention is a silver halide emulsion containing silver halide grains with a silver chloride content of at least 95 mole %, being sensitized with selenium and gold, and further comprising at least two kinds of compounds each having a function of oxidizing metallic silver clusters.

Further, the present invention is a silver halide emulsion containing silver halide grains with a silver chloride content of at least 95 mole %, being sensitized with selenium and gold, and further containing at least two compounds selected from the following Groups A to F;

Group A: a compound represented by the following formula (I),

Group B: a compound represented by the following formula (II),

Group C: a compound represented by the following formula (III),

Group D: hydrogen peroxide or a hydrogen peroxide adduct,

Group E: chlorous acid,

Group F: an inorganic sulfur, $$R^1—SO_2S\text{-}M \qquad \text{Formula (I)}$$

$$R^2—S—S—R^3 \qquad \text{Formula (II)}$$

Formula (III)

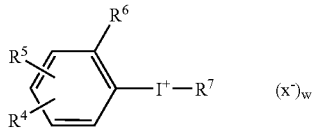

wherein $R^1$, $R^2$, and $R^3$ each independently represent an aliphatic group, an aromatic group, or a heterocyclic group, and $R^2$ and $R^3$ may combine with each other to form a ring; M represents a cation; $R^4$, $R^5$, and $R^6$ each independently represent a hydrogen atom, an aliphatic group, an aromatic group, a heterocyclic group, an alkoxy group, a hydroxyl group, a halogen atom, an aryloxy group, an alkylthio group, an arylthio group, an acyl group, a sulfonyl group, an acyloxy group, a carboxyl group, a cyano group, a nitro group, a sulfo group, an alkylsulfoxido group, or a trifluoroalkyl group, and any two groups among $R^4$, $R^5$, and $R^6$ may combine with each other to form a 5- or 6-membered ring or a polycyclic system; $R^7$ represents a carboxylate or $O^-$; $X^-$ represents an anion as a counter ion; and w represents 0 or 1; provided that w is 0 and $R^7$ is $O^-$ when $R^6$ is a carboxyl group or a sulfo group.

Further, the present invention is a silver halide color photographic light-sensitive material containing any of the above emulsions.

Further, the present invention is a silver halide color photographic light-sensitive material having, on a support, a red-sensitive silver halide emulsion layer, a green-sensitive silver halide emulsion layer, and a blue-sensitive silver halide emulsion layer, wherein one of the silver halide emulsion layers contains a silver halide emulsion with a silver chloride content of at least 95 mole %, and the silver halide emulsion contains at least one selenium compound and at least one metal complex represented by the following formula (D1);

$$[M^{D1}X^{D1}_{n}L^{D1}_{(6-n)}]^{m} \qquad \text{formula (D1)}$$

wherein, in formula (D1), $M^{D1}$ represents Cr, Mo, Re, Fe, Ru, Os, Co, Rh, Pd, or Pt; $X^{D1}$ represents a halogen ion; $L^{D1}$ represents a ligand other than $X^{D1}$; n represents 3, 4, 5, or 6; and m is an electric charge of the metal complex and represents 4−, 3−, 2−, 1−,0, or 1+; plural $X^{D1}$s may be the same or different, and when plural $L^{D1}$s exist, the plural $L^{D1}$s may be the same or different; provided that the metal complex represented by formula (D1) has no or only one CN ion as a ligand.

Other and further features and advantages of the invention will appear more fully from the following description

DETAILED DESCRIPTION OF THE INVENTION

As a result of our intensive studies, the present inventors have found that the aforementioned problems can be solved by the following embodiments of the invention.

(1) A silver halide emulsion containing silver halide grains with a silver chloride content of at least 95 mole %, being sensitized with selenium and gold, and further comprising at least two kinds of compounds each having a function of oxidizing metallic silver clusters.

(2) A silver halide emulsion containing silver halide grains with a silver chloride content of at least 95 mole %, being sensitized with selenium and gold, and further comprising at least two compounds selected from the following Groups A to F;

Group A: a compound represented by the following formula (I),

Group B: a compound represented by the following formula (II),

Group C: a compound represented by the following formula (III),

Group D: hydrogen peroxide or a hydrogen peroxide adduct,

Group E: chlorous acid,

Group F: an inorganic sulfur, $$R_1—SO_2S\text{-}M \qquad \text{Formula (I)}$$

$$R^2—S—S—R^3 \qquad \text{Formula (II)}$$

Formula (III)

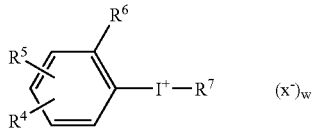

wherein $R^1$, $R^2$, and $R^3$ each independently represent an aliphatic group, an aromatic group, or a heterocyclic group, and $R^2$ and $R^3$ may combine with each other to form a ring; M represents a cation; $R^4$, $R^5$, and $R^6$ each independently represent a hydrogen atom, an aliphatic group, an aromatic group, a heterocyclic group, an alkoxy group, a hydroxyl group, a halogen atom, an aryloxy group, an alkylthio group, an arylthio group, an acyl group, a sulfonyl group, an acyloxy group, a carboxyl group, a cyano group, a nitro group, a sulfo group, an alkylsulfoxido group, or a trifluoroalkyl group, and any two groups among $R^4$, $R^5$, and $R^6$ may combine with each other to form a 5- or 6-membered ring or a polycyclic system; $R^7$ represents a carboxylate or $O^-$; $X^-$ represents an anion as a counter ion; and w represents 0 or 1; provided that w is 0 and $R^7$ is $O^-$ when $R^6$ is a carboxyl group or a sulfo group.

(3) The silver halide emulsion as described in (2), wherein at least one compound of the at least two compounds is selected from Group A.

(4) The silver halide emulsion as described in (2), wherein at least one compound of the at least two compounds is selected from Group B.

(5) The silver halide emulsion as described in (2), wherein at least one compound of the at least two compounds is selected from Group C.

(6) The silver halide emulsion as described in (2), wherein at least one compound of the at least two compounds is selected from Group D.

(7) The silver halide emulsion as described in (2), wherein at least one compound of the at least two compounds is selected from Group E.

(8) The silver halide emulsion as described in (2), wherein at least one compound of the at least two compounds is selected from Group F.

(9) The silver halide emulsion as described in (2), wherein the at least two compounds are selected from different groups of Groups A to F.

(10) The silver halide emulsion as described in (9), wherein at least one compound of the at least two compounds is selected from Group A and at least one compound of the rest is selected from Groups B to F.

(11) The silver halide emulsion as described in (9), wherein at least one compound of the at least two compounds is selected from Group B and at least one compound of the rest is selected from Groups A, and C to F.

(12) The silver halide emulsion as described in (9), wherein at least one compound of the at least two compounds is selected from Group C and at least one compound of the rest is selected from Groups A, B, and D to F.

(13) The silver halide emulsion as described in (9), wherein at least one compound of the at least two compounds is selected from Group D and at least one compound of the rest is selected from Groups A to C, E, and F.

(14) The silver halide emulsion as described in (9), wherein at least one compound of the at least two compounds is selected from Group E and at least one compound of the rest is selected from Groups A to D, and F.

(15) The silver halide emulsion as described in (9), wherein at least one compound of the at least two compounds is selected from Group F and at least one compound of the rest is selected from Groups A to E.

(16) The silver halide emulsion as described in any one of (1) to (15), wherein the silver halide grains have an average side length ranging from 0.10 μm to 0.60 μm.

(17) A silver halide color photographic light-sensitive material having, on a support, a yellow-dye-forming silver halide emulsion layer, a magenta-dye-forming silver halide emulsion layer, and a cyan-dye-forming silver halide emulsion layer, wherein at least one silver halide emulsion layer contains the silver halide emulsion described in any of (1) to (16).

(18) A silver halide color photographic light-sensitive material having, on a support, a yellow-dye-forming silver halide emulsion layer, a magenta-dye-forming silver halide emulsion layer, and a cyan-dye-forming silver halide emulsion layer, wherein the yellow-dye-formming silver halide emulsion layer contains the silver halide emulsion described in any of (1) to (16).

(19) A silver halide color photographic light-sensitive material having, on a support, a yellow-dye-forming silver halide emulsion layer, a magenta-dye-forming silver halide emulsion layer, and a cyan-dye-forming silver halide emulsion layer, wherein the silver halide emulsion layer nearest to the support contains the silver halide emulsion described in any of (1) to (16).

(Hereinafter, a first embodiment of the present invention means to include the silver halide emulsions described in the items (1) to (16) above, and the silver halide color photographic light-sensitive materials described in the items (17) to (19) above.)

(20) A silver halide color photographic light-sensitive material having, on a support, a red-sensitive silver halide emulsion layer, a green-sensitive silver halide emulsion layer, and a blue-sensitive silver halide emulsion layer, wherein one of the silver halide emulsion layers contains a silver halide emulsion with a silver chloride content of at least 95 mole %, and the silver halide emulsion contains at least one selenium compound and at least one metal complex represented by the following formula (D1);

$$[M^{D1}X^{D1}{}_{n}L^{D1}{}_{(6-n)}]^{m} \quad \text{formula (D1)}$$

wherein, in formula (D1), $M^{D1}$ represents Cr, Mo, Re, Fe, Ru, Os, Co, Rh, Pd, or Pt; $X^{D1}$ represents a halogen ion; $L^{D1}$ represents a ligand other than $X^{D1}$; n represents 3, 4, 5, or 6; and m is an electric charge of the metal complex and represents 4−, 3−, 2−, 1−,0, or 1+; plural $X^{D1}$s may be the same or different; and when plural $L^{D1}$s exist, the plural $L^{D1}$s may be the same or different; provided that the metal complex represented by formula (D1) has no or only one CN ion as a ligand.

(21) The silver halide color photographic light-sensitive material as described in (20), wherein the metal complex represented by formula (D1) is contained in silver halide grains in an amount of $1\times10^{-10}$ to $1\times10^{-6}$ mole per mole of silver atom.

(22) The silver halide color photographic light-sensitive material as described in (20) or (21), wherein the silver halide emulsion containing the selenium compound further contains at least one metal complex represented by the following formula (D2);

$$[IrX^{D2}{}_{n}L^{D2}{}_{(6-n)}]^{m} \quad \text{formula (D2)}$$

wherein, in formula (D2), $X^{D2}$ represents a halogen ion or a pseudohalogen ion other than a cyanate ion; $L^{D2}$ represents a ligand different from $X^{D2}$; n represents 3, 4, or 5; m represents an electric charge of the metal complex and is 5−,4−,3−,2−,1−,0, or 1+; plural $X^{D2}$s may be the same or different; and when plural $L^{D2}$s exist, the plural $L^{D2}$s may be the same or different.

(23) The silver halide color photographic light-sensitive material as described in any of (20) to (22), wherein the silver halide emulsion containing the selenium compound further contains silver iodide in an amount of 0.05 mole to 1.0 mole per mole of silver atom, and silver halide grains contained in the silver halide emulsion have a silver iodide-containing phase higher in silver iodide concentration than the surrounding portions.

(24) The silver halide color photographic light-sensitive material as described in any of (20) to (23), wherein the silver halide emulsion containing the selenium compound includes silver halide grains having an average sphere-equivalent grain diameter of 0.6 μm or below.

(25) The silver halide color photographic light-sensitive material as described in any of (20) to (24), wherein the silver halide emulsion containing the selenium compound contains a coupler in a proportion of 0.6 to 1 equivalent to 1 mole of silver.

(26) The silver halide color photographic light-sensitive material as described in any of (20) to (25), wherein a total coating amount of silver is from 0.2 $g/m^2$ to 0.45 $g/m^2$.

(27) The silver halide color photographic light-sensitive material as described in any of (20) to (26), wherein a total coating amount of gelatin is from 3 $g/m^2$ to 6 $g/m^2$.

(28) The silver halide color photographic light-sensitive material as described in any of (20) to (27), which is a silver halide color photographic light-sensitive material for use in rapid processing, and which forms an image in a processing performed under a condition that a color developing step is started within 9 seconds of image-wise exposure and the color developing step is finished within 28 seconds.

(29) The silver halide color photographic light-sensitive material as described in any of (20) to (28), which is a silver halide color photographic light-sensitive material for use in digital exposure wherein image-wise exposure is performed by laser scanning exposure.

(30) The silver halide color photographic light-sensitive material as described in any of (20) to (29), wherein at least one of the silver halide emulsion layers comprises two silver halide emulsions, one of the two is the silver halide emulsion as described in any of (20) to (29) and the other is a silver halide emulsion with a silver chloride content of 95 mole % or higher and being different in sensitivity from the silver halide emulsion as described in any of (20) to (29).

(31) The silver halide color photographic light-sensitive material as described in (30), wherein, between the two silver halide emulsions, desensitization by at least one metal complex represented by formula (D1) is greater in a low-sensitivity emulsion than a high-sensitive emulsion.

(32) The silver halide color photographic light-sensitive material as described in (30) or (31), wherein, between the two silver halide emulsions, a low-sensitivity emulsion is higher in content of at least one metal complex represented by formula (D1) per mole of silver halide, than a high-sensitivity emulsion.

(33) The silver halide color photographic light-sensitive material as described in any of (20) to (32), wherein the metal complex represented by formula (D1) is a metal complex represented by formula (D1A):

$$[M^{D1A}X^{D1A}{}_{n}L^{D1A}{}_{(6-n)}]^{m} \quad \text{formula (D1A)}$$

wherein, in formula (D1A), $M^{D1A}$ represents Re, Ru, Os, or Rh; $X^{D1A}$ represents a halogen ion; $L^{DIA}$ represents NO or NS when MDIA is Re, Ru, or Os, while $L^{D1A}$ represents $H_2O$, OH, or O when $M^{D1A}$ is Rh; n represents 3, 4, 5, or 6; and m represents an electric charge of the metal complex and is 4−, 3−, 2−, 1−,0, or 1+; plural $X^{D1A}$s may be the sane or different; and when plural $L^{D1A}$s exist, the plural $L^{D1A}$s may be the same or different.

(34) The silver halide color photographic light-sensitive material as described in any of (20) to (33), wherein $M^{D1}$ of the metal complex represented by formula (D1) is Rh.

(35) The silver halide color photographic light-sensitive material as described in any of (22) to (34), wherein the metal complex represented by formula (D2) is a metal complex represented by formula (D2A):

$$[IrX^{D2A}{}_{n}L^{D2A}{}_{(6-n)}]^{m} \quad \text{formula (D2A)}$$

wherein, in formula (D2A), $X^{D2A}$ represents a halogen ion or a pseudohalogen ion other than a cyanate ion; $L^{D2A}$ represents an inorganic ligand different from $X^{D2A}$; n represents 3, 4, or 5; m represents an electric charge of the metal complex and is 5−, 4−, 3−, 2−, 1−,0, or 1+; plural $X^{D2A}$s may be the same or different; and when plural $L^{D2A}$s are present, these plural $L^{D2A}$s may be the same or different.

(36) The silver halide color photographic light-sensitive material as described in any of (22) to (34), wherein the metal complex represented by formula (D2) is a metal complex represented by formula (D2B):

$$[IrX^{D2B}{}_{n}L^{D2B}{}_{(6-n)}]^{m} \quad \text{formula (D2B)}$$

wherein, in formula (D2B), $X^{D2B}$ represents a halogen ion or a pseudohalogen ion other than a cyanate ion; $L^{D2B}$ represents a ligand having a chained or cyclic hydrocarbon as a basic structure, or a ligand in which a portion of carbon atoms or hydrogen atoms of the basic structure is substituted with other atoms or atom groups; n represents 3, 4, or 5; m represents an electric charge of the metal complex and is 5−, 4−, 3−, 2−, 1−, 0, or 1+; plural $X^{D2B}$s may be the same or different; and when plural $L^{D2B}$s are present, these plural $L^{D2B}$s may be the same or different.

(37) The silver halide color photographic light-sensitive material as described in any of (22) to (34), wherein the metal complex represented by formula (D2) is a metal complex represented by formula (D2C):

$$[IrX^{D2C}{}_{n}L^{D2C}{}_{(6-n)}]^{m} \quad \text{formula (D2C)}$$

wherein, in formula (D2C), $X^{D2C}$ represents a halogen ion or a pseudohalogen ion other than a cyanate ion; $L^{D2C}$ represents a 5-membered ring ligand having at least one nitrogen atom and at least one sulfur atom in its ring skeleton that may have a substituent on any of the carbon atoms in said ring skeleton; n represents 3, 4, or 5; m represents an electric charge of the metal complex and is 5−, 4−, 3−, 2−, 1−,0, or 1+; plural $X^{D2C}$s may be the same or different; and when plural $L^{D2C}$s are present, these plural $L^{D2C}$s may be the same or different.

(38) The silver halide color photographic light-sensitive material as described in any of (22) to (34), wherein the metal complex represented by formula (D2) is a metal complex represented by formula (D2D):

$$[IrX^{D2D}{}_{n}L^{D2D}{}_{(6-n)}]^{m} \quad \text{formula (D2D)}$$

wherein, in formula (D2D), $X^{D2D}$ represents a halogen ion or a pseudohalogen ion other than a cyanate ion; $L^{D2D}$ represents a 5-membered ring ligand having at least two nitrogen atoms and at least one sulfur atom in its ring skeleton that may have a substituent on any of the carbon atoms in said ring skeleton; n represents 3, 4, or 5; m represents an electric charge of the metal complex and is 5−, 4−, 3−, 2−, 1−,0, or 1+; plural $X^{D2D}$s may be the same or different; and when plural $L^{D2D}$s are present, these plural $L^{D2D}$s may be the same or different.

(39) The silver halide color photographic light-sensitive material as described in any of (20) to (38), which is a silver halide color photographic light-sensitive material, having, on a reflective support, at least one silver halide emulsion layer containing a yellow-dye-forming coupler, at least one silver halide emulsion layer containing a magenta-dye-forming coupler, and at least one silver halide emulsion layer containing a cyan-dye-forming coupler.

(40) The silver halide color photographic light-sensitive material as described in (39), wherein the silver halide emulsion layer containing a yellow-dye-forming coupler includes a silver halide emulsion having a sphere-equivalent diameter of 0.6 μm or below.

(41) The silver halide color photographic light-sensitive material as described in any of (20) to (40), wherein at least one silver halide emulsion in the silver halide emulsion layers contains 0.1 to 7 mole % of silver bromide, and silver halide grains contained in the silver halide emulsion have a silver bromide-containing phase having a silver bromide concentration higher than the surrounding portions.

(42) The silver halide color photographic light-sensitive material as described in any of (20) to (41), which is a silver halide color photographic light-sensitive material for use in digital exposure wherein image-wise exposure is performed by scanning exposure using as a light source a blue semiconductor laser having a light-emission wavelength in the range of 420 to 460 nm.

(Hereinafter, a second embodiment of the present invention means to include the silver halide color photographic light-sensitive materials described in the items (20) to (42) above.)

Herein, the present invention means to include all of the above first and second embodiments, unless otherwise specified.

The present invention is described below in detail.

The silver halide emulsion of the first embodiment of the present invention is a silver halide emulsion that contains silver halide grains having a silver chloride content of at least 95 mole %; further contains at least two kinds of compounds having a function of oxidizing metallic silver clusters (which are aggregates of silver atoms, formed in the processes of grain formation and after-ripening, and sometimes become a cause of fogging); and is sensitized with selenium and gold.

Herein, the term "compound having a function of oxidizing metallic silver clusters" refers to the compound capable of suppressing fogging that occurs when a coating sample prepared by coating a silver halide emulsion layer (coating amount of silver: $1.5\times10^{-3}$ mole/$m^2$) together with a protective film of gelatin (coating amount of gelatin: 1.0 g/$m^2$) is immersed in a gold intensifier having the following composition for 3 minutes at 20° C. prior to development processing, subjected to 1-minute washing, and then subjected to the usual development processing:

Gold Intensifier 0.1%

| | |
|---|---|
| $H[AuCl_4]$ | 4 ml |
| $H_2O$ | 88 ml |
| 1.0% KSCN | 5 ml |
| 1.2% NaCl | 3 ml |

Any compounds may be adopted in the present invention as far as they have such a property as described above. For instance, the compounds for use in the present invention may be generally known oxidizing agents, such as hydrogen peroxide, nitric acid, nitrous acid, halogen elements including bromine and iodine, salts of oxy acids, such as pernanganates (e.g., $KMnO_4$) and chromates (e.g., $K_2CrO$); perhalogenates (e.g., potassium periodate), and high-valence metal salts (e.g., potassium ferricyanide).

In the present invention, it is preferable that, as the compounds having functions of oxidizing metallic silver clusters, at least two kinds of compounds are selected from the following Groups A to F. Additionally, it is preferred that no sulfinic acid compound be used in combination with those compounds.

Group A: a compound represented by the following formula (I)

Group B: a compound represented by the following formula (II)

Group C: a compound represented by the following formula (III)

Group D: hydrogen peroxide or a hydrogen peroxide adduct

Group E: chlorous acid

Group F: an inorganic sulfur $R^1—SO_2S\text{-}M$ Formula (I)

$R^2—S—S—R^3$ Formula (II)

Formula (III)

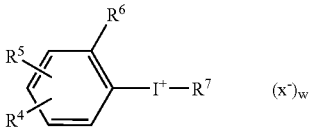

In the above formulae, $R^1$, $R^2$, and $R^3$ each independently represent an aliphatic group, an aromatic group, or a heterocyclic group, and M represents a cation. Herein, $R^2$ and $R^3$ may combine with each other to form a ring. $R^4$, $R^5$, and $R^6$ each independently represent a hydrogen atom, an aliphatic group, an aromatic group, a heterocyclic group, an alkoxy group, a hydroxyl group, a halogen atom, an aryloxy group, an alkylthio group, an arylthio group, an acyl group, a sulfonyl group, an acyloxy group, a carboxyl group, a cyano group, a nitro group, a sulfo group, an alkylsulfoxido group, or a trifluoroalkyl group. Herein, any two among those substituents $R^4$, $R^5$, and $R^6$ may combine with each other to form a 5- or 6-membered ring or a polycyclic system. $R^7$ represents a carboxylate or $O^-$, $X^-$ represents an anion as a counter ion, and w represents 0 or 1, provided that w is 0 and $R^7$ is $O^-$ when $R^6$ is a carboxyl group or a sulfo group.

Compounds of Groups A to F are described below.

Compounds represented by formula (I), which form Group A, are explained first.

In thiosulfonic acid compounds represented by formula (I), $R^1$ represents an aliphatic group, an aromatic group, or a heterocyclic group, and M represents a cation. The aliphatic group of $R^1$ includes linear, branched or cyclic alkyl, alkenyl, and alkynyl groups. Although there is no particular limit to the number of carbon atoms contained in these groups each, the number of carbon atoms is preferably of such an order as to permit dissolution in water, lower alcohol including methanol and ethanol; an organic solvent including ethyl acetate, or a mixture of two or more thereof. Aliphatic groups containing from 1 to 8 carbon atoms are preferred. Examples of such aliphatic groups include a methyl group and an ethyl group. The aromatic group of $R^1$ includes a phenyl group and a naphthyl group, and the heterocyclic group of $R^1$ is preferably a group derived from a 5- to 7-membered ring containing as a hetero atom at least one nitrogen, oxygen, or sulfur atom. This ring may be a saturated ring or an unsaturated ring, and it may be a hetero ring fused with another ring such as a benzene ring. One example of such a hetero ring is an indole ring. These aliphatic, aromatic, and heterocyclic groups have no particular restriction as to the number and the kinds of substituents they can have, but preferred are substituents capable of promoting or at least permitting dissolution in water, organic solvents, or mixtures thereof, as mentioned above.

Examples of such substituents include an alkoxy group, an aryl group, an alkyl group, a halogen atom, an amino group, an acylamino group, a carboxyl group, a hydroxyl group, and a heterocyclic group.

$R^1$ is preferably an aliphatic group or an aromatic group, and especially preferably an aromatic group.

Examples of the cation represented by M include an alkali metal ion (e.g., $Li^+$, $Na^+$, $K^+$) and an ammonium ion (e.g., $NH_4^+$, tetraethylammonium ion).

Typical examples of a thiosulfonic acid compound for use in the present invention are illustrated below.

| | |
|---|---|
| I-1 | $CH_3SO_3SNa$ |
| I-2 | $C_2H_3SO_2SK$ |
| I-3 | $C_3H_{13}SO_2SNa$ |
| I-4 | $CH_3(CH_3)_2CHCH_2SO_2S—NH_4$ (with $C_2H_5$) |
| I-5 | $C_{12}H_{23}SO_2SNa$ |
| I-6 | $(CH_3)_2CH—SO_2SK$ |
| I-7 | $CH_3OCH_2CH_2SO_2S•Na$ |
| I-8 | $CH_2=CHCH_2SO_2SNa$ |
| I-9 | 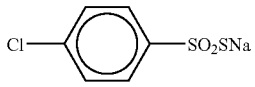 |
| I-10 | 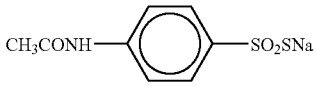 |
| I-11 | 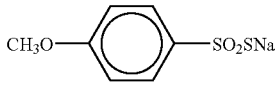 |
| I-12 | 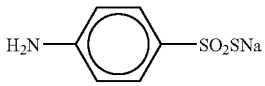 |
| I-13 | 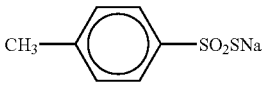 |
| I-14 | 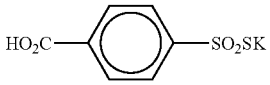 |
| I-15 | $C_2H_5SO_2SNa$ |
| I-16 | $C_4H_9SO_2SLi$ |
| I-17 | $C_8H_{17}SO_2SNa$ |
| I-18 | $C_{10}H_{21}SO_2SNa$ |
| I-19 | $C_{16}H_{33}SO_2SNa$ |
| I-20 | $t\text{-}C_4H_9SO_2SNa$ |
| I-21 | 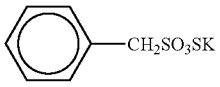 |

-continued

| | |
|---|---|
| I-22 | 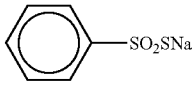 |

The amount of a Group A compound to be used is preferably from $1\times10^{-7}$ to $1\times10^{-1}$ mole per mole of silver halide. It is more preferable that the addition amount of a Group A compound is from $1\times10^{-6}$ to $1\times10^{-2}$ mole/mole Ag, and particularly from $1\times10^{-5}$ to $1\times10^{-3}$ mole/mole Ag.

Disulfide compounds represented by formula (II), which form Group B, are explained.

$R^2$ and $R^3$ each independently represent an aliphatic group, an aromatic group, or a heterocyclic group. Herein, $R^2$ and $R^3$ may combine with each other to form a ring.

The aliphatic group of $R^2$ and $R^3$ each includes an alkyl group, an alkenyl group, an alkynyl group, a cycloalkyl group, a cycloalkenyl group, and an aralkyl group. Of these groups, the groups containing 1 to 18 carbon atoms are preferred over the others. Examples of such groups include methyl, ethyl, n-propyl, i-propyl, ibutyl, t-pentyl, n-hexyl, n-decyl, allyl, 3-pentenyl, propargyl, cyclohexyl, cyclohexenyl, benzyl, and phenethyl. The aromatic group of $R^2$ and $R^3$ each includes monocyclic or fused-ring aryl groups, preferably those containing 6 to 20 carbon atoms; and examples thereof include a phenyl group and a naphthyl group. The heterocyclic group of $R^2$ and $R^3$ each is preferably those containing 3 to 10 carbon atoms, such as morpholino and pyridyl. $R^2$ and $R^3$ may combine with each other to form a ring, preferably to form a 5- or 6-membered ring together with —S—S—.

Each of the groups represented by $R^2$ and $R^3$ may have a substituent, examples of which are given below. Further, each group may have two or more different substituents. Typical examples of the substituent include a carboxyl group, an alkoxycarbonyl group (such as ethoxycarbonyl), an aryloxycarbonyl group (such as phenoxycarbonyl), an amino group, a substituted amino group (such as ethylamino, dimethylamino, and methylphenylamino), a hydroxyl group, an alkoxy group (such as methoxy), an aryloxy group (such as phenoxy), an acyl group (such as acetyl), an acylamino group (such as acetamido), an ureido group (such as N,N-dimethylureido), a nitro group, a sulfonyl group (such as methylsulfonyl and phenylsulfonyl), a sulfo group, a mercapto group, an alkylthio group (such as methylthio), a cyano group, a phosphonyl group, a sulfamoyl group (such as unsubstituted sulfamoyl and N,N-dimethylsulfamoyl), a carbamoyl group (such as unsubstituted carbamoyl and N,N-diethylcarbamoyl), an alkyl group (such as ethyl), an aryl group (such as phenyl), a heterocyclic group (such as morpholino and pyrazolyl), and a halogen atom (such as chlorine and bromine). These substituents may further be substituted.

$R^2$ and $R^3$ each are preferably an aliphatic group or an aromatic group, and more preferably an aliphatic group.

Specific examples of the compound represented by formula (II) will be shown below, but the present invention is not limited to these.

II-1

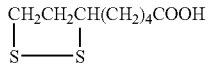

II-2

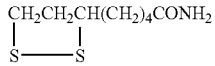

II-3

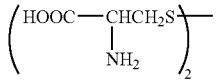

II-4

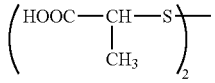

II-5

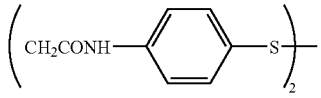

II-6

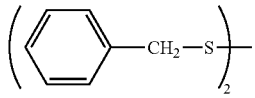

II-7

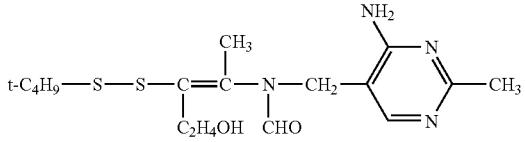

II-8

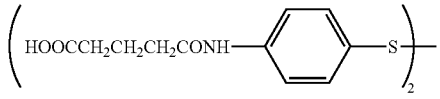

II-9

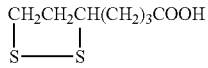

II-10

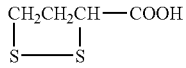

II-11

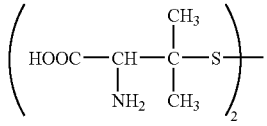

II-12

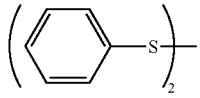

II-13

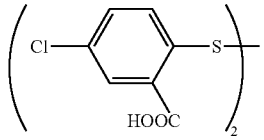

II-14

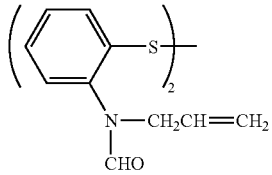

-continued

II-15

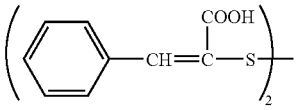

II-16

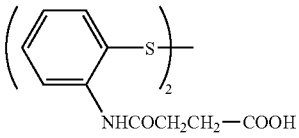

The amount of a Group B compound to be used is preferably from $1\times10^{-7}$ to $1\times10^{-1}$ mole per mole of silver halide. It is more preferable that the addition amount of a Group B compound is from $1\times10^{-6}$ to $1\times10^{-2}$ mole/mole Ag, and particularly preferably from $1\times10^{-5}$ to $1\times10^{-3}$ mole/mole Ag.

Aryliodonium compounds represented by formula (III), which form Group C, are explained below in detail.

In formula (III), $R^4$, $R^5$, and $R^6$ each independently represent a hydrogen atom, an aliphatic group, an aromatic group, a heterocyclic group, an alkoxy group, a hydroxyl group, a halogen atom, an aryloxy group, an alkylthio group, an arylthio group, an acyl group, a sulfonyl group, an acyloxy group, a carboxyl group, a cyano group, a nitro group, a sulfo group, an alkylsulfoxido group, or a trifluoroalkyl group. Herein, any two among $R^4$, $R^5$, and $R^6$ may combine with each other to form a 5- or 6-membered ring or a polycyclic system. Incidentally, each of the groups recited above and the ring formed by combining any two of $R^4$, $R^5$, and $R^6$ may further have a substituent(s).

The aliphatic group of $R^4$, $R^5$, and $R^6$ each is preferably an alkyl group containing 1 to 22 carbon atoms or an alkenyl or alkynyl group containing 2 to 22 carbon atoms, more preferably an alkyl group containing 1 to 10 carbon atoms or an alkenyl or alkynyl group containing 3 to 5 carbon atoms, and particularly preferably an alkyl group containing 1 to 5 carbon atoms. Each of these groups may either have a substituent or not. Examples of such an alkyl group include methyl, ethyl, propyl, butyl, pentyl, hexyl, octyl, 2-ethylhexyl, decyl, dodecyl, hexadecyl, octadecyl, cyclohexyl, isopropyl, and t-butyl; examples of such an alkenyl group include allyl and butenyl; and examples of such an alkynyl group include propargyl and butynyl.

The aromatic group of $R^4$, $R^5$, and $R^6$ each is preferably an aromatic group containing 6 to 20 carbon atoms, such as phenyl or naphthyl; more preferably an aromatic group containing 6 to 10 carbon atoms, and particularly preferably a phenyl group. Each of these groups may either have a substituent or not.

The heterocyclic group of $R^4$, $R^5$, and $R^6$ each is preferably a 3- to 15-membered heterocyclic group containing at least one atom selected from nitrogen, oxygen, sulfur, selenium, and tellurium; and more preferably a 5- or 6-membered heterocyclic group containing at least one atom selected from nitrogen, oxygen, sulfur, selenium, and tellurium. Examples of a hetero ring in such a heterocyclic group include pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotrizole, tetrazole, oxadiazole, and thiadiazole.

In addition, $R^4$, $R^5$, and $R^6$ each represent an alkoxy group (e.g., methoxy, ethoxy, octyloxy), a hydroxyl group, a halogen atom, an aryloxy group (e.g., phenoxy), an alkylthio group (e.g., methylthio, butylthio), an arylthio group (e.g., phenylthio), an acyl group (e.g., acetyl, propionyl, butyryl, valeryl), a sulfonyl group (e.g., methylsulfonyl, phenylsulfony), an acyloxy group (e.g., acetoxy, benzoxy), a carboxyl group, a cyano group, a nitro group, a sulfo group, an alkylsulfoxido group (e.g., methanesulfoxido, benzenesulfoxido), or a trifluoroalkyl group (e.g., trifluoromethyl).

The ring formed by combining any two of $R^4$, $R^5$, and $R^6$ may be either monocyclic or polycyclic, and it may be alicyclic, aromatic, or heterocyclic.

Of the foregoing groups represented by $R^4$, $R^5$, and $R^6$, preferred are groups that do not inhibit reciprocity-law-improvement activities of the resultant aryliodonium compounds.

As to the groups represented by $R^4$, $R^5$, and $R^6$, one preferred embodiment is that $R^4$, $R^5$, and $R^6$ each independently represent a hydrogen atom, an aliphatic group, an aromatic group, or a heterocyclic group. Another preferred embodiment is that $R^4$ and $R^5$ each independently represent a hydrogen atom, a halogen atom, an aliphatic group, an aromatic group, or a heterocyclic group, and $R^6$ represents a sulfo group or a carboxyl group.

$R^7$ represents a carboxylate (e.g., acetate, formate, benzoate, trifluoroacetate) or $O^-$, and w represents 0 or 1; however, w is 0 and $R^7$ is $O^-$ when $R^6$ represents a sulfo group or a carboxyl group.

$X^-$ represents an anion as a counter ion. The counter ion is preferably such an anion as not to ruin reciprocity-law-improving effect of the resultant compound. Of such anions, water-soluble ones are more preferred.

Examples of $X^-$ include $CH_3CO_2^-$, $Cl^-$, $CF_3SO_3^-$, $PF_6^-$, $Br^-$, $BF_4^-$, $AsF_6^-$, $CH_3SO_3^-$, $CF_3CO_2^-$, $CH_3C_6H_4SO_3^-$, $HSO_4^-$, $SbF_6^-$, $HCO_2^-$, and $CCl_3CO_2^-$. Of these anions, $CH_3CO_2^-$, $CH_3SO_3^-$, and $PF_6^-$are particularly preferred as $X^-$.

Each of the groups represented by $R^4$ to $R^7$ may further have a substituent. Examples of such a substituent include an alkyl group (such as methyl, ethyl, hexyl), an alkoxy group (such as methoxy, ethoxy, octyloxy), an aryl group (such as phenyl, naphthyl, tolyl), a hydroxyl group, a halogen atom, an aryloxy group (such as phenoxy), an alkylthio group (such as methylthio, butylthio), an arylthio group (such as phenylthio), an acyl group (such as acetyl, propionyl, butyryl, valeryl), a sulfonyl group (such as methylsulfonyl, phenylsulfonyl), an acylamino group, a sulfonylamino group, an acyloxy group (such as acetoxy, benzoxy), a carboxyl group, a cyano group, a sulfo group, and an amino group (including an alkylamino group, an arylamino group, and a heterocyclic amino group). Of these substituents, alkyl groups (especially lower alkyl groups, i.e., alkyl groups containing 1 to 4 carbon atoms, such as methyl) and halogen atoms (such as chlorine) are preferred over the others.

Specific examples of the compound represented by formula (III) will be shown below, but the present invention is not limited to these.

III-1

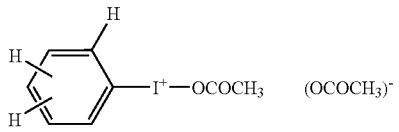

-continued

III-2

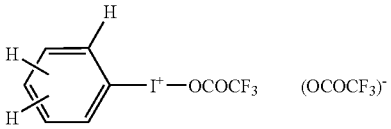

III-3

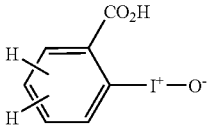

III-4

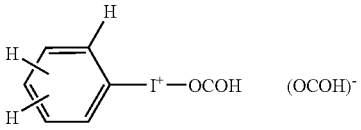

III-5

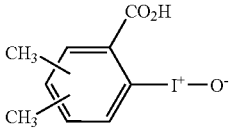

III-6

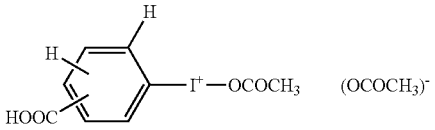

III-7

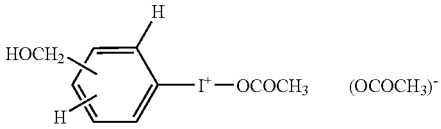

III-8

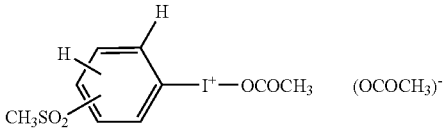

The amount of a Group C compound to be used is preferably from $1\times10^{-7}$ to $1\times10^{-1}$ mole per mole of silver halide. It is more preferable that the addition amount of a Group C compound is from $1\times10^{-6}$ to $1\times10^{-2}$ mole/mole Ag, and particularly preferably from $1\times10^{-5}$ to $1\times10^{-3}$ mole/mole Ag.

Hydrogen peroxide and hydrogen peroxide adducts, which form Group D, are explained below.

Examples of hydrogen peroxide adducts include $NaBO_2.H_2O_2.H_2O$, $2NaCO_3.3H_2O_2$, $Na_4P_2O_7.2H_2O_2$, and $2Na_2SO_4.H_2O_2.2H_2O$. The amount of a Group D compound to be used is preferably from $1\times10^{-7}$ to $1\times10^{-1}$ mole per mole of silver halide. It is more preferable that the addition amount of a Group D compound is from $1\times10^{-6}$ to $1\times10^{-2}$ mole/mole Ag, and particularly preferably from $1\times10^{-5}$ to $1\times10^{-3}$ mole/mole Ag.

The group E refers to a chlorous acid. The amount of the chlorous acid is preferably from $1\times10^{-7}$ to $1\times10^{-1}$ mole per mole of silver halide. It is more preferable that the addition amount of the chlorous acid is from $1\times10^{-6}$ to $1\times10^{-2}$ mole/mole Ag, and particularly preferably from $1\times10^{-5}$ to $1\times10^{-3}$ mole/mole Ag.

The inorganic sulfur of Group F refers to sulfur as a simple substance or the elemental sulfur, preferably α-sulfur which is stably present in a solid state at ordinary temperature. The amount of inorganic sulfur to be used is preferably from $1\times10^{-7}$ to $1\times10^{-1}$ mole per mole of silver halide. It is more preferable that the addition amount of inorganic sulfur is from $1\times10^{-6}$ to $1\times10^{-2}$ mole/mole Ag, and particularly preferably from $1\times10^{-5}$ to $1\times10^{-3}$ mole/mole Ag.

In the first embodiment of the present invention, it is preferable that the at least two compounds are selected from different groups in Groups A to F, and especially preferably selected from Group A and Group B, respectively.

The selenium compound for use in the first and second embodiments of the present invention is described.

In the invention, the selenium compound may be any of selenium compounds capable of sensitizing silver halide emulsions; however, compounds represented by the following formula (SE1), (SE2), or (SE3) are preferred.

Formula (SE1)

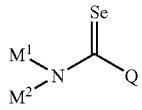

In formula (SE1), $M^1$ and $M^2$ each independently represent a hydrogen atom, an alkyl group, an alkenyl group, an alkynyl group, an aryl group, a heterocyclic group, an acyl group, an amino group, an alkoxy group, a hydroxy group, or a carbamoyl group; Q represents an alkyl group, an alkenyl group, an alkynyl group, an aryl group, a heterocyclic group, $OM^3$, or $NM^4M^{5-}$, herein $M^3$, $M^4$, and $M^5$ each independently represent a hydrogen atom, an alkyl group, an alkenyl group, an alkynyl group, an aryl group, or a heterocyclic group; and any two or three groups of $M^1$, $M^2$, and Q may bond together, to form a ring structure.

Formula (SE2)

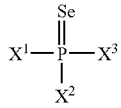

In formula (SE2), $X^1$, $X^2$, and $X^3$ each independently represent an alkyl group, an alkenyl group, an alkynyl group, an aryl group, a heterocyclic group, $OJ^1$, or $NJ^2J^3$, herein $J^1$, $J^2$, and $J^3$ each independently represent a hydrogen atom, an alkyl group, an alkenyl group, an alkynyl group, an aryl group, or a heterocyclic group.

$E^1$-Se-$E^2$ Formula (SE3)

In formula (SE3), $E^1$ and $E^2$ each independently represent an alkyl group, an alkenyl group, an alkynyl group, an aryl group, a heterocyclic group, an acyl group, an alkoxycarbonyl group, an aryloxycarbonyl group, or a carbamoyl group. $E^1$ and $E^2$ may be the same or different.

In the following, the selenium compound represented by formula (SE1) will be explained in detail.

In formula (SE1), "alkyl group" represented by $M^1$ to $M^5$ and Q means a straight-chain, branched, or cyclic, substituted or unsubstituted alkyl group. Preferred examples thereof include a straight-chain or branched, substituted or unsubstituted alkyl group having 1 to 30 carbon atoms (e.g., a methyl group, an ethyl group, an isopropyl group, a n-propyl group, a n-butyl group, a t-butyl group, a 2-pentyl group, a n-hexyl group, a n-octyl group, a t-octyl group, a 2-ethylhexyl group, a 1,5-dimethylhexyl group, a n-decyl group, a n-dodecyl group, a n-tetradecyl group, a n-hexadecyl group, a hydroxyethyl group, a hydroxypropyl group, a 2,3-dihydroxypropyl group, a carboxymethyl group, a carboxyethyl group, a sodiumsulfoethyl group, a diethylaminoethyl group, a diethylaminopropyl group, a butoxypropyl group, an ethoxyethoxyethyl group, and a n-hexyloxypropyl group); a substituted or unsubstituted cycloalkyl group having 3 to 18 carbon atoms (e.g., a cyclopropyl group, a cyclopentyl group, a cyclohexyl group, a cyclooctyl group, an adamanthyl group, a cyclododecyl group, and 3-oxo-cyclohexyl group); a substituted or unsubstituted bicycloalkyl group having 5 to 30 carbon atoms (that is, a monovalent group formed by removing one hydrogen atom from a bicycloalkane having 5 to 30 carbon atoms, e.g., a bicyclo[1,2,2]heptane-2-yl group, a bicyclo[2,2,2]octane-3-yl group); and a tricycloalkyl group and the like, which may have more ring structures. Examples of the alkenyl group represented by $M^1$ to $M^5$ and Q include an alkenyl group having 2 to 16 carbon atoms (e.g., an allyl group, a 2-butenyl group, and a 3-pentenyl group). Examples of the alkynyl group represented by $M^1$ to $M^5$ and Q include an alkynyl group having 2 to 10 carbon atoms (e.g., a propargyl group, and a 3-pentynyl group).

Examples of the aryl group represented by $M^1$ to $M^5$ and Q include a substituted or unsubstituted phenyl or naphthyl group having 6 to 20 carbon atoms (such as unsubstituted phenyl, unsubstituted naphthyl, 3,5-dimethyl phenyl, 4-butoxyphenyl, and 4-dimethylaminophenyl). The heterocyclic group represented by $M^1$ to $M^5$ and Q is preferably a 3- to 12-membered heterocyclic group containing as ring constituent atoms 0 to 20 carbon atoms and at least one hetero atom (preferably a nitrogen atom, an oxygen atom, or a sulfur atom). Examples of the heterocyclic group include pyridyl, furyl, imidazolyl, piperidyl and morpholyl.

In formula (SE1), the acyl group represented by $M^1$ and $M^2$ is preferably an acyl group having 1 to 30 carbon atoms, and examples thereof include an acetyl group, a formyl group, a benzoyl group, a pivaloyl group, a caproyl group, and an n-nonanoyl group; the amino group represented by $M^1$ and $M^2$ is preferably an amino group having 0 to 30 carbon atoms, and examples thereof include an unsubstituted amino group, a methylamino group, a hydroxyethylamino group, an n-octylamino group, a dibenzylamino group, a dimethylamino group, and a diethylamino group; the alkoxy group represented by $M^1$ and $M^2$ is preferably an alkoxy group having 1 to 30 carbon atoms, and examples thereof include a methoxy group, an ethoxy group, an n-butyloxy group, a cyclohexyloxy group, an n-octyloxy group, and an n-decyloxy group; and the carbamoyl group represented by $M^1$ and $M^2$ is preferably a carbamoyl group having 1 to 30 carbon atoms, and examples thereof include an unsubstituted carbamoylgroup, an N,N-diethylcarbamoyl group, and an N-phenylcarbamoyl group.

In formula (SE1), $M^1$ and $M^2$, Q and $M^1$, or Q and $M^2$ may bond together to form a ring structure. Moreover, when Q represents $NM^4M^5$, $M^4$ and $M^5$ may bond together to form a ring structure.

$M^1$ to $M^5$ and Q in formula (SE1) may have a substituent(s) as many as possible. Examples of the substituent include a halogen atom (fluorine, chlorine, bromine, or iodine), an alkyl group (any of linear, branched, or cyclic alkyl groups including a bicycloalkyl group and an active methine group), an alkenyl group, an alkynyl group, an aryl group, a heterocyclic group (substitution position not questioned), an acyl group, an alkoxycarbonyl group, an aryloxycarbonyl group, a heterocyclic oxycarbonyl group, a carbamoyl group, a N-hydroxycarbamoyl group, a N-acylcarbamoyl group, a N-sulfonylcarbamoyl group, a N-carbamoylcarbamoyl group, a thiocarbamoyl group, a N-sulfamoylcarbamoyl group, a carbazoyl group, a carboxyl group or a salt thereof, an oxalyl group, an oxamoyl group, a cyano group, a carbonimidoyl group, a formyl group, a hydroxyl group, an alkoxy group (including a group containing ethyleneoxy or propyleneoxy units as repeating units), an aryloxy group, a heterocyclic oxy group, an acyloxy group, an alkoxy- or aryloxy-carbonyloxy group, a carbamoyloxy group, a sulfonyloxy group, an amino group, an alkyl-, aryl- or heterocyclic-amino group, an acylamino group, a sulfonamido group, a ureido group, a thioureido group, an N-hydroxyureido group, an imido group, an alkoxy- or aryloxy-carbonylamino group, a sulfamoylamino group, a semicarbazide group, a thiosemicarbazide group, a hydrazino group, an ammonio group, an oxamoylamino group, an N-alkyl- or N-aryl-sulfonylureido group, an N-acylureido group, an N-acylsulfamoylamino group, a hydroxylamino group, a nitro group, a heterocyclic group containing a quaternary nitrogen atom (e.g., pyridinio, imidazolio, quinolinio, or isoquinolinio), an isocyano group, an imino group, a mercapto group, an alkyl-, aryl-, or heterocyclic-thio group, an alkyl-, aryl-, or heterocyclic-dithio group, an alkyl- or aryl-sulfonyl group, an alkyl- or aryl-sulfinyl group, a sulfo group or a salt thereof, a sulfamoyl group, an N-acylsulfamoyl group, an N-sulfonylsulfamoyl group or a salt thereof, a phosphino group, a phosphinyl group, a phosphinyloxy group, a phosphinylamino group, and a silyl group.

Herein, the active methine group refers to a methine group substituted by two electron-withdrawing groups. Herein, the electron-withdrawing group is preferably a group having the Hammett's substituent constant $\sigma_p$ value of 0 or more, and example thereof include an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group, and a carbonimidoyl group. These two electron-withdrawing groups may be bonded with each other to form a ring structure. Additionally, the term "salt" as used herein is intended to include cations of alkali metals, alkaline earth metals, and heavy metals, and organic cations such as ammonium ions and phosphonium ions. Those substituents may further be substituted with any of those substituents.

As the compound represented by formula (SE1), the following case is more preferable: $M^1$ and $M^2$ each independently are a hydrogen atom, a substituted or unsubstituted, straight-chain or branched alkyl group having 1 to 6 carbon atoms, a substituted or unsubstituted cycloalkyl group having 3 to 6 carbon atoms, an alkenyl group having 2 to 6 carbon atoms, a substituted or unsubstituted phenyl group having 6 to 10 carbon atoms, a heterocyclic group, or an acyl group; and Q is a substituted or unsubstituted, straight-chain or branched alkyl group having 1 to 6 carbon atoms, a substituted or unsubstituted cyclic alkyl group having 3 to 6 carbon atoms, an alkenyl group having 2 to 6 carbon atoms, a substituted or unsubstituted phenyl group having 6 to 10 carbon atoms, or $NM^4M^5$, in which $M^4$ and $M^5$ each independently represent a hydrogen atom, a substituted or unsubstituted, straight-chain or branched alkyl group having 1 to 6 carbon atoms, a substituted or unsubstituted cyclic alkyl group having 3 to 6 carbon atoms, an alkenyl group having 2 to 6 carbon atoms, a substituted or unsubstituted phenyl group having 6 to 10 carbon atoms, or a heterocyclic group.

As the compound represented by formula (SE1), the following case is further preferable: $M^1$ and $M^2$ each independently are a hydrogen atom, a substituted or unsubstituted, straight-chain or branched alkyl group having 1 to 6 carbon atoms, an alkenyl group having 2 to 6 carbon atoms, or a substituted or unsubstituted phenyl group having 6 to 10 carbon atoms; and Q is a substituted or unsubstituted, straight-chain or branched alkyl group having 1 to 6 carbon atoms, a substituted or unsubstituted phenyl group having 6 to 10 carbon atoms, or $NM^4M^5$, in which $M^4$ and $M^5$ each represent a hydrogen atom, a substituted or unsubstituted, straight-chain or branched alkyl group having 1 to 6 carbon atoms, an alkenyl group having 2 to 6 carbon atoms, or a substituted or unsubstituted phenyl group having 6 to 10 carbon atoms.

As the compound represented by formula (SE1), the following case is further more preferable: Q is $NM^4M^5$ in which $M^4$ and $M^5$ each independently represent a hydrogen atom, a substituted or unsubstituted, straight-chain or branched alkyl group having 1 to 6 carbon atoms, an alkenyl group having 2 to 6 carbon atoms, or a substituted or unsubstituted phenyl group having 6 to 10 carbon atoms.

Specific examples of the compounds represented by formula (SE1) are shown below. However, the present invention is not limited to these compounds.

SE1-1

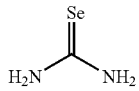

SE1-2

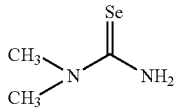

SE1-3

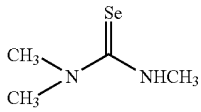

SE1-4

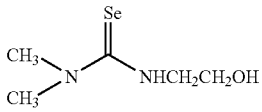

SE1-5

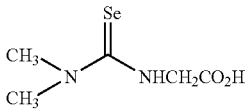

SE1-6

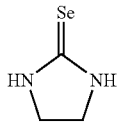

SE1-7

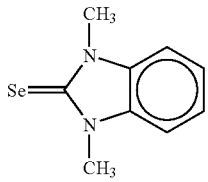

-continued

SE1-8

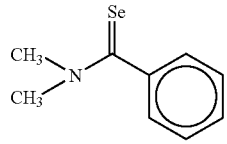

SE1-9

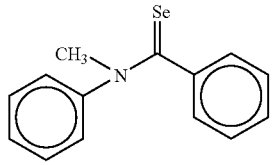

SE1-10

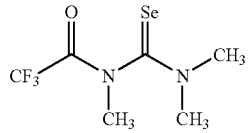

SE1-11

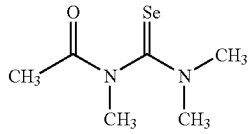

SE1-12

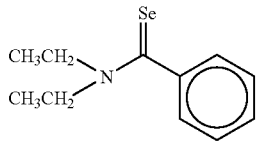

SE1-13

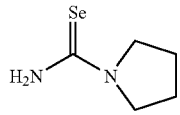

SE1-14

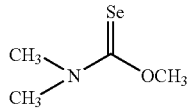

SE1-15

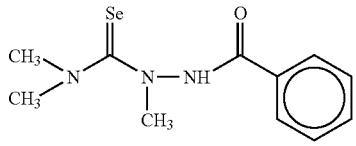

SE1-16

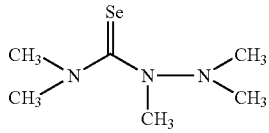

SE1-17

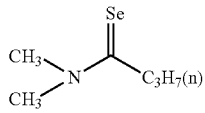

The compound represented by formula (SE1) for use in the present invention may be synthesized according to known methods, for example, the methods described in Chem. Rev., 55, 181-228 (1955); J. Org. Chem., 24, 470473

(1959); J. Heterocycl. Chem., 4, 605-609 (1967); J. Drug (Yakushi), 82, 36-45 (1962); JP-B-39-26203, JP-A-63-229449, and OLS-2,043,944.

The selenium compound represented by formula (SE2) will be described in detail.

In formula (SE2), the alkyl, alkenyl, alkynyl, aryl, and heterocyclic groups represented by $X^1$ to $X^3$ and $J^1$ to $J^3$ have the same meanings as those represented by $M^1$ to $M^5$ and Q in formula (SE1), and preferred ranges are also identical. $X^1$ to $X^3$ and $J^1$ to $J^3$ each may have a substituent(s) as many as possible, and examples of the substituent include the same examples that are mentioned as the substituent which $M^1$ to $M^5$ and Q in formula (SE1) may have.

As the compound represented by formula (SE2), the following case is preferable: $X^1$ to $X^3$ each independently are a substituted or unsubstituted, straight-chain or branched alkyl group having 1 to 6 carbon atoms, a substituted or unsubstituted phenyl group having 6 to 10 carbon atoms, or a heterocyclic group. As the compound represented by formula (SE2), the following case is more preferable: $X^1$ to $X^3$ each independently are a substituted or unsubstituted phenyl group having 6 to 10 carbon atoms.

Specific examples of the compounds represented by formula (SE2) are shown below. However, the present invention is not limited to these compounds.

SE2-1

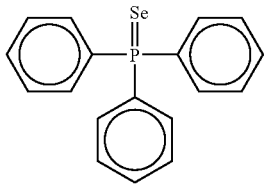

SE2-2

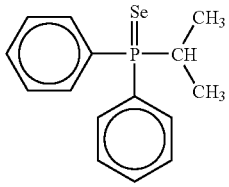

SE2-3

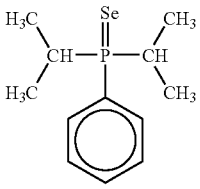

SE2-4

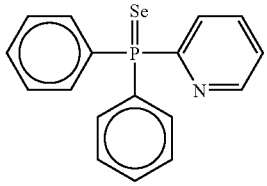

-continued

SE2-5

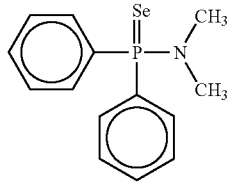

SE2-6

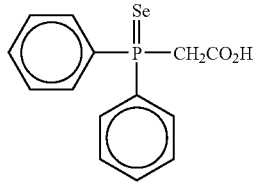

SE2-7

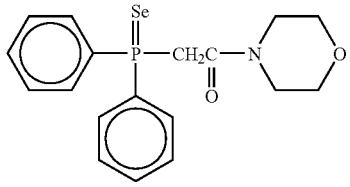

SE2-8

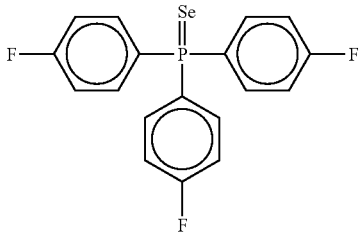

SE2-9

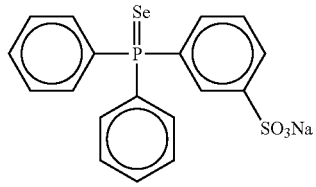

SE2-10

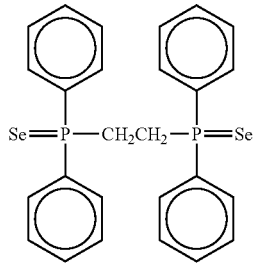

SE2-11

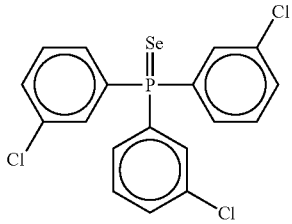

-continued

SE2-12

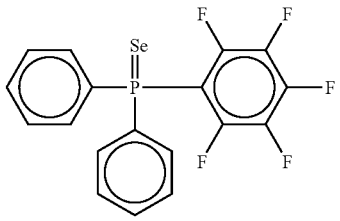

SE2-13

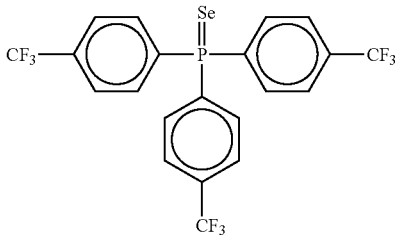

SE2-14

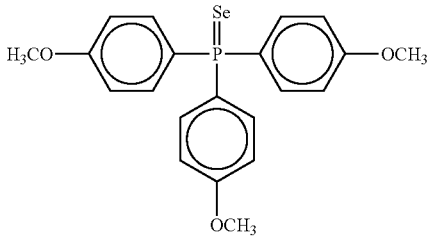

SE2-15

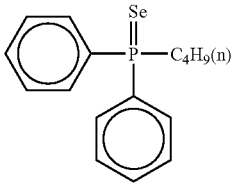

SE2-16

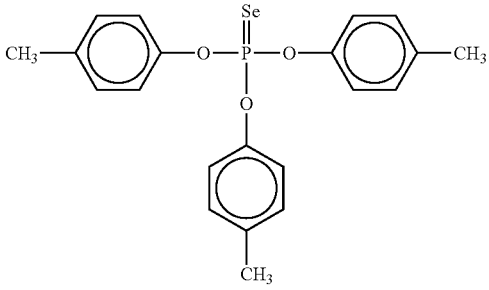

SE2-17

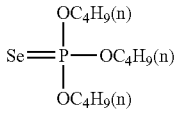

SE2-18

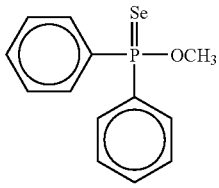

-continued

SE2-19

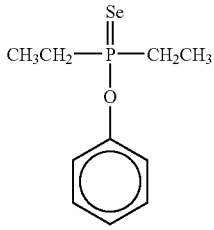

SE2-20

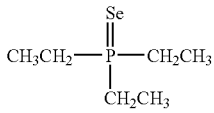

The compound represented by formula (SE2) for use in the present invention may be synthesized according to known methods, for example, the methods described in Organic Phosphorus Compounds, vol. 4, pp. 1-73; J. Chem. Soc. B, p. 1416 (1968); J. Org. Chem., vol. 32, p. 1717 (1967); J. Org. Chem., vol 32, p. 2999 (1967); Tetrahedron, vol. 20, p. 449 (1964); and J. Am. Chem. Soc., vol. 91, p. 2915 (1969).

The selenium compound represented by formula (SE3) will be explained in detail.

The alkyl, alkenyl, alkynyl, aryl, and heterocyclic groups represented by $E^1$ and $E^2$ in formula (SE3) have the same meanings as those represented by $M^1$ to $M^5$ and Q in formula (SE1), and their preferred ranges are also identical. The acyl group represented by $E^1$ and $E^2$ is preferably an acyl group having 1 to 30 carbon atoms, and examples thereof include an acetyl group, a formyl group, a benzoyl group, a pivaloyl group, a caproyl group, and an n-nonanoyl group; the alkoxycarbonyl group represented by $E^1$ and $E^2$ is preferably an alkoxycarbonyl group having 2 to 30 carbon atoms, and examples thereof include a methoxycarbonyl group, an ethoxycarbonyl group, an n-butyloxycarbonyl group, a cyclohexyloxycarbonyl group, an n-octyloxycarbonyl group, and an n-decyloxycarbonyl group; the aryloxycarbonyl group represented by $E^1$ and $E^2$ is preferably an aryloxycarbonyl group having 6 to 30 carbon atoms, and examples thereof include a phenoxycarbonyl group, and a napthoxycarbonyl group; and the carbamoyl group represented by $E^1$ and $E^2$ is preferably a carbamoyl group having 1 to 30 carbon atoms, and examples thereof include an unsubstituted carbamoyl group, an N,N-diethylcarbamoyl group, and an N-phenylcarbamoyl group. $E^1$ and $E^2$ each may further have a substituent(s) as far as possible. Such substituents have the same meaning as the substituents that $M^1$ to $M^5$ and Q in formula (SE1) may have, and the former and the latter are also identical in the scope of preferred ones.

In preferred compounds among those represented by formula (SE3) in the present invention, either $E^1$ or $E^2$ is a group selected from the groups represented by the following formulae (T1) to (T4). More preferably, both $E^1$ and $E^2$ are groups selected from the groups represented by formula (T1) to (T4). In these cases, $E^1$ and $E^2$ may be the same or different.

Formula (T1)

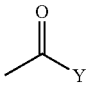

Formula (T2)

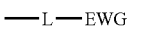

Formula (T3)

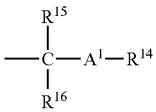

Formula (T4)

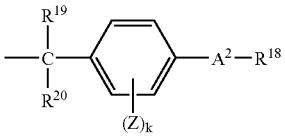

In formula (T1), Y represents an alkyl group, an alkenyl group, an alkynyl group, an aryl group, a heterocyclic group, $OR^{11}$, or $NR^{12}R^{13}$, in which $R^{11}$, $R^{12}$, and $R^{13}$ each independently represent an alkyl group, an alkenyl group, an alkynyl group, an aryl group, or a heterocyclic group. In formula (T2), L represents a divalent linking group, and EWG represents an electron-withdrawing group. L and EWG may bond together to form a ring. In formula (T3), $A^1$ represents an oxygen atom, a sulfur atom, or $NR^{17}$; and $R^{14}$, $R^{15}$, $R^{16}$, and $R^{17}$ each independently represent a hydrogen atom, an alkyl group, an alkenyl group, an alkynyl group, an aryl group, or a heterocyclic group, and $R^{15}$ and $R^{16}$ may bond together to form a ring. In formula (T4), $A^2$ represents an oxygen atom, a sulfur atom, or $NR^{21}$; $R^{18}$ represents a hydrogen atom, an alkyl group, an alkenyl group, an alkynyl group, an aryl group, a heterocyclic group, or an acyl group; $R^{19}$, $R^{20}$, and $R^{21}$ each independently represent a hydrogen atom, an alkyl group, an alkenyl group, an alkynyl group, an aryl group, or a heterocyclic group. $R^{19}$ and $R^{20}$ may bond together to form a ring. Z represents a substituent; k is an integer from 0 to 4. When k is 2 or more, plural Zs may be the same or different. Herein, the electron-withdrawing group is preferably a group having a Hammett's $\sigma_m$ value of 0 or above.

In formula (T1), Y represents an alkyl group, an alkenyl group, an alkynyl group, an aryl group, a heterocyclic group, —$OR^{11}$, or —$NR^{12}R^{13}$, in which $R^{11}$, $R^{12}$, and $R^{13}$ each independently represent an alkyl group, an alkenyl group, an alkynyl group, an aryl group, or a heterocyclic group. Where the alkyl group is concerned, it has the same meaning as those represented by $M^1$ to $M^5$ and Q in formula (SE1), and they are identical in the scope of preferred ones. Likewise, the alkenyl group, the alkynyl group, the aryl group, and the heterocyclic group have the same meanings as the alkenyl group, the alkynyl group, the aryl group, and the heterocyclic group each of $M^1$ to $M^5$ and Q in formula (SE1) can represent, respectively, and the scope of preferred ones in regard to each of these groups is also identical.

In formula (T1), Y is preferably an alkyl group, an alkenyl group, an alkynyl group, an aryl group, or a heterocyclic group; and more preferably an alkyl group or an aryl group.

In formula (T2), the divalent linking group represented by L preferably represents an alkylene, alkenylene, or alkynylene group having 2 to 20 carbon atoms; more preferably represents a straight-chain, branched or cyclic alkylene group having 2 to 10 carbon atoms (e.g., ethylene, propylene, cyclopentylene, and cyclohexylene), an alkenylene group (e.g., vinylene), or an alkynylene group (e.g., propynylene). L is more preferably a cycloalkylene group, or a group represented by the following formula (L1) or (L2); L is further more preferably a group represented by formula (L1) or (L2).

Formula (L1)

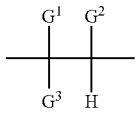

Formula (L2)

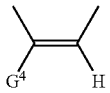

In formulae (L1) and (L2), $G^1$, $G^2$, $G^3$, and $G^4$ each independently represent a hydrogen atom, an alkyl group having 1 to 10 carbon atoms, an aryl group having 6 to 20 carbon atoms, or a heterocyclic group having 1 to 10 carbon atoms. Any two or three of $G^1$, $G^2$, and $G^3$ may bond together, to form a ring. $G^1$, $G^2$, $G^3$, and $G^4$ each are preferably a hydrogen atom, an alkyl group, or an aryl group, and more preferably a hydrogen atom or an alkyl group.

In formula (T2), EWG represents an electron-withdrawing group. The term "electron-withdrawing group" so-called herein means a group having a positive value of Hammett's substituent constant $\sigma_m$ value, and preferably a $\sigma_m$ value of 0.12 or more, with its upper limit being 1.0 or less. Specific examples of the electron-withdrawing group having a positive $\sigma_m$ value, include an alkoxy group, an alkylthio group, an acyl group, a formyl group, an acyloxy group, an acylthio group, a carbamoyl group, an alkoxycarbonyl group, an aryloxycarbonyl group, a cyano group, a nitro group, a dialkylphosphono group, a diarylphosphono group, a dialkylphosphinyl group, a diarylphosplunyl group, a phosphoryl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, an imino group, an imino group substituted with an N atom, a carboxy group (or its salt), an alkyl group substituted with at least two or more halogen atoms; an aryloxy group, an arylthio group, an acylamino group, an alkylamino group, an aryl group substituted with other electron-withdrawing group having a $\sigma_p$ value of 0.2 or more; a heterocyclic group, a halogen atom, an azo group, and a selenocyanate group.

In the present invention, EWG is preferably an alkoxy group, an alkylthio group, an acyl group, a formyl group, a carbamoyl group, an alkoxycarbonyl group, an aryloxycarbonyl group, a cyano group, a nitro group, a dialkylphosphono group, a diarylphosphono group, a dialkylphosphinyl group, a diarylphosphinyl group, an alkylsulfinyl group, an arylsulfinyl group, an alkylsulfonyl group, an arylsulfonyl group, a sulfamoyl group, a thiocarbonyl group, an imino group, an imino group substituted with an N atom; a phosphoryl group, a carboxy group (or its salt), an alkyl group substituted with at least two or more halogen atoms; an aryl group substituted with other electron-withdrawing group having a cp value of 0.2 or more; a heterocyclic group, or a halogen atom; more preferably an alkoxy group, an alkylthio group, an acyl group, a formyl group, a carbamoyl group, an alkoxycarbonyl group, an aryloxycarbonyl group, a cyano group, a nitro group, an alkylsulfonyl group, an arylsulfonyl group, a carboxy group, or an alkyl group substituted with at least two or more halogen atoms; and further preferably an alkoxy group, an alkylthio group, an acyl group, a formyl group, a cyano group, a nitro group, an alkylsulfonyl group, an arylsulfonyl group, or an alkyl group substituted with at least two or more halogen atoms.

In formula (T3), $R^{14}$ to $R^{17}$ each independently represent a hydrogen atom, an alkyl group, an alkenyl group, an allynyl group, an aryl group, or a heterocyclic group. The alkyl group so-called herein has the same meaning as the aforementioned alkyl group represented by $M^1$ to $M^5$ and Q in formula (SE1), and the preferable range is also the same. Likewise, the alkenyl group, alkynyl group, aryl group, and heterocyclic group have the same meanings as the aforementioned alkenyl group, alkynyl group, aryl group, and heterocyclic group, represented by $M^1$ to $M^5$ and Q in formula (SE1), respectively, and the preferable ranges are also the same.

In the present invention, $R^{14}$ is preferably an alkyl group. $R^{15}$ and $R^{16}$ each are preferably a hydrogen atom, an alkyl group, or an aryl group, and more preferably a hydrogen atom, or an alkyl group. The case where one of $R^{15}$ and $R^{16}$ is a hydrogen atom and the other is a hydrogen atom or an alkyl group is still more preferable. $R^{17}$ is preferably a hydrogen atom, an alkyl group, or an aryl group, more preferably a hydrogen atom or an alkyl group, and still more preferably an alkyl group.

In formula (T3), $A^1$ represents an oxygen atom, a sulfur atom, or $NR^{17}$. In the present invention, $A^1$ is preferably an oxygen atom or a sulfur atom, and more preferably an oxygen atom.

Next, the group represented by formula (T4) will be explained.

In formula (T4), the alkyl group represented by $R^{18}$ to $R^{21}$ has the same meaning as the aforementioned alkyl group represented by $M^1$ to $M^5$ and Q in formula (SE1), and the preferable range is also the same. Likewise, the alkenyl group, alkynyl group, aryl group, and heterocyclic group have the same meanings as the aforementioned alkenyl group, alkynyl group, aryl group, and heterocyclic group represented by $M^1$ to $M^5$ and Q in formula (SE1), respectively, and the preferable ranges are also the same. Examples of the acyl group represented by $R^{18}$ include an acetyl group, a formyl group, a benzoyl group, a pivaloyl group, a caproyl group, and an n-nonanoyl group.

Z in formula (T4) represents a substituent, and examples thereof include the same ones as the substituents $M^1$ to $M^5$ and Q in formula (SE1) may have.

In the present invention, preferable examples of Z include a halogen atom, an alkyl group, an aryl group, a heterocyclic group, an acyl group, an alkoxycarbonyl group, an aryloxycarbonyl group, a carbamoyl group, an N-acylcarbamoyl group, an N-sulfonylcarbamoyl group, an N-carbamoylcarbamoyl group, a thiocarbamoyl group, N-sulfamoylcarbamoyl group, a carbazoyl group, a carboxy group (including a salt thereof), a cyano group, a formyl group, a hydroxy group, an alkoxy group, an aryloxy group, a heterocyclic oxy group, an acyloxy group, a nitro group, an amino group, an alkyl-, aryl- or heterocyclic-amino group, an acylamino group, a sulfonamido group, a ureido group, a thioureido group, an alkylthio group, an arylthio group, a heterocyclic thio group, an alkyl- or aryl-sulfonyl group, an alkyl- or aryl-sulfinyl group, a sulfo group (including a salt thereof), and a sulfamoyl group. More preferable examples thereof include a halogen atom, an alkyl group, an aryl group, a heterocyclic group, a carboxy group (including a salt thereof), a hydroxy group, an alkoxy group, an aryloxy group, a heterocyclic oxy group, an acyloxy group, an amino group, an alkyl-, aryl-, or heterocyclic-amino group, an acylamino group, a ureido group, a thioureido group, an alkylthio group, an arylthio group, a heterocyclic thio group, and a sulfo group (including a salt thereof). Further more preferred examples thereof include an alkyl group, an aryl group, a carboxy group (including a salt thereof), a hydroxy group, an alkoxy group, an aryloxy group, an alkyl-, aryl-, or heterocyclic-amino group, a ureido group, an alkylthio group, an arylthio group, and a sulfo group (including a salt thereof).

In formula (T4), k represents an integer of from 0 to 4. In the present invention, k is preferably an integer of from 0 to 2, and more preferably an integer of 0 or 1.

In formula (T4), $A^2$ represents an oxygen atom, a sulfur atom, or $NR^{21}$. In the present invention, $A^2$ preferably represents an oxygen atom or a sulfur atom.

Of compounds represented by formula (SE3), more preferred ones correspond to a case where $E^1$ is a group of formula (T1) and $E^2$ is a group of formula (T1), a case where $E^1$ is a group of formula (T1) and $E^2$ is a group of formula (T2), a case where $E^1$ is a group of formula (T1) and $E^2$ is a group of formula (T3), a case where $E^1$ is a group of formula (T1) and $E^2$ is a group of formula (T4), a case where $E^1$ is a group of formula (T2) and $E^2$ is a group of formula (T3), a case where $E^1$ is a group of formula (T2) and $E^2$ is a group of formula (T4), a case where $E^1$ is a group of formula (T3) and $E^2$ is a group of formula (T3), a case where $E^1$ is a group of formula (T3) and $E^2$ is a group of formula (T4), and a case where $E^1$ is a group of formula (T4) and $E^2$ is a group of formula (T4), respectively. Of these cases, the case where $E^1$ is a group of formula (T1) and $E^2$ is a group of formula (T1), the case where $E^1$ is a group of formula (T1) and $E^2$ is a group of formula (T2), the case where $E^1$ is a group of formula (T1) and $E^2$ is a group of formula (T3), the case where $E^1$ is a group of formula (T3) and $E^2$ is a group of formula (T4), the case where $E^1$ is a group of formula (T2) and $E^2$ is a group of formula (T3), the case where $E^1$ is a group of formula (T3) and $E^2$ is a group of formula (T4), and the case where $E^1$ is a group of formula (T4) and $E^2$ is a group of formula (T4) are more preferred over the others; and the case where $E^1$ is a group of formula (T1) and $E^2$ is a group of formula (T2), the case where $E^1$ is a group of formula (T1) and $E^2$ is a group of formula (T3), the case where $E^1$ is a group of formula (T1) and $E^2$ is a group of formula (T4), the case where $E^1$ is a group of formula (T2) and $E^2$ is a group of formula (T3), and the case where $E^1$ is a group of formula (T3) and $E^2$ is a group of formula (T4) are particularly favorable. Of these cases, the most favorable ones are the case where $E^1$ is a group of formula (T1) and $E^2$ is a group of formula (T2), the case where $E^1$ is a group of formula (T1) and $E^2$ is a group of formula (T3), and the case where $E^1$ is a group of formula (T2) and $E^2$ is a group of formula (T3).

Specific examples of the compound represented by formula (SE3) will be shown below, but the present invention is not limited to these. Further, with respect to the compounds that may have a plurality of stereoisomers, their stereostructure is not limited to these.

SE3-1
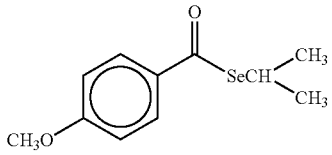
SE3-2
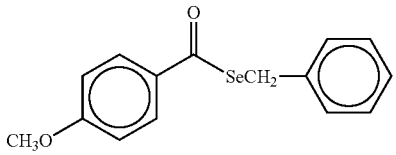
SE3-3
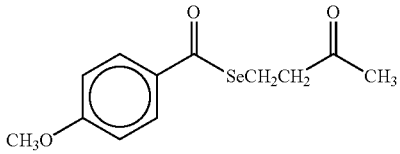
SE3-4
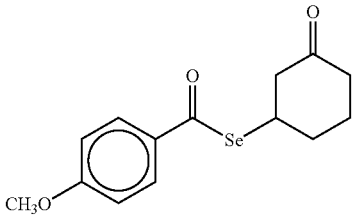
SE3-5
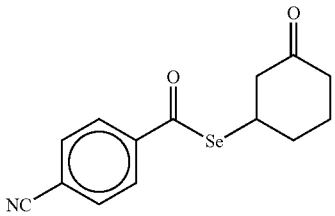
SE3-6
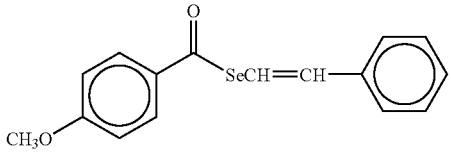
SE3-7
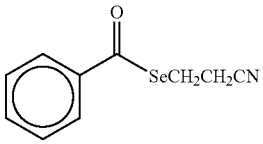
SE3-8
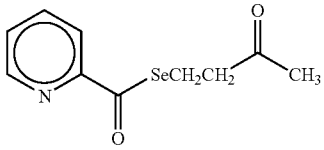
-continued
SE3-9
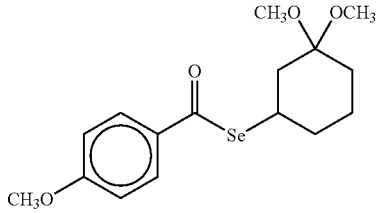
SE3-10
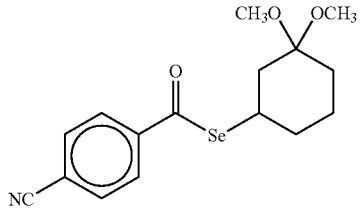
SE3-11
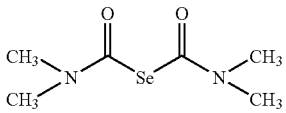
SE3-12
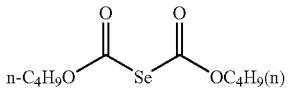
SE3-13
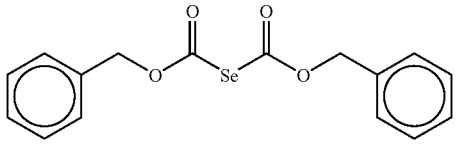
SE3-14
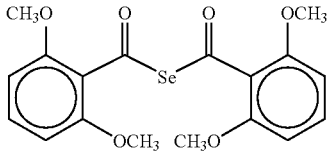
SE3-15
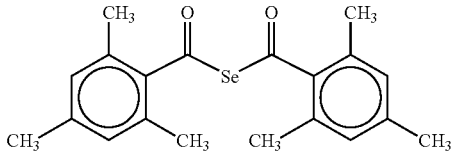
SE3-16
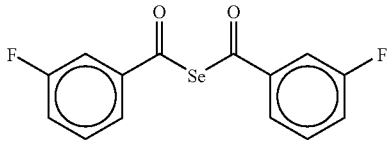
SE3-17
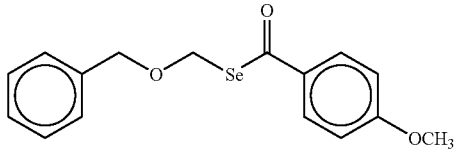

-continued
SE3-18
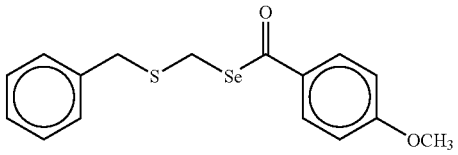
SE3-19
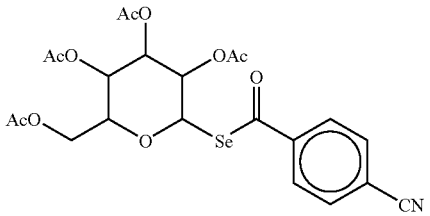
SE3-20
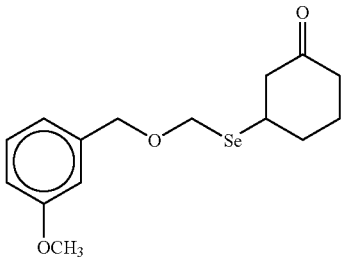
SE3-21
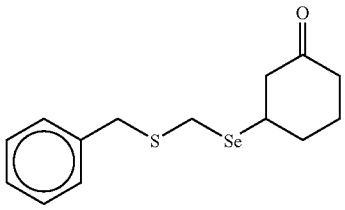
SE3-22
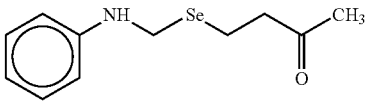
SE3-23
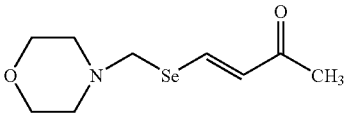
SE3-24
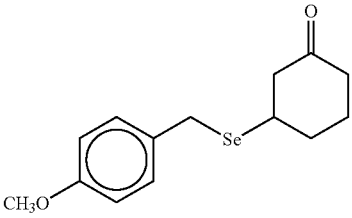
SE3-25
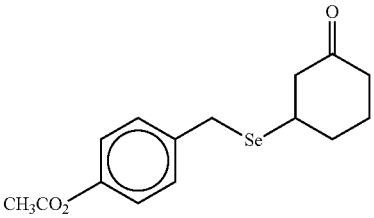
-continued
SE3-26
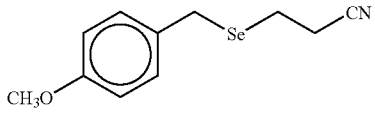
SE3-27
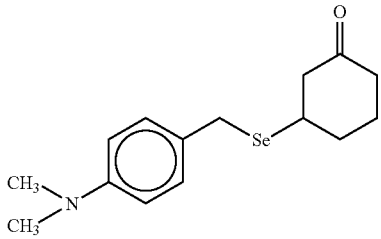
SE3-28
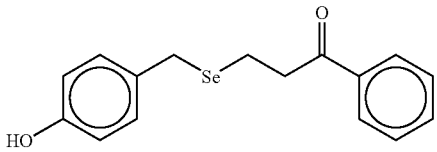
SE3-29
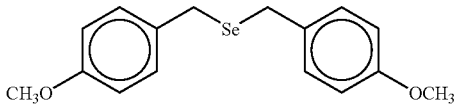
SE3-30
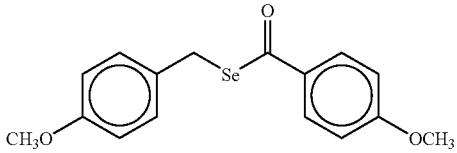
SE3-31
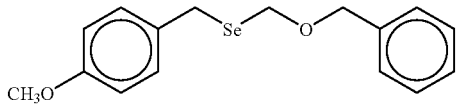
SE3-32
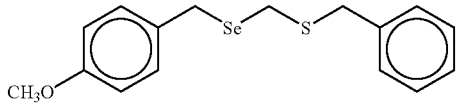
SE3-33
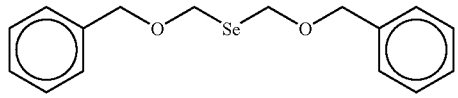
SE3-34
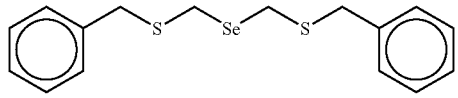
SE3-35
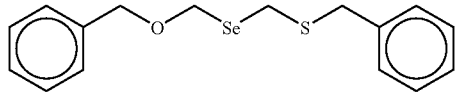
SE3-36
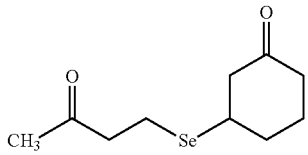

The compound represented by formula (SE3) for use in the present invention may be synthesized according to the methods described in the following already known documents: The Chemistry of Organic Selenium and Tellurium Compounds, Vol. 1 (1986) and ibid. Vol. 2 (1987) edited by S. Patai and Z. Rappoport; and Organoselenium Chemistry (1987) by D. Liotta.

In addition to the foregoing ones, selenium compounds as described in JP-B43-13489, JP-B44-15748, JP-A-4-25832, JP-A-4-109240, JP-A-4-271341, JP-A-5-40324, JP-A-5-11385, JP-A-6-51415, JP-A-6-175258, JP-A-6180478, JP-A-6-208186, JP-A-6-208184, JP-A-6-317867, JP-A-7-92599, JP-A-7-98483, JP-A-7-140579, JP-A-7-301879, JP-A-7-301880, JP-A-8-114882, JP-A-9-138475, JP-A-9-197603, and JP-A-10-10666, specifically colloidal metallic selenium, selenoketones (e.g., selenobenzophenone), isoselenocyanates, and selenocarboxylic acid compounds, can be used in the present invention. Further, the non-labile selenium compounds as described in JP-B464553 and JP-B-52-34492, including selenous acid compounds, selenocyanic acid compounds (such as potassium selenocyanate), selenazoles, and selenides, can also be used. Of these compounds, selenocyanic acid compounds are preferred over the others.

Up to this point, the structures suitable as the selenium compounds are shown, but those structures should not be construed as limiting the scope of the present invention. From the viewpoints of hard gradation enhancement and fog reduction, it is preferable that the 3d-orbital electron of a selenium atom in the selenium compound for use in the present invention has bound energy of from 54.0 eV to 65.0 eV, as measured with an X-ray photoelectron spectroscope.

The amount of a selenium sensitizer for use in the present invention, though it varies depending on the selenium compound used, the silver halide grains used in combination therewith and the chemical ripening conditions adopted, is generally from about $1\times10^{-8}$ to about $1\times10^{-4}$ mole, preferably from about $1\times10^{-7}$ to about $1\times10^{-5}$ mole, per mole of silver halide. The present invention has no particular restriction as to conditions for chemical sensitization, but the pCl is preferably from 0 to 7, more preferably from 0 to 5, and particularly preferably from 1 to 3, and the temperature is preferably from 40 to 95° C., and more preferably from 50 to 85° C.

The selenium compounds according to the present invention can be added at any stage during the period from the instant following the grain formation to the instant preceding the completion of chemical sensitization. The preferable addition time is within a period between the instant following completion of desalting and the chemical sensitization process inclusive.

In the first embodiment of the present invention, the silver halide emulsion undergoes gold sensitization in combination with selenium sensitization using any of the selenium compounds as recited above. In the second embodiment of the present invention, the selenium sensitization may be combined with gold sensitization.

Examples of a gold sensitizer for use in the gold sensitization include colloidal gold sulfide and gold sensitizers having their individual gold-complex stability constants logP2 in the range of 21 to 35. In addition to these gold sensitizers, commonly-used gold compounds (e.g., chloroauric acid, potassium chloroaurate, auric trichloride, potassium auric thiocyanate, potassium iodoaurate, tetracyanoauric acid, ammonium aurothiocyanate, pyridyltrichlorogold) can be preferably used.

The amount of the gold sensitizer to be used in the first embodiment of the present invention, though it varies depending on the gold compound used, the silver halide grains used in combination therewith, and the chemical ripening conditions adopted, is generally from about $1\times10^{-4}$ to about $1\times10^{-8}$ mole, preferably from about $1\times10^{-4}$ to about $1\times10^{-7}$ mole, per mole of silver halide.

In the present invention, the gold sensitizers can be added at any stage during the period from the instant following the grain formation to the instant preceding the completion of chemical sensitization. The addition time is preferably within a period between the instant following completion of desalting and the chemical sensitization process inclusive.

The silver halide emulsion for use in the second embodiment of the invention is preferably an emulsion having undergone gold sensitization known in the field. The emulsion can be increased in sensitivity by undergoing gold sensitization, and thereby fluctuations in photographic properties when scanning exposure using laser light is performed can be reduced. To effect gold sensitization, various inorganic gold compounds, gold(I) complexes having an inorganic ligand, and gold(I) complexes having an organic ligand can be utilized. For instance, chloroauric acid and salts thereof can be used as the inorganic gold compounds; and dithiocyanato gold compounds, such as potassium dithiocyanatoaurate(I), and dithiosulfato gold compounds, such as trisodium dithiosulfatoaurate(I), can be used as the gold(I) complex having an inorganic ligand.

As the gold (I) compounds each having an organic ligand (an organic compound), use can be made of bis-gold (1) mesoionic heterocycles described in JP-A-4-267249, e.g. bis(1,4,5-trimethyl-1,2,4-triazolium-3-thiolato) aurate (I) tetrafluoroborate; organic mercapto gold (1) complexes described in JP-A-11-218870, e.g. potassium bis(1-[3-(2-sulfonatobenzamido)phenyl]-5-mercaptotetrazole potassium salt) aurate (I) pentahydrate; and gold (I) compound with a nitrogen-compound anion coordinated therewith, as described in JP-A-4-268550, e.g. bis(1-methylhydantoinato) gold (I) sodium salt tetrahydrate. As these gold (I) compounds having an organic ligand, use can be made of those which are synthesized in advance and isolated, as well as those which are generated by mixing an organic ligand and an Au compound (e.g., chlroauric acid or its salt), to add to an emulsion without isolating the resulting Au compound. Moreover, an organic ligand and an Au compound (e.g., chlroauric acid or its salt) may be separately added to the emulsion, to generate the gold (I) compound having the organic ligand, in the emulsion.

Also, the gold (I) thiolate compound described in U.S. Pat. No. 3,503,749, the gold compounds described in JP-A-8-69074, JP-A-8-69075 and JP-A-9-269554, and the compounds described in U.S. Pat. Nos. 5,620,841, 5,912,112, 5,620,841, 5,939,245, and 5,912,111 may be used.

In the second embodiment of the present invention, the amount of the above compound to be added can vary in a wide range depending on the occasion, and it is generally in the range of $5\times10^{-7}$ mol to $5\times10^{-3}$ mol, and preferably in the range of $5\times10^{-6}$ mol to $5\times10^{-4}$ mol, per mol of silver halide.

Further, in the second embodiment of the present invention, colloidal gold sulfide can also be used, to conduct gold sensitization. A method of producing the colloidal gold sulfide is described in, for example, Research Disclosure, No. 37154; Solid State Ionics, Vol. 79, pp. 60 to 66 (1995); and Compt. Rend. Hebt. Seances Acad. Sci. Sect. B, Vol. 263, p. 1328 (1996). In the above Research Disclosure, a method is described in which a thiocyanate ion is used in the production of colloidal gold sulfide. It is, however, possible to use a thioether compound, such as methionine or thiodiethanol, instead.

Colloidal gold sulfide having various grain sizes are applicable, and it is preferable to use those having an average grain diameter of 50 nm or less, more preferably 10 nm or less, and further preferably 3 nm or less. The grain diameter can be measured from a TEM photograph. Also, the composition of the colloidal gold sulfide may be $Au_2S_1$ or may be sulfur-excess compositions such as $Au_2S_1$ to $Au_2S_2$ which are preferable. $Au_2S_{1.1}$ to $Au_2S_{1,8}$ are more preferable.

The composition of the colloidal gold sulfide can be analyzed in the following manner: for example, gold sulfide grains are taken out, to find the content of gold and the content of sulfur, by utilizing analysis methods such as ICP and iodometry, respectively. If gold ions and sulfur ions (including hydrogen sulfide and its salt) dissolved in the liquid phase exist in the gold sulfide colloid, this affects the analysis of the composition of the gold sulfide colloidal grains. Therefore, the analysis is made after the gold sulfide grains have been separated by ultrafiltration or the like. In the second embodiment of the present invention, the amount of the colloidal gold sulfide to be added can be varied in a wide range depending on the occasion, and it is generally in the range of $5\times10^{-7}$ mol to $5\times10^{-3}$ mol, and preferably in the range of $5\times10^{-6}$ mol to $5\times10^{-4}$ mol, in terms of gold atom, per mol of silver halide.

In the second embodiment of the present invention, chalcogen sensitization and gold sensitization can be conducted by using the same molecule such as a molecule capable of releasing $AuCh^-$, in which Au represents Au (I), and Ch represents a sulfur atom, a selenium atom, or a tellurium atom. Examples of the molecule capable of releasing $AuCh^-$ include gold compounds represented by AuCh-L, in which L represents a group of atoms bonding to AuCh to form the molecule. Further, one or more ligands may coordinate to Au together with Ch-L. The gold compounds represented by AuCh-L have a tendency to form AgAuS when Ch is S, AgAuSe when Ch is Se, or AgAuTe when Ch is Te, when the gold compounds are reacted in a solvent in the presence of silver ions. Examples of these compounds include those in which L is an acyl group. In addition, gold compounds represented by formula (AuCh1), formula (AuCh2), or formula (AuCh3) are exemplified.

$R_1$—X-M-ChAu Formula (AuCh1)

In formula (AuCh1), Au represents Au (I); Ch represents a sulfur atom, a selenium atom, or a tellurium atom; M represents a substituted or unsubstituted methylene group; X represents an oxygen atom, a sulfur atom, a selenium atom, or $NR_2$; $R_1$ represents a group of atoms bonding to X to form the molecule (e.g., an organic group, such as an alkyl group, an aryl group, or a heterocyclic group); $R_2$ represents a hydrogen atom or a substituent (e.g., an organic group, such as an alkyl group, an aryl group, or a heterocyclic group); and $R_1$ and M may combine together to form a ring.

Regarding the compound represented by formula (AuCh1), Ch is preferably a sulfur atom or a selenium atom; X is preferably an oxygen atom or a sulfur atom; and $R_1$ is preferably an alkyl group or an aryl group. More specific examples of the compounds include Au(I) salts of thiosugar (for example, gold thioglucose (such as α-gold thioglucose), gold peracetyl thioglucose, gold thiomannose, gold thiogalactose, gold thioarabinose), Au(I) salts of selenosugar (for example, gold peracetyl selenoglucose, gold peracetyl selenomannose), and Au(I) salts of tellurosugar. Herein, the terms "thiosugar," "selenosugar" and "tellurosugar" mean the compounds in which a hydroxy group in the anomer position of the sugar is substituted with a SH group, a SeH group, and a TeH group, respectively.

$W_1W_2C{=}CR_3ChAu$ Formula (AuCh2)

In formula (AuCh2), Au represents Au(I); Ch represents a sulfur atom, a selenium atom, or a tellurium atom; $R_3$ and $W_2$ each independently represent a substituent (e.g., a hydrogen atom, a halogen atom, or an organic group such as alkyl, aryl, or heterocyclic group); $W_1$ represents an electron-withdrawing group having a positive value of the Hammett's substituent constant $\sigma_p$ value; and $R_3$ and $W_1$, $R_3$ and $W_2$, or $W_1$ and $W_2$ may bond together to form a ring.

In the compound represented by formula (AuCh2), Ch is preferably a sulfur atom or a selenium atom; $R_3$ is preferably a hydrogen atom or an alkyl group; and $W_1$ and $W_2$ each are preferably an electron-withdrawing group having the Hammett's substituent constant $\sigma_p$ value of 0.2 or more. Examples of the specific compound include $(NC)_2C{=}CHSAu$, $(CH_3OCO)_2C{=}CHSAu$, and $CH_3CO(CH_3OCO)C{=}CHSAu$.

$W_3$-E-ChAu Formula (AuCh3)

In formula (AuCh3), Au represents Au(I); Ch represents a sulfur atom, a selenium atom, or a tellurium atom; E represents a substituted or unsubstituted ethylene group; $W_3$ represents an electron-withdrawing group having a positive value of the Hammett's substituent constant $\sigma_p$ value.

In the compound represented by formula (AuCh3), Ch is preferably a sulfur atom or a selenium atom; E is preferably an ethylene group having thereon an electron-withdrawing group whose Hammett's substituent constant $\sigma_p$ value is a positive value; and $W_3$ is preferably an electron-withdrawing group having the Hammett's substituent constant $\sigma_p$ value of 0.2 or more.

An addition amount of these compounds can vary over a wide range according to the occasions, and the amount is generally in the range of $5\times10^{-7}$ to $5\times10^{-3}$ mol, preferably in the range of $3\times10^{-6}$ to $3\times10^{-4}$ mol, per mol of silver halide.

In addition to selenium sensitization and gold sensitization, sulfur sensitization, tellurium sensitization or precious metal sensitization can also be used in combination.

Further, it is possible to use reduction sensitizers in combination with the sensitizers as recited above. Examples of the reduction sensitizer include stannous chloride, aminoiminomethanesulfinic acid, hydrazine derivatives, borane compounds, silane compounds, and polyamine compounds.

Furthermore, it is preferable in the present invention that the chemical sensitization using the selenium compound as recited above is carried out in the presence of a silver halide solvent. Examples of a silver halide solvent usable therein include thiocyanates (such as potassium thiocyanate), thioether compounds (such as the compounds described in U.S. Pat. Nos. 3,021,215 and 3,271,157, JP-B-58-30571 and JP-A60-136736, especially 3,6-diithia-1,8-octanediol), tetrasubstituted thiourea compounds (such as the compounds described in JP-B-59-11892 and U.S. Pat. No. 4,221,863, especially tetramethylthiourea), the thione compounds described in JP-B-60-11341, the mercapto compounds described in JP-B-63-29727, the meso-ionic compounds described in JP-A-60-163042, the selenoether compounds described in U.S. Pat. No. 4,782,013, the telluroether compounds described in JP-A-2-118566, and sulfites. Of these solvents, the thiocyanates, the thioether compounds, the tetrasubstituted thiourea compound and the thione compounds are more preferred. The amount of a silver halide solvent used is from about $1\times10^{-5}$ to $1\times10^{-2}$ mole per mole of silver halide.

Silver halide grains constituting the silver halide emulsion according to the first embodiment of the present invention are not particularly restricted as to their average side length. Their average side length is, however, generally from 0.1 μm to 0.6 μm, preferably from 0.1 μm to 0.5 μm, more preferably from 0.1 μm to 0.45 μm, and particularly preferably from 0.1 μm to 0.4 μm. The variation coefficient of the average side length is preferably from 10% to 20%. In the first embodiment of the present invention, it is preferable that the projected areas of silver halide grains ranging in side length from 0.1 μm to 0.6 μm make up at least 50%, preferably at least 80%, particularly preferably at least 90%, of the sum total of projected areas of all silver halide grains constituting the silver halide emulsion. The side lengths of silver halide grains can be determined from electron micrographs of the grains. More specifically, the side lengths of cubes having the same volumes as silver halide grains are taken as side lengths of the grains. The average side length can be determined by measuring side lengths of silver halide grains so high in number as to be statistically significant (for instance, at least 600 silver halide grains) and calculating the average of the side lengths measured.

The term "sphere-equivalent diameter" as used herein refers to the diameter of a sphere having the same volume as each grain. In the present invention, especially in the second embodiment of the present invention, it is preferable that the emulsion is made up of grains having a monodisperse grain-size distribution. In the second embodiment of the present invention, the coefficient of variation in sphere-equivalent diameters of all the emulsion grains is preferably 20% or below, more preferably 15% or below, particularly preferably 10% or below. The coefficient of variation in sphere-equivalent diameters is expressed in terms of the percentage of the standard deviation of sphere-equivalent diameters of individual grains to the average of the sphere-equivalent diameters. To achieve wide latitude, it is preferably carried out to use a blend of two or more of the monodisperse emulsions as mentioned above in one and the same layer or to coat two or more of the monodisperse emulsions in layers.

The present invention is applied to a silver halide color photographic light-sensitive material having at least one silver halide emulsion layer containing a yellow-dye-forming coupler, at least one silver halide emulsion layer containing a magenta-dye-forming coupler, and at least one silver halide emulsion layer containing a cyan-dye-forming coupler. In the second embodiment of the present invention, the sphere-equivalent diameter of the emulsion grains in the silver halide emulsion layer containing a yellow-dye-forming coupler is preferably 0.6 μm or below, more preferably 0.5 μm or below, and particularly preferably 0.4 μm or below, and the lower limit is 0.05 μm. In the second embodiment of the present invention, the sphere-equivalent diameter of the emulsion grains in the silver halide emulsion layer containing a magenta-dye-forming coupler and that in the silver halide emulsion layer containing a cyan-dye-forming coupler each are preferably 0.5 μm or below, more preferably 0.4 μm or below, and particularly preferably 0.3 μm or below, and the lower limit is 0.05 μm. The term "sphere-equivalent diameter" as used herein refers to the diameter of a sphere having the same volume as each individual grain. The grain having a sphere-equivalent diameter of 0.6 μm is comparable to a cubic grain having a side length of about 0.48 μm, the grain having a sphere-equivalent diameter of 0.5 μm is comparable to a cubic grain having a side length of about 0.40 μm, the grain having a sphere-equivalent diameter of 0.4 μm is comparable to a cubic grain having a side length of about 0.32 μm, and the grain having a sphere-equivalent diameter of 0.3 μm is comparable to a cubic grain having a side length of about 0.24 μm. The silver halide emulsion according to the second embodiment of the present invention may further contain another silver halide grains, in addition to the silver halide grains contained in the silver halide emulsion defined in the second embodiment of the present invention (namely, the specific silver halide emulsion (grains) having silver chloride content of 95 mol % or more and containing the specific selenium compound and the metal complex represented by formula (D1)). As to the silver halide emulsion according to the second embodiment of the present invention, however, it is required that at least 50%, based on projected area, of all the grains contained therein be the specific silver halide grains defined in the second embodiment of the present invention, and it is preferable that the silver halide grains defined in the second embodiment of the present invention make up, on a projected-area basis, at least 80%, especially at least 90%, of all the grains contained therein.

Each of the present silver halide emulsions contains specific silver halide grains. The silver halide grains have no particular restriction as to their shapes. It is, however, preferable that the grains are made up of cubic grains having substantially {100} faces, tetradecahedral crystal grains (which may be round in their vertexes and may have higher-order planes), octahedral crystal grains, or tabular grains having principal faces formed of {100} faces or {111} faces and an aspect ratio of 2 or more, preferably 3 or more. The term "aspect ratio" as used herein refers to the value obtained by dividing the diameter of a circle equivalent to the projected area of a grain by the gain thickness. In the first embodiment of the present invention, it is preferable that the silver halide grains be cubic or tetradecahedral grains.

The silver halide emulsion of the first embodiment of the present invention is required to have a silver chloride content of at least 95 mole %, and it is preferable that the silver chloride content therein be 98 mole % or above.

The silver halide emulsion defined in the second embodiment of the present invention has a silver chloride content of at least 95 mole %, and it is preferable from the viewpoint of rapid processing suitability that the silver chloride content be 96 mole % or above, more preferably 97 mole % or above.

The silver halide grains in the silver halide emulsion for use in the present invention, each preferably have a silver bromide-containing phase and/or a silver iodide-containing phase. In the first embodiment of the present invention, when the silver halide emulsion specific to the invention has a silver bromide-containing phase, the silver bromide content therein is preferably from 0.1 to 4 mole %, and more preferably from 0.5 to 2 mole %. When the silver halide emulsion specific to the first embodiment of the present invention has a silver iodide-containing phase, the silver iodide content therein is preferably from 0.02 to 1 mole %, more preferably from 0.05 to 0.50 mole %, and further more preferably from 0.07 to 0.40 mole %. Further, in the second embodiment of the present invention, from additional viewpoints of hard gradation and excellent latent-image stability, it is preferable that the silver bromide content be from 0.1 to 7 mole %, preferably from 0.5 to 5 mole %. In the second embodiment of the present invention, the silver iodide content is preferably 0.02 to 1 mole %, more preferably 0.05 to 1.0 mole %, further more preferably 0.05 to 0.50 mole %, and most preferably 0.07 to 0.40 mole %, from viewpoints of obtaining high sensitivity and hard gradation in high illumination intensity.

In the second embodiment of the present invention, the silver halide grains specific to the invention are preferably silver iodobromochloride grains, particularly preferably silver iodobromochloride grains having halide compositions as recited above.

The specific silver halide grains in the silver halide emulsion for use in the present invention, each preferably have a silver bromide-containing phase and/or a silver iodide-containing phase. Especially, silver iodobromochloride grains having the above halogen compositions are preferred. Herein, the term "silver bromide-containing phrase" or "silver iodide-containing phase" means a region where the content of silver bromide or silver iodide is higher than that in the surrounding regions. The halogen compositions of the silver bromide-containing phase or the silver iodide-containing phase and of the surrounding region (outer periphery) may vary either continuously or drastically. Such a silver bromide-containing phase or silver iodide-containing phase may form a layer which has an approximately constant concentration in a certain width at a portion in the grain, or it may form a maximum point having no spread. In the first embodiment of the present invention, the local silver bromide content in the silver bromide-containing phase is preferably 3 mol % or more, more preferably from 5 to 40 mol %, and most preferably from 5 to 25 mol %. In the second embodiment of the present invention, the local silver bromide content in the silver bromide-containing phase is preferably 5 mol % or more, more preferably from 10 to 80 mol %, and most preferably from 15 to 50 mol %. In the first and second embodiments of the present invention, the local silver iodide content in the silver iodide-containing phase is preferably 0.3 mol % or more, more preferably from 0.5 to 8 mol %, and most preferably from 1 to 5 mol %. Such a silver bromide- or silver iodide-containing phase may be present in plural numbers in layer form, within the grain. In this case, the phases may have different silver bromide or silver iodide contents from each other.

It is preferable that the silver bromide-containing phase or silver iodide-containing phase that the silver halide emulsion grains for use in the present invention have, are each formed in the layer form so as to surround the grain center. One preferred embodiment is that the silver bromide-containing phase or silver iodide-containing phase formed in the layer form so as to surround the grain, has a uniform concentration distribution in the circumferential direction of the grain in each phase. However, in the silver bromide-containing phase or the silver iodide-containing phase formed in the layer form so as to surround the grain, there may be the maximum point or the minimum point of the silver bromide or silver iodide concentration in the circumferential direction of the grain to have a concentration distribution. For example, when the emulsion grain has the silver bromide-containing phase or silver iodide-containing phase formed in the layer form so as to surround the grain in the vicinity of the grain surface, the silver bromide or silver iodide concentration of a corner portion or of an edge of the grain can be different from that of a principal face of the grain. Further, aside from the silver bromide-containing phase and/or silver iodide-containing phase formed in the layer form so as to surround the grain, another silver bromide-containing phase and/or silver iodide-containing phase not surrounding the grain may exist in isolation at a specific portion of the surface of the grain.

In a case where the silver halide emulsion for use in the present invention contains a silver bromide-containing phase, it is preferable that said silver bromide-containing phase be formed in a layer form so as to have a concentration maximum of silver bromide inside the grain. Likewise, in a case where the silver halide emulsion of the present invention contains a silver iodide-containing phase, it is preferable that said silver iodide-containing phase be formed in a layer form so as to have a concentration maximum of silver iodide on the surface of the grain. Such a silver bromide-containing phase or silver iodide-containing phase is constituted preferably with a silver amount of 3% to 30%, more preferably with a silver amount of 3% to 15%, in terms of the grain volume, in the viewpoint of increasing the local concentration with a smaller silver bromide or silver iodide content.

The silver halide grain of the silver halide emulsion for use in the present invention preferably contains both a silver bromide-containing phase and a silver iodide-containing phase. In this case, the silver bromide-containing phase and the silver iodide-containing phase may exist either at the same place in the grain or at different places thereof. It is preferred that these phases exist at different places, in a point that the control of grain formation may become easy. Further, a silver bromide-containing phase may contain silver iodide. Alternatively, a silver iodide-containing phase may contain silver bromide. In general, an iodide added during formation of high silver chloride grains is liable to ooze to the surface of the grain more than a bromide, so that the silver iodide-containing phase is liable to be formed at the vicinity of the surface of the grain. Accordingly, when a silver bromide-containing phase and a silver iodide-containing phase exist at different places in a grain, it is preferred that the silver bromide-containing phase be formed more internally than the silver iodide-containing phase. In such a case, another silver bromide-containing phase may be provided further outside the silver iodide-containing phase in the vicinity of the surface of the grain.

A silver bromide content and/or a silver iodide content necessary for exhibiting the effects of the present invention such as achievement of high sensitivity and realization of hard gradation, each increase with the silver bromide-containing phase and/or the silver iodide-containing phase being formed in more inside of the grain. This causes the silver chloride content to decrease to more than necessary, resulting in the possibility of impairing rapid processing suitability. Accordingly, to integrate functions of these phases for controlling photographic actions, in the vicinity of the surface of the grain, it is preferred that the silver bromide-containing phase and the silver iodide-containing phase be placed adjacent to each other.

From these points, it is preferred that the silver bromide-containing phase be formed at any of the position ranging from 50% to 100% of the grain volume measured from the inside, and that the silver iodide-containing phase be formed at any of the position ranging from 85% to 100% of the grain volume measured from the inside. Further, it is more preferred that the silver bromide-containing phase be formed at any of the position ranging from 70% to 95% of the grain volume measured from the inside, and that the silver iodide-containing phase be formed at any of the position ranging from 90% to 100% of the grain volume measured from the inside.

When the silver halide emulsion for use in the first embodiment of the present invention has a silver bromide-containing phase, another preferable mode of the silver halide emulsion having a silver bromide-containing phase is a mode in which the silver halide emulsion has a region ranging in silver bromide content from 0.5 to 20 mole % at a depth of 20 nm or less below the emulsion grain surface. Herein, it is preferable for the silver bromide-containing phase to be situated at a depth of 10 nm or less below the emulsion grain surface and to range in silver bromide content from 0.5 to 10 mole %, more preferably from 0.5 to 5 mole %. In this case, it is not always required that the silver bromide-containing phase take a layer form. For maximizing the effects of the invention, however, it is preferable that the silver bromide-containing phase be formed so as to take a layer form to surround the emulsion grain.

When the silver halide emulsion for use in the first embodiment of the present invention has a silver iodide-containing phase, another preferable mode of the silver halide emulsion having a silver iodide-containing phase is a mode in which the silver halide emulsion has a region ranging in silver iodide content from 0.3 to 10 mole % at a depth of 20 nm or less below the emulsion grain surface. Herein, it is preferable for the silver iodide-containing phase to be situated at a depth of 10 nm or less below the emulsion grain surface and to range in silver bromide content from 0.5 to 10 mole %, more preferably from 0.5 to 5 mole %. In this case, it is not always required that the silver iodide-containing phase take a layer form. For maximizing the effects of the invention, however, it is preferable that the silver iodide-containing phase be formed so as to take a layer form to surround the emulsion grain.

The silver halide emulsion of the present invention preferably contains silver bromide and/or silver iodide. In order to introduce bromide ions or iodide ions, a bromide salt or iodide salt solution may be added alone, or it may be added in combination with both a silver salt solution and a high chloride salt solution. In the latter case, the bromide or iodide salt solution and the high chloride salt solution may be added separately, or as a mixture solution of these salts of bromide or iodide and high chloride. The bromide or iodide salt is generally added in a form of a soluble salt, such as an alkali or alkali earth bromide or iodide salt. Alternatively, bromide or iodide ions may be introduced by cleaving the bromide or iodide ions from an organic molecule, as described in U.S. Pat. No. 5,389,508. As another source of bromide or iodide ion, fine silver bromide grains or fine silver iodide grains may be used.

The addition of a bromide salt or iodide salt solution may be concentrated at one time of grain formation process or may be performed over a certain period of time. For obtaining an emulsion with high sensitivity and low fog, the position of the introduction of iodide ions to a high chloride emulsion may be limited. The deeper in the emulsion grain iodide ions are introduced, the smaller is the increment of sensitivity. Accordingly, the addition of an iodide salt solution is preferably started at 50% or outer side of the volume of the grain, more preferably 70% or outer side, and most preferably 85% or outer side. Moreover, the addition of an iodide salt solution is preferably finished at 98% or inner side of the volume of the grain, more preferably 96% or inner side. When the addition of an iodide salt solution is finished at a little inner side of the grain surface, an emulsion having higher sensitivity and lower fog can be obtained.

On the other hand, the addition of a bromide salt solution is preferably started at 50% or outer side, more preferably 70% or outer side of the volume of the grain.

The distribution of a bromide ion concentration and iodide ion concentration in the depth direction of the grain can be measured, according to an etching/TOF-SIMS (Time of Flight-Secondary Ion Mass Spectrometry) method by means of, for example, TRIFT II Model TOF-SIMS apparatus (trade name, manufactured by Phi Evans Co.). A TOF-SIMS method is specifically described in, Nippon Hyomen Kagakukai edited, *Hyomen Bunseki Giiutsu Sensho Niji Ion Shitsurvo Bunsekiho* (*Surface Analysis Technique Selection—Secondary Ion Mass Analytical Method*), Manizen Co., Ltd. (1999). When an emulsion grain is analyzed by the etching/TOF-SIMS method, it can be analyzed that iodide ions ooze toward the surface of the grain, even though the addition of an iodide salt solution is finished at an inner side of the grain. In the analysis with the etching/TOF-SIMS method, it is preferred that the emulsion of the present invention have the maximum concentration of iodide ions at the surface of the grain, that the iodide ion concentration decrease inwardly in the grain, and that the bromide ions have the maximum concentration in the inside of the grain. The local concentration of silver bromide can also be measured with X-ray diffractometry, as long as the silver bromide content is high to some extent.

The specific silver halide grains in the present silver halide emulsion preferably contain an iridium complex. As the iridium complex, preferred is a hexacoordinate complex having at least two different kinds of ligands in one and the same complex and containing Ir as a central metal. Of such hexacoordinate iridium complexes, hexacoordinate iridium complexes having both halogen ligands (including-pseudohalogen ligands) and organic ligands in one and the same complex and hexacoordinate iridium complexes having both halogen ligands (including pseudohalogen ligands) and inorganic ligands other than halogen ligands in one and the same complex are favorable over the others. It is more preferable that each of the silver halide grains specific to the present invention contain a combination of a hexacoordinate iridium complex having both halogen ligands and organic ligands and a hexacoordinate iridium complex having both halogen ligands and inorganic ligands other than halogen ligands.

The metal complexes represented by the following formula (D1), for use in the present invention, preferably in the second embodiment of the present invention, will be explained below.

Incidentally, the metal complexes represented by formula (D1) are complexes used for rendering the gradation of photosensitive materials harder (hard-gradation-enhancing complexes).

$$[M^{D1}X^{D1}{}_{n}L^{D1}{}_{(6-n)}]^{m} \qquad \text{Formula (D1)}$$

In formula (D1), $M^{D1}$ represents Cr, Mo, Re, Fe, Ru, Os, Co, Rh, Pd, or Pt; $X^{D1}$ represents a halogen ion; $L^{D1}$ represents a ligand different from $X^{D1}$; n represents an integer of 3, 4, 5, or 6; and m represents the electric charge of the metal complex and is 4−, 3−, 2−, 1−,0, or 1+Herein, plural $X^{D1}$s may be the same or different. When plural $L^{D1}$s exist, the plural $L^{D1}$s may be the same or different. However, among ligands each of the metal complexes represented by formula (D1) has, no or only one ligand is CN ion.

Among the metal complexes represented by formula (D1), metal complexes represented by formula (D1 A) are preferred.

$$[M^{D1A}X^{D1A}{}_{n}L^{D1A}{}_{(6-n)}]^{m} \qquad \text{Formula (D1 A)}$$

In formula (D1A), $M^{D1A}$ represents Re, Ru, Os, or Rh; $X^{D1A}$ represents a halogen ion; $L^{D1A}$ represents NO or NS when $M^{D1A}$ is Re, Ru, or Os, while $L^{D1A}$ represents $H_2O$, OH, or O when $M^{D1A}$ is Rh; n represents an integer of 3, 4, 5, or 6; and m represents an electronic charge of the metal complex and is 4−, 3−, 2−, 1−, 0, or 1+. Herein, plural $X^{D1A}$s may be the same or different. When plural $L^{D1A}$s exist, the plural $L^{D1A}$s may be the same or different.

$X^{D1A}$ has the same meanings as $X^{D1}$ in formula (D1) and preferable ranges are also identical.

Preferable specific examples of the metal complexes represented by formula (D1) are shown below. However, the present invention is not limited to these complexes.

$[ReCl_6]^{2-}$
$[ReCl_5(NO)]^{2-}$
$[RuCl_6]^{2-}$
$[RuCl_6]^{3-}$
$[RuCl_5(NO)]^{2-}$
$[RuCl_5(NS)]^{2-}$
$[RuBr_5(NS)]^{2-}$
$[OsCl_6]^{4-}$
$[OsCl_5(NO)]^{2-}$
$[OsBr_5(NS)]^{2-}$
$[RhCl_6]^{3-}$
$[RhCl_5(H_2O)]^{2-}$
$[RhCl_4(H_2O)]^{2-}$
$[RhBr_6]^{3-}$
$[RhBr_5(H_2O)]_{2-}$
$[RhBr_4(H_2O)_2]^{-}$
$[PdCl_6]^{2-}$
$[ptCl_6]^{2-}$

Among them, $[OsCl_5(NO)]^{2-}$ or $[RhBr_6]^{3}$ is particularly preferable.

Next, the metal complexes represented by the following formula (D2) (six-coordination complexes having iridium as a central metal), which are preferably used in the first and second embodiments of the present invention, will be explained.

$$[IrX^{D2}{}_nL^{D2}{}_{(6-n)}]^m \qquad \text{Formula (D2)}$$

In formula (D2), $X^{D2}$ represents a halogen ion or a pseudohalogen ion other than a cyanate ion; $L^{D2}$ represents a ligand different from $X^{D2}$; n represents an integer of 3, 4, or 5; and m represents an electric charge of the metal complex and is 5−, 4−, 3−, 2−, 1−,0, or 1+. Herein, plural $X^{D2}$s may be the same or different. When plural $L^{D2}$s are present, these plural $L^{D2}$s may be the same or different.

In the above, the pseudohalogen (halogenoid) ion means an ion having a nature similar to that of halogen ion, and examples of the same include cyanide ion ($CN^-$), thiocyanate ion ($SCN^-$), selenocyanate ion ($SeCN^-$), tellurocyanate ion ($TeCN^-$), azide dithiocarbonate ion ($SCSN_3^-$), cyanate ion ($OCN^-$), fulminate ion ($ONC^-$), and azide ion ($N_3^-$).

$X^{D2}$ is preferably a fluoride ion, a chloride ion, a bromide ion, an iodide ion, a cyanide ion, an isocyanate ion, a thiocyanate ion, a nitrate ion, a nitrite ion, or an azide ion. Among these, chloride ion and bromide ion are particularly preferable. $L^{D2}$ is not particularly limited, and it may be an organic or inorganic compound that may or may not have electric charge(s), with organic or inorganic compounds with no electric charge being preferable.

Among the metal complexes represented by the formula (D2), metal complexes represented by the following formula (D2A) are preferred.

$$[IrX^{D2A}{}_nL^{D2A}{}_{(6-n)}]^m \qquad \text{Formula (D2A)}$$

In formula (D2A), $X^{D2A}$ represents a halogen ion or a pseudohalogen ion other than a cyanate ion. $L^{D2A}$ represents an inorganic ligand different from $X^{D2A}$. n represents an integer of 3, 4, or 5. m represents the electric charge of the metal complex and is 5−, 4−, 3−, 2−, 1−,0, or 1+. Herein, plural $X^{D2A}$s may be the same or different. When plural $L^{D2A}$s are present, these plural $L^{D2A}$s may be the same or different.

In formula (D2A), $X^{D2A}$ has the same meanings as $X^{D2}$ in formula (D2) and preferred ranges are also identical. $L^{D2A}$ is preferably water, OCN, ammonia, phosphine, and carbonyl, with water being particularly preferred.

Among the metal complexes represented by formula (D2), metal complexes represented by the following formula (D2B) are further preferred.

$$[IrX^{D2B}{}_nL^{D2B}{}_{(6-n)}]^m \qquad \text{Formula (D2B)}$$

In formula (D2B), $X^{D2B}$ represents a halogen ion or a pseudohalogen ion other than cyanate ion; $L^{D2B}$ represents a ligand having a chained or cyclic hydrocarbon as a basic structure, or a ligand in which a portion of carbon atoms or hydrogen atoms of the basic structure is substituted with other atoms or atom groups; n represents an integer of 3, 4, or 5; m represents the electric charge of the metal complex and is 5−, 4−, 3−, 2−, 1−,0, or 1+. Herein, plural $X^{D2B}$s may be the same or different. When plural $L^{D2B}$s are present, these plural $L^{D2B}$s may be the same or different.

$X^{D2B}$ has the same meanings as $X^{D2}$ in formula (D2) and preferable ranges are also identical. $L^{D2B}$ represents a ligand having a chain or cyclic hydrocarbon as a basic structure, or a ligand in which a portion of carbon atoms or hydrogen atoms of the basic structure is substituted with other atoms or atom groups, but it is not a cyanide ion. $L^{D2B}$ is preferably a heterocyclic compound, more preferably a 5-membered heterocyclic compound ligand. Among the 5-membered heterocyclic compound, compounds having at least one nitrogen atom and at least one sulfur atom in its 5-membered ring skeleton are further preferred.

Among the metal complexes represented by formula (D2B), metal complexes represented by formula (D2C) are more preferred.

$$[IrX^{D2C}{}_nL^{D2C}{}_{(6-n)}]^m \qquad \text{Formula (D2C)}$$

In formula (D2C), $X^{D2A}$ represents a halogen ion or a pseudohalogen ion other than a cyanate ion; $L^{D2A}$ represents a 5-membered ring ligand having at least one nitrogen atom and at least one sulfur atom in its ring skeleton that may have a substituent on the carbon atoms in said ring skeleton; n represents an integer of 3, 4, or 5; and m represents the electric charge of the metal complex and is 5−, 4−, 3−, 2−, 1−,0, or 1+. Herein, plural $X^{D2C}$s may be the same or different. When plural $L^{D2C}$s are present, these plural $L^{D2C}$s may be the same or different.

$X^{D2C}$ has the same meanings as $X^{D2}$ in formula (D2) and preferable ranges are also identical. The substituent on the carbon atoms in said ring skeleton in $L^{D2C}$ is preferably a substituent having a smaller volume than n-propyl group. Preferred examples of the substituent include a methyl group, an ethyl group, a methoxy group, an ethoxy group, a cyano group, an isocyano group, a cyanate group, an isocyanate group, a thiocyanate group, a isothiocyanate group, a formyl group, a thioformyl group, a hydroxyl group, a mercapto group, an amino group, a hydrazino group, an azido group, a nitro group, a nitroso group, a hydroxyamino group, a carboxyl group, a carbamoyl group, a halogen atom (fluoro, chloro, bromo, and iodo).

Among the metal complexes represented by formula (D2C), metal complexes represented by formula (D2D) are more preferred.

$$[IrX^{D2D}{}_nL^{D2D}{}_{(6-n)}]^m \qquad \text{Formula (D2D)}$$

In formula (D2D), $X^{D2D}$ represents a halogen ion or a pseudohalogen ion other than a cyanate ion; $L^{D2D}$ represents a 5-membered ring ligand having at least two nitrogen atoms and at least one sulfur atom in its ring skeleton that may have a substituent on the carbon atoms in said ring skeleton; n represents an integer of 3, 4, or 5; and m represents the electric charge of the metal complex and is 5−, 4−, 3−, 2−, 1−, 0, or 1+. Herein, plural $X^{D2D}$s may be the same or different. When plural $L^{D2D}$s are present, these plural $L^{D2D}$s may be the same or different.

$X^{D2D}$ has the same meanings as $X^{D2}$ in formula (D2) and preferable ranges are also identical. $L^{D2D}$ is preferably a compound containing thiadiazole as a skeleton, and a substituent other than hydrogen is preferably bonded to the carbon atoms in the compound. Preferred examples of the substituent include a halogen atom (such as fluorine, chlorine, bromine, iodine), a methoxy group, an ethoxy group, a carboxyl group, a methoxycarboxyl group, an acyl group, an acetyl group, a chloroformyl group, a mercapto group, a methylthio group, a thioformyl group, a thiocarboxyl group, a dithiocarboxyl group, a sulfino group, a sulfo group, a sulfamoyl group, a methylamino group, a cyano group, an isocyano group, a cyanato group, an isocyanato group, a thiocyanato group, an isothiocyanato group, a hydroxyamino group, a hydroxyimino group, a carbamoyl group, a nitroso group, a nitro group, a hydrazino group, a hydrazono group, and an azido group; more preferred examples include a halogen atom (fluorine, chlorine, bromine, iodine), a chloroformyl group, a sulfino group, a sulfo group, a sulfamoyl group, an isocyano group, a cyanato group, an isocyanato group, a thiocyanato group, an isothiocyanate group, a hydroxyimino group, a nitroso group, a nitro group, and an azido group. Among them, chlorine, bromine, a chloroformyl group, an isocyano group, a cyanato group, an isocyanato group, and a thiocyanato group are particularly preferred. n preferably represents 4 or 5, and m preferably represents 2− or 1−.

Preferable specific examples of the metal complexes represented by formula (D2) are shown below. However, the present invention is not limited to these complexes.

$[IrCl_5(H_2O)]^{2-}$
$[IrCl_4(H_2O)_2]^{-}$
$[IrCl_5(H_2O)]^{-}$
$[IrCl_4(H_2O)_2]^{0}$
$[IrCl_5(OH)]^{3-}$
$[IrCl_4(OH)_2]^{2-}$
$[IrCl_5(OH)]^{2-}$
$[IrCl_4(OH)_2]^{2-}$
$[IrCl_5(O)]^{4-}$
$[IrCl_4(O)_2]^{5-}$
$[IrCl_5(O)]^{3-}$
$[IrCl_4(O)_2]^{4-}$
$[IrBr_5(H_2O)]^{2-}$
$[IrBr_4(H_2O)_2]^{-}$
$[IrBr_5(H_2O)]^{-}$
$[IrBr_4(H_2O)_2]^{0}$
$[IrBr_5(OH)]^{3-}$
$[IrBr_4(OH)_2]^{2-}$
$[IrBr_5(OH)]^{2-}$
$[IrBr_4(OH)_2]-$
$[IrBr_5(O)]^{4-}$
$[IrBr_4(O)_2]^{5-}$
$[IrBr_5(O)]^{3-}$
$[IrBr_4(O)_2]^{4-}$
$[IrCl_5(OCN)]^{3-}$
$[IrBr_5(OCN)]^{3-}$
$[IrCl_5(thiazole)]^{2-}$
$[IrCl_4(thiazole)_2]^{-}$
$[IrCl_3(thiazole)_3]^{0}$
$[IrBr_5(thiazole)]^{2-}$
$[IrBr_4(thiazole)_2]^{-}$
$[IrBr_3(thiazole)_3]^{0}$
$[IrCl_5(5\text{-methylthiazole})]^{2-}$
$[IrCl_4(5\text{-methylthiazole})_2]^{-}$
$[IrBr_5(5\text{-methylthiazole})]^{2-}$
$[IrBr_4(5\text{-methylthiazole})_2]^{-}$ Among them, $[IrCl_5(5\text{-methylthiazole})]^{2-}$ is particularly preferred in the second embodiment of the present invention.

In the present invention, the silver halide grains may contain not only the aforementioned iridium compound represented by formula (D2) but also another iridium complex having 6 ligands, all of which are Cl, Br, or I; and in the case of the first embodiment of the present invention, it is preferred that such another iridium complex be contained. In this case, any two or three of Cl, Br, and I may be mixed and present in the 6-coordination complex. The iridium complex (six-coordination complex) in which the ligands are Cl, Br, or I is particularly preferably incorporated in a silver bromide-containing phase, in order to obtain hard gradation upon high illuminance exposure.

Specific examples of the iridium complex (six-coordination complex) in which all of 6 ligands are made of Cl, Br, or I are shown below. However, the present invention is not limited to these complexes.

$[IrCl_6]^{2-}$
$[IrCl_6]^{3-}$
$[IrBr_6]^{2-}$
$[IrBr_6]^{3-}$
$[IrI_6]^{3-}$

The foregoing metal complexes are anionic ions. When these are formed into salts with cationic ions, counter cationic ions are preferably those easily soluble in water. Preferable examples thereof include an alkali metal ion, such as a sodium ion, a potassium ion, a rubidium ion, a cesium ion, and a lithium ion; an ammonium ion, and an alkyl ammonium ion. These metal complexes can be used being dissolved in water or in a mixed solvent of water and an appropriate water-miscible organic solvent (such as alcohols, ethers, glycols, ketones, esters, and amides). The metal complexes of formula (D1) are added in amounts of, preferably $1\times10^{-11}$ mole to $1\times10^{-6}$ mole, more preferably $1\times10^{-10}$ mole to $1\times10^{-6}$ mole, and particularly preferably $1\times10^{-10}$ mole to $1\times10^{-7}$ mole, per mole of silver atom, during grain formation. These metal complexes of formula (D2) and the iridium complex in which all the ligands are Cl, Br, or I are added in amounts of, preferably $1\times10^{-10}$ mole to $1\times10^{-3}$ mole, and particularly preferably 1×10 mole to $1\times10^{-5}$ mole, per mole of silver atom, during grain formation.

In the present invention, the above-mentioned metal complexes are preferably added directly to the reaction solution at the time of silver halide grain formation, or indirectly to the grain-forming reaction solution via addition to an aqueous halide solution for forming silver halide grains or other solutions, so that they are doped to the inside of the silver halide grains. Further, it is also preferable to employ a method in which the metal complex is doped into a silver halide grain, by preparing fine particles doped with the complex in advance and adding the fine particles for carrying out physical ripening. Further, it is also preferable that these methods may be combined, to incorporate the complex into the inside of the silver halide grains.

In the case where these metal complexes are doped to the inside of the silver halide grains, they are preferably uniformly distributed in the inside of the grains. On the other hand, as disclosed in JP-A-4-208936, JP-A-2-125245 and JP-A-3-188437, they are also preferably distributed only in the grain surface layer. Alternatively they are also preferably distributed only in the inside of the grain while the grain surface is covered with a layer free of the complex. Further, as disclosed in U.S. Pat. Nos. 5,252,451 and 5,256,530, it is also preferred that the silver halide grains be subjected to physical ripening in the presence of fine grains having the metal complexes incorporated therein, to modify the grain surface phase. Further, these methods may be used in combination. Two or more kinds of complexes may be incorporated in the inside of an individual silver halide grain. There is no particular limitation on the halogen composition at the site where the above-mentioned metal complexes are incorporated, but it is preferable that the hexacoordinate complex whose central metal is Ir and whose six ligands are all Cl, Br or I ions be incorporated into maximum silver-bromide concentration region(s).

In the first embodiment of the present invention, a metal ion other than the above-mentioned iridium can be doped in the inside and/or on the surface of the silver halide grains. The metal ions to be used are preferably ions of a transition metal. Preferable examples of the transition metal are iron, ruthenium, osmium, and rhodium. In the second embodiment of the present invention, a metal ion other than the above-mentioned metal complexes can be doped in the inside and/or on the surface of the silver halide grains. The metal ions to be used are preferably ions of a transition metal. Preferable examples of the transition metal are iron, ruthenium, osmium, lead, cadmium, and zinc. In both the first and second embodiments of the present invention, it is more preferable that these metal ions are used in the form of a six-coordination complex of octahedron-type having ligands. When employing an inorganic compound as a ligand, cyanide ion, halide ion, thiocyanate ion, hydroxide ion, peroxide ion, azide ion, nitrite ion, water, ammonia, nitrosyl ion, or thionitrosyl ion is preferably used. Such a ligand is preferably coordinated to any metal ion selected from the group consisting of the above-mentioned iron, ruthenium, osmium, lead, cadmium and zinc. Two or more kinds of these ligands are also preferably used in one complex molecule. Further, an organic compound can also be preferably used as a ligand Preferable examples of the organic compound include chain compounds having a main chain of 5 or less carbon atoms and/or heterocyclic compounds of 5- or 6-membered ring. More preferable examples of the organic compound are those having at least a nitrogen, phosphorus, oxygen, or sulfur atom in a molecule as an atom which is capable of coordinating to a metal. Most preferred organic compounds are faran, thiophene, oxazole, isooxazole, thiazole, isothiazole, imidazole, pyrazole, triazole, furazane, pyran, pyridine, pyridazine, pyrimidine and pyrazine. Further, organic compounds which have a substituent introduced into a basic skeleton of the above-mentioned compounds are also preferred.

As a combination of the metal ion and the ligand, a combination of an iron ion and a cyano ligand and a combination of a ruthenium ion and a cyano ligand are preferable. In the first embodiment of the present invention, it is preferable to use these metal complex compounds and the iridium complexes as recited above in combination. In the second embodiment of the present invention, it is preferable to use these compounds and the metal complexes of formulas (D1) and (D2) as recited above in combination. In the present invention, preferred of these compounds are those in which the number of cyanide ions accounts for the majority of the coordination number (site) intrinsic to the iron or ruthenium that is the central metal. The remaining sites are preferably occupied by thiocyanato, ammonio, aquo, nitrosyl ion, dimethylsulfoxide, pyridine, pyrazine, or 4,4'-bipyridine. Most preferably each of 6 coordination sites of the central metal is occupied by a cyanide ion, to form a hexacyano iron complex or a hexacyano ruthenium complex. Such metal complexes composed of these cyanide ion ligands are preferably added during grain formation in an amount of $1\times10^{-8}$ mol to $1\times10^{-2}$ mol, most preferably $1\times10^{-6}$ mol to $5\times10^{-4}$ mol, per mol of silver atom.

In the present invention, preferably in the first embodiment of the present invention, in the case of the ruthenium complex and the osmium complex, nitrosyl ion, thionitrosyl ion, or water molecule is also preferably used in combination with chloride ion, as ligands. More preferably these ligands form a pentachloronitrosyl complex, a pentachlorothionitrosyl complex, or a pentachloroaquo complex. The formation of a hexachloro complex is also preferred. These complexes are preferably added during grain formation in an amount of $1\times10^{-10}$ mol to $1\times10^{-6}$ mol, more preferably $1\times10^{-9}$ mol to $1\times10^{-6}$ mol, per mol of silver atom.

Various compounds or precursors thereof can be included in the silver halide emulsion of or for use in the present invention, to prevent fogging from occurring or to stabilize photographic performance, during manufacture, storage or photographic processing of the photographic material. Specific examples of compounds useful for the above purposes are disclosed in JP-A-62-215272, pages 39 to 72, and they can be preferably used. In addition, 5-arylamino-1,2,3,4-thiatriazole compounds (the aryl residual group has at least one electron-withdrawing group) disclosed in European Patent No. 0447647 can also be preferably used.

Further, in the present invention, to enhance storage stability of the silver halide emulsion, it is also preferred in the present invention to use hydroxamic acid derivatives described in JP-A-11-109576; cyclic ketones having a double bond adjacent to a carbonyl group, both ends of said double bond being substituted with an amino group or a hydroxyl group, as described in JP-A-11-327094 (in particular, compounds represented by formula (S1); the description at paragraph Nos. 0036 to 0071 of JP-A-11-327094 is incorporated herein by reference); sulfo-substituted catecols or hydroquinones described in JP-A-11-143011 (for example, 4,5 dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid, and salts of these acids); hydroxylamines represented by formula (A) described in U.S. Pat. No. 5,556,741 (the description of line 56 in column 4 to line 22 in column 11 of U.S. Pat. No. 5,556,741 is preferably applied to the present invention and is incorporated herein by reference); and water-soluble reducing agents represented by formula (I), (II), or (III) of JP-A-11-102045.

Spectral sensitization can be carried out for the purpose of imparting spectral sensitivity in a desired light wavelength region to the light-sensitive emulsion of or for use in the present invention. Examples of spectral sensitizing dyes for spectral sensitization of blue, green, and red light regions, include, for example, those disclosed by F. M. Harmer, in *Heterocyclic Compounds—Cyanine Dyes and Related Compounds*, John Wiley & Sons, New York, London (1964). Specific examples of compounds and spectral sensitization processes that are preferably used in the present invention include those described in JP-A-62-215272, from page 22, right upper column to page 38. In addition, the spectral sensitizing dyes described in JP-A-3-123340 are very preferred as red-sensitive spectral sensitizing dyes for silver halide emulsion grains having a high silver chloride content, from the viewpoint of stability, adsorption strength, temperature dependency of exposure, and the like.

The amount of these spectral sensitizing dyes to be added can vary in a wide range depending on the occasion, and it is preferably in the range of $0.5\times10^{-6}$ mole to $1.0\times10^{-2}$ mole, more preferably in the range of $1.0\times10^{-6}$ mole to $5.0\times10^{-3}$ mole, per mole of silver halide.

In the first embodiment of the present invention, the silver halide emulsions of the present invention is incorporated in at least one silver halide emulsion layer. Preferably, it is incorporated in a yellow-dye-forming silver halide emulsion layer or a silver halide emulsion layer nearest to the support.

Next, silver halide color photographic light-sensitive materials relating to the present invention are described.

Each of the silver halide color photographic light-sensitive materials of the present invention (which may be simply referred to as "photosensitive material"), as mentioned above, has, on a support, at least one yellow-color-forming blue-sensitive silver halide emulsion layer, at least one magenta-color-forming green-sensitive silver halide emulsion layer, and at least one cyan-color-forming red-sensitive silver halide emulsion layer. The second embodiment of the present invention is characterized in that at least one of the aforementioned silver halide emulsion layers constituting the silver halide color photographic light-sensitive material contains the silver halide emulsion of the present invention.

In the present invention, the yellow-color-forming blue-sensitive silver halide emulsion layer functions as a yellow-color-forming layer containing a yellow-dye-forming coupler, the magenta-color-forming green-sensitive silver halide emulsion layer as a magenta-color-forming layer containing a magenta-dye-forming coupler, and the cyan-color-forming red-sensitive silver halide emulsion layer as a cyan-color-forming layer containing a cyan-dye-forming coupler. It is preferable that silver halide emulsions contained in the yellow-color-forming layer, the magenta-color-forming layer, and the cyan-color-forming layer, respectively, have sensitivities to light in wavelength regions different from one another (e.g., a blue region, a green region, and a red region).

In the second embodiment of the present invention, it is preferable that at least two varieties of silver halide emulsions differing in sensitivity and having silver chloride contents of at least 90 mole % are contained in a silver halide emulsion layer. The silver halide emulsions differing in sensitivity may include at least two varieties; however, from the viewpoint of designing a photosensitive material, the use of two or three varieties of emulsions is preferred. When three or more varieties of silver halide emulsions differing in sensitivity are used, the second embodiment of the present invention is applied to at least one of them. The two varieties of silver halide emulsions may differ in grain size, halide composition and structure; or species and amounts of sensitizing dyes, chemical sensitizers and antifoggants used; or they may be identical in those factors, provided that their sensitivities are different Herein, it is appropriate that the sensitivities of the two emulsions be different by from 0.05 logE to 0.8 logE, preferably from 0.15 logE to 0.5 logE, when a photosensitive material having a composition where the two emulsions are included, is subjected to $10^{-4}$-second image-wise exposure and then to photographic processing adopted.

In the second embodiment of the present invention, at least two varieties of silver halide emulsions differing in sensitivity and having silver chloride contents of at least 95 mole %, though preferably mixed in one and the same silver halide emulsion layer, may be coated separately to form different emulsion layers. Herein, however, these layers are required to have almost the same color sensitivity and to generate colors of almost the same hue. The expression "to have almost the same color sensitivity", in the case of color photographic materials, means that the layers have sensitivities to light in the same color range, e.g., light in the blue range, light in the green range, or light in the red range, and that the layers may be different in spectral sensitivity as far as the spectral sensitivities are in the same color range. In addition, the expression "to generate colors of almost the same hue", in the case of color photographic materials, means that the layers generate colors in the same hue range, e.g., yellow colors, magenta colors, or cyan colors, and that the layers may be different in hue of generated color as far as the difference falls within the same color hue.

In the second embodiment of the present invention, at least one of the at least two varieties of silver halide emulsions differing in sensitivity and having silver chloride contents of at least 95 mole % contains the metal complex represented by formula (D1). The metal complex represented by formula (D1) is preferably contained in both of the two varieties of silver halide emulsions differing in sensitivity, and more preferably contained in all the silver halide emulsions forming silver halide emulsion layers.

In the at least two varieties of silver halide emulsions differing in sensitivity and having silver chloride contents of at least 95 mole %, it is preferable that the amount of the metal complex represented by formula (D1) contained per mole of silver halide be greater in the low-sensitivity emulsion than in the high-sensitivity emulsion. Further, it is preferable that the average metal complex content per grain be higher in the low-sensitivity emulsion than in the high-sensitivity emulsion. In these cases, no metal complex may be contained in the high-sensitivity emulsion, but it is preferable that the high-sensitivity emulsion contains the metal complex represented by formula (D1) in an amount smaller than the low-sensitivity emulsion.

In the at least two varieties of silver halide emulsions differing in sensitivity and having silver chloride contents of at least 95 mole %, it is preferable that the degree of desensitization by a metal complex represented by formula (D1) be greater in the low-sensitivity emulsion than in the high-sensitivity emulsion. The phrase "degree of desensitization by a metal complex represented by formula (D1)" as used herein refers to the difference in sensitivity between the case of incorporating a metal complex represented by formula (D1) into an emulsion and the case of not incorporating the metal complex into the same emulsion, with the direction of desensitization being defined as positive. Further, the degree of desensitization is set as 0, in the case where one of the silver halide emulsions differing in sensitivity does not contain the metal complex concerned. The degrees of desensitization in the high-sensitivity emulsion and the low-sensitivity emulsion, respectively, are preferably from 0 to 0.8 logE, more preferably from 0.1 to 0.5 logE. Further, it is preferable that the degree of desensitization by the metal complex concerned be higher in the low-sensitivity emulsion than in the high-sensitivity emulsion by 0.1 to 0.8 logE, and more preferably by 0.1 to 0.5 logE.

The light-sensitive material of the present invention may be provided with a hydrophilic colloid layer, an anti-halation layer, an intermediate layer, and a colored layer, if necessary, in addition to the aforementioned yellow color-forming layer, magenta color-forming layer, and cyan color-forming layer.

In the light-sensitive material of the present invention, any of conventionally-known materials for photography or additives may be used.

For example, as a photographic support (base), a transmissive type support or a reflective type support may be used. As the transmissive type support, it is preferred to use a transparent film, such as a cellulose nitrate film, and a polyethylene terephthalate film; or a polyester of 2,6-naphthalenedicarboxylic acid (NDCA) and ethylene glycol (EG), or a polyester of NDCA, terephthalic acid, and EG, provided thereon with an information-recording layer such as a magnetic layer. In the present invention, it is preferred to use the reflective type support (or reflective support). As the reflective type support, it is especially preferable to use a reflective support having a substrate laminated thereon with a plurality of polyethylene layers or polyester layers, at least one of the water-proof resin layers (laminate layers) contains a white pigment such as titanium oxide.

A more preferable reflective support is a support having a paper substrate provided with a polyolefin layer having fine holes, on the same side as silver halide emulsion layers. The polyolefin layer may be composed of multi-layers. In this case, it is more preferable for the support to be composed of a fine hole-free polyolefin (e.g., polypropylene, polyethylene) layer adjacent to a gelatin layer on the same side as the silver halide emulsion layers, and a fine hole-containing polyolefin (e.g., polypropylene, polyethylene) layer closer to the paper substrate. The density of the multi-layer or single-layer of polyolefin layer(s) existing between the paper substrate and photographic constituting layers is preferably in the range of 0.40 to 1.0 g/ml, more preferably in the range of 0.50 to 0.70 g/ml. Further, the thickness of the multi-layer or single-layer of polyolefin layer(s) existing between the paper substrate and photographic constituting layers is preferably in the range of 10 to 100 μm, more preferably in the range of 15 to 70 μm. Further, the ratio of thickness of the polyolefin layer(s) to the paper substrate is preferably in the range of 0.05 to 0.2, more preferably in the range 0.1 to 0.15.

Further, it is also preferable for enhancing rigidity of the reflective support, that a polyolefin layer be provided on the surface of the foregoing paper substrate opposite to the side of the photographic constituting layers, i.e., on the back surface of the paper substrate. In this case, it is preferable that the polyolefin layer on the back surface be polyethylene or polypropylene, the surface of which is matted, with the polypropylene being more preferable. The thickness of the polyolefin layer on the back surface is preferably in the range of 5 to 50 μm, more preferably in the range of 10 to 30 μm, and further the density thereof is preferably in the range of 0.7 to 1.1 g/ml. As to the reflective support for use in the present invention, preferable embodiments of the polyolefin layer to be provided on the paper substrate include those described in JP-A-10-333277, JP-A-10-333278, JP-A-11-52513, JP-A-11-65024, European Patent Nos. 0880065 and 0880066.

Further, it is preferred that the above-described water-proof resin layer contain a fluorescent whitening agent. Further, the fluorescent whitening agent may be dispersed and contained in a hydrophilic colloid layer, which is formed separately from the above layers in the light-sensitive material. Preferred fluorescent whitening agents which can be used, include benzoxazole-series, coumarin-series, and pyrazoline-series compounds. Further, fluorescent whitening agents of benzoxazolylnaphthalene-series and benzoxazolylstilbene-series are more preferably used. The amount of the fluorescent whitening agent to be used is not particularly limited, and preferably in the range of 1 to 100 mg/m$^2$. When a fluorescent whitening agent is mixed with a water-proof resin, a mixing ratio of the fluorescent whitening agent to be used in the water-proof resin is preferably in the range of 0.0005 to 3% by mass, and more preferably in the range of 0.001 to 0.5% by mass, to the resin.

Further, a transmissive type support or the foregoing reflective type support each having coated thereon a hydrophilic colloid layer containing a white pigment may be used as the reflective type support. Furthermore, a reflective type support having a mirror plate reflective metal surface or a secondary diffusion reflective metal surface may be employed as the reflective type support.

As the support for use in the light-sensitive material of the present invention, a support of the white polyester type, or a support provided with a white pigment-containing layer on the same side as the silver halide emulsion layer, may be adopted for display use. Further, it is preferable for improving sharpness that an antihalation layer be provided on the silver halide emulsion layer side or the reverse side of the support. In particular, it is preferable that the transmission density of support be adjusted to the range of 0.35 to 0.8 so that a display may be enjoyed by means of both transmitted and reflected rays of light.

In the light-sensitive material of the present invention, in order to improve, e.g., the sharpness of an image, a dye (particularly an oxonole-series dye) that can be discolored by processing, as described in European Patent No. 0,337,490 A2, pages 27 to 76, is preferably added to the hydrophilic colloid layer such that an optical reflection density at 680 nm in the light-sensitive material is 0.70 or more. It is also preferable to add 12% by mass or more (more preferably 14% by mass or more) of titanium oxide that is surface-treated with, for example, dihydric to tetrahydric alcohols (e.g., trimethylolethane) to a water-proof resin layer of the support.

The light-sensitive material of the present invention preferably contains, in the hydrophilic colloid layer, a dye (particularly oxonole dyes and cyanine dyes) that can be discolored by processing, as described in European Patent No. 0337490A2, pages 27 to 76, in order to prevent irradiation or halation or to enhance safelight safety, and the like. Further, a dye described in European Patent No. 0819977 may also be preferably used in the present invention. Among these water-soluble dyes, some deteriorate color separation or safelight safety when used in an increased amount. Preferable examples of the dye which can be used and which does not deteriorate color separation, include water-soluble dyes described in JP-A-5-127324, JP-A-5-127325 and JP-A-5-216185.

In the present invention, it is possible to use a colored layer which can be discolored during processing, in place of the water-soluble dye, or in combination with the water-soluble dye. The colored layer that can be discolored with a processing, to be used, may contact with an emulsion layer directly, or indirectly through an interlayer containing an agent for preventing color-mixing during processing, such as hydroquinone or gelatin. The colored layer is preferably provided as a lower layer (i.e. a layer closer to the support) with respect to the emulsion layer which develops the same primary color as the color of the colored layer. It is possible to provide colored layers independently, each corresponding to respective primary colors. Alternatively, only some layers selected from them may be provided. In addition, it is possible to provide a colored layer subjected to coloring so as to match a plurality of primary-color regions. About the optical reflection density of the colored layer, it is preferred that, at the wavelength which provides the highest optical density in a range of wavelengths used for exposure (a visible light region from 400 nm to 700 nm for an ordinary printer exposure, and the wavelength of the light generated from the light source in the case of scanning exposure), the optical density is 0.2 or more but 3.0 or less, more preferably 0.5 or more but 2.5 or less, and particularly preferably 0.8 or more but 2.0 or less.

The colored layer may be formed by a known method. For example, there are a method in which a dye in a state of a dispersion of solid fine particles is incorporated in a hydrophilic colloid layer, as described in JP-A-2-282244, from page 3, upper right column to page 8, and JP-A-3-7931, from page 3, upper right column to page 11, left under column; a method in which an anionic dye is mordanted in a cationic polymer; a method in which a dye is adsorbed onto fine grains of silver halide or the like and fixed in the layer; and a method in which a colloidal silver is used, as described in JP-A-1-239544. As to a method of dispersing fine-powder of a dye in solid state, for example, JP-A-2-308244, pages 4 to 13, describes a method in which fine particles of dye which is at least substantially water-insoluble at the pH of 6 or less, but at least substantially water-soluble at the pH of 8 or more, are incorporated. The method of mordanting anionic dyes in a cationic polymer is described, for example, in JP-A-2-84637, pages 18 to 26. U.S. Pat. Nos. 2,688,601 and 3,459,563 disclose a method of preparing colloidal silver for use as a light absorber. Among these methods, preferred are the method of incorporating fine particles of dye and the method of using colloidal silver.

The silver halide photographic materials of the invention can be used as color negative films, color positive films, color reversal films, color reversal photographic papers, color photographic papers, display photosensitive materials, digital color proofs, motion picture color positives or motion picture color negatives. Of these photosensitive materials, display photosensitive materials, digital color proofs, motion picture color positives, color reversal photographic papers and color photographic papers are preferred over the others as uses of the present silver halide photographic materials, and the use as color photographic papers is particularly preferable. The color photographic paper, as mentioned above, preferably includes at least one yellow-color-forming blue-sensitive silver halide emulsion layer, at least one magenta-color-forming green-sensitive silver halide emulsion layer, and at least one cyan-color-forming red-sensitive silver halide emulsion layer. In general the arranging order of these silver halide emulsion layers in the direction that goes away from a support is a yellow-color-forming blue-sensitive silver halide emulsion layer, a magenta-color-forming green-sensitive silver halide emulsion layer, and a cyan-color-forming red-sensitive silver halide emulsion layer.

However, other layer arrangements which are different from the above, may be adopted.

In the present invention, a blue-sensitive silver halide emulsion layer (i.e. a yellow coupler-containing silver halide emulsion layer) may be provided at any position on a support. In the case where silver halide tabular grains are contained in the blue-sensitive silver halide emulsion layer, it is preferable that the blue-sensitive silver halide emulsion layer be positioned more apart from a support than at least one of a green-sensitive silver halide emulsion layer (i.e. a magenta-coupler-containing silver halide emulsion layer) and a red-sensitive silver halide emulsion layer (i.e. a cyan-coupler-containing silver halide emulsion layer). Further, it is preferable that the blue-sensitive silver halide emulsion layer be positioned most apart from a support than other silver halide emulsion layers, from the viewpoint of color-development acceleration, desilvering acceleration, and reducing residual color due to a sensitizing dye. Further, it is preferable that the red-sensitive silver halide emulsion layer be disposed in the middle of the other silver halide emulsion layers, from the viewpoint of reducing blix fading. On the other hand, it is preferable that the red-sensitive silver halide emulsion layer be the lowest layer, from the viewpoint of reducing light fading. Further, each of the yellow-color-formihg layer, the magenta-color-forming layer, and the cyan-color-forming layer may be composed of two or three layers. It is also preferable that a color-forming layer be formed by providing a silver-halide-emulsion-free layer containing a coupler in adjacent to a silver halide emulsion layer, as described in, for example, JP-A-4-75055, JP-A-9-114035, JP-A-10-246940, and U.S. Pat. No. 5,576,159.

Preferred examples of silver halide emulsions and other materials (additives or the like) that can be used in the present invention, photographic constituting layers (arrangement of the layers or the like), and processing methods for processing the photographic materials and additives for processing, are disclosed in JP-A-62-215272, JP-A-2-33144, and European Patent No. 0355660 A2. Particularly, those disclosed in European Patent No. 0355660 A2 are preferably used. Further, it is also preferred to use silver halide color photographic light-sensitive materials and processing methods thereof disclosed in, for example, JP-A-5-34889, JP-A-4-359249, JP-A-4-313753, JP-A-4-270344, JP-A-5-66527, JP-A-4-34548, JP-A-4-145433, JP-A-2-854, JP-A-1-158431, JP-A-2-90145, JP-A-3-194539, JP-A-2-93641, and European Patent Publication No. 0520457 A2.

In particular, as the above-described reflective support and silver halide emulsion, as well as the different kinds of metal ions to be doped in the silver halide grains, the storage stabilizers or antifogging agents of the silver halide emulsion, the methods of chemical sensitization (sensitizers), the methods of spectral sensitization (spectral sensitizers), the cyan, magenta, and yellow couplers and the emulsifying and dispersing methods thereof, the dye-image-stability-improving agents (stain inhibitors and discoloration inhibitors), the dyes (coloring layers), the kinds of gelatin, the layer structure of the light-sensitive material, and the film pH of the light-sensitive material, those described in the patent publications as shown in the following Table 1 are particularly preferably used in the present invention.

TABLE 1

| Element | JP-A-7-104448 | JP-A-7-77775 | JP-A-7-301895 |
|---|---|---|---|
| Reflective type supports | Column 7, line 12 to Column 12, line 19 | Column 35, line 43 to Column 44, line 1 | Column 5, line 40 to Column 9, line 26 |
| Silver halide emulsions | Column 72, line 29 to Column 74, line 18 | Column 44, line 36 to Column 46, line 29 | Column 77, line 48 to Column 80, line 28 |
| Different metal ion species | Column 74, lines 19 to 44 | Column 46, line 30 to Column 47, line 5 | Column 80, line 29 to Column 81, line 6 |
| Storage stabilizers or antifoggants | Column 75, lines 9 to 18 | Column 47, lines 20 to 29 | Column 18, line 11 to Column 31, line 37 (Especially, mercaptoheterocyclic compounds) |
| Chemical sensitizing methods (Chemical sensitizers) | Column 74, line 45 to Column 75, line 6 | Column 47, lines 7 to 17 | Column 81, lines 9 to 17 |
| Spectral sensitizing methods (Spectral sensitizers) | Column 75, line 19 to Column 76, line 45 | Column 47, line 30 to Column 49, line 6 | Column 81, line 21 to Column 82, line 48 |
| Cyan couplers | Column 12, line 20 to Column 39, line 49 | Column 62, line 50 to Column 63, line 16 | Column 88, line 49 to Column 89, line 16 |
| Yellow couplers | Column 87, line 40 to Column 88, line 3 | Column 63, lines 17 to 30 | Column 89, lines 17 to 30 |
| Magenta couplers | Column 88, lines 4 to 18 | Column 63, line 3 to Column 64, line 11 | Column 31, line 34 to Column 77, line 44 and column 88, lines 32 to 46 |
| Emulsifying and dispersing methods of couplers | Column 71, line 3 to Column 72, line 11 | Column 61, lines 36 to 49 | Column 87, lines 35 to 48 |
| Dye-image-preservability improving agents (antistaining agents) | Column 39, line 50 to Column 70, line 9 | Column 61, line 50 to Column 62, line 49 | Column 87, line 49 to Column 88, line 48 |
| Anti-fading agents | Column 70, line 10 to Column 71, line 2 | | |
| Dyes (coloring agents) | Column 77, line 42 to Column 78, line 41 | Column 7, line 14 to Column 19, line 42, and Column 50, line 3 to Column 51, line 14 | Column 9, line 27 to Column 18, line 10 |
| Gelatins | Column 78, lines 42 to 48 | Column 51, lines 15 to 20 | Column 83, lines 13 to 19 |
| Layer construction of light-sensitive materials | Column 39, lines 11 to 26 | Column 44, lines 2 to 35 | Column 31, line 38 to Column 32, line 33 |
| Film pH of light-sensitive materials | Column 72, lines 12 to 28 | | |
| Scanning exposure | Column 76, line 6 to Column 77, line 41 | Column 49, line 7 to Column 50, line 2 | Column 82, line 49 to Column 83, line 12 |
| Preservatives in developer | Column 88, line 19 to Column 89, line 22 | | |

As cyan, magenta, and yellow couplers which can be used in the present invention other than the above mentioned ones, those disclosed in JP-A-62-215272, page 91, right upper column, line 4 to page 121, left upper column, line 6, JP-A-2-33144, page 3, right upper column, line 14 to page 18, left upper column, bottom line, and page 30, right upper column, line 6 to page 35, right under column, line 11, European Patent No. 0355,660 (A2), page 4, lines 15 to 27, page 5, line 30 to page 28, bottom line, page 45, lines 29 to 31, page 47, line 23 to page 63, line 50, are also advantageously used.

Further, it is preferred for the present invention to add compounds represented by formula (II) or (III) in WO 98/33760 and compounds represented by formula (D) described in JP-A-10-221825.

As the cyan dye-forming coupler (hereinafter also simply referred to as "cyan coupler") which can be used in the present invention, pyrrolotriazole-series couplers are preferably used, and more specifically, couplers represented by formula (1) or (II) in JP-A-5-313324, and couplers represented by formula (I) in JP-A-6-347960 are preferred. Exemplified couplers described in these publications are particularly preferred. Further, phenol-series or naphthol-series cyan couplers are also preferred. For example, cyan couplers represented by formula (ADF) described in JP-A-10-333297 are preferred. Preferable examples of cyan couplers other than the foregoing cyan couplers, include pyrroloazole-type cyan couplers described in European Patent Nos. 0 488 248 and 0 491 197 (A1); 2,5-diacylamino phenol couplers described in U.S. Pat. No. 5,888,716; pyrazoloazole-type cyan couplers having an electron-withdrawing group or a group bonding via hydrogen bond at the 6-position, as described in U.S. Pat. Nos. 4,873,183 and 4,916,051; and particularly, pyrazoloazole-type cyan couplers having a carbamoyl group at the 6-position, as described in JP-A-8-171185, JP-A-8-311360, and JP-A-8-339060.

Further, as a cyan coupler, use can also be made of a diphenyliridazole-series cyan coupler described in JP-A-2-33144; as well as a 3-hydroxypyridine-series cyan coupler (particularly a 2-equivalent coupler formed by allowing a 4-equivalent coupler of a coupler (42), to have a chlorine splitting-off group; and couplers (6) and (9), enumerated as specific examples are particularly preferable) described in European patent 0333185 A2; a cyclic active methylene-series cyan coupler (particularly couplers 3, 8, and 34 enumerated as specific examples are particularly preferable) described in JP-A-64-32260; a pyrrolopyrozole-type cyan coupler described in European Patent No. 0456226 A1; and a pyrroloimidazole-type cyan coupler described in European Patent No. 0484909.

Among these cyan couplers, pyrroloazole-series cyan couplers represented by formula (I) described in JP-A-11-282138 are particularly preferred. The descriptions of the paragraph Nos. 0012 to 0059 including exemplified cyan couplers (1) to (47) of the above JP-A-11-282138 can be entirely applied to the present invention, and therefore they are preferably incorporated herein by reference as a part of the present specification.

The magenta dye-forming couplers (which may be referred to simply as "magenta coupler" hereinafter) that can be used in the present invention can be 5-pyrazolone-series magenta couplers and pyrazoloazole-series magenta couplers, such as those described in the above-mentioned patent publications in the above table. Among these, preferred are pyrazolotriazole couplers in which a secondary or tertiary alkyl group is directly bonded to the 2-, 3-, or 6-position of the pyrazolotriazole ring, such as those described in JP-A-61-65245; pyrazoloazole couplers having a sulfonamido group in its molecule, such as those described in JP-A-61-65246; pyrazoloazole couplers having an alkoxyphenylsulfonamido ballasting group, such as those described in JP-A-61-147254; and pyrazoloazole couplers having an alkoxy or aryloxy group at the 6-position, such as those described in European Patent Nos. 226849 A and 294785 A, in view of hue and stability of an image to be formed therefrom, and color-forming property of the couplers. Particularly, as the magenta coupler, pyrazoloazole couplers represented by formula (M-I) described in JP-A-8-122984 are preferred The descriptions of paragraph Nos. 0009 to 0026 of the patent publication JP-A-8-122984 can be entirely applied to the present invention, and therefore are incorporated herein by reference as a part of the present specification. In addition, pyrazoloazole couplers having a steric hindrance group at both the 3- and 6-positions, as described in European Patent Nos. 854384 and 884640, can also be preferably used.

Further, as yellow dye-forming couplers (which may be referred to simply as "yellow coupler" herein), preferably use can be made, in the present invention, of acylacetamide-type yellow couplers in which the acyl group has a 3-membered to 5-membered ring structure, such as those described in European Patent No. 0447969 A1; malondianilide-type yellow couplers having a ring structure, as described in European Patent No. 0482552 A1; pyrrol-2 or 3-yl or indol-2 or 3-yl carbonyl acetanilide-series couplers, as described in European Patent (laid open to public) Nos. 953870 A1, 953871 A1, 953872 A1, 953873 A1, 953874 A1, and 953875 A1; acylacetamide-type yellow couplers having a dioxane structure, such as those described in U.S. Pat. No. 5,118,599; acetanilide-type yellow couplers wherein the acyl group is substituted by a hetero ring, such as those described in JP-A-2003-173007, other than the compounds described in the above-mentioned table. Of these couplers, the acylacetamide-type yellow couplers whose acyl groups are 1-alkylcyclopropane-1-carbonyl groups, the malondianilide-type yellow couplers wherein either anilide forms an indoline ring, the acetanilide-type yellow couplers wherein the acyl group is substituted by a hetero ring are used to advantage. These couplers may be used singly or in combination.

It is preferred that couplers for use in the present invention, are pregnated into a loadable latex polymer (as described, for example, in U.S. Pat. No. 4,203,716) in the presence (or absence) of the high-boiling-point organic solvent described in the foregoing table, or they are dissolved in the presence (or absence) of the foregoing high-boiling-point organic solvent with a polymer insoluble in water but soluble in an organic solvent, and then emulsified and dispersed into an aqueous hydrophilic colloid solution. Examples of the water-insoluble but organic-solvent-soluble polymer which can be preferably used, include the homopolymers and co-polymers as disclosed in U.S. Pat. No. 4,857,449, from column 7 to column 15, and WO 88/00723, from page 12 to page 30. The use of methacrylate-series or acrylamide-series polymers, especially acrylamide-series polymers are more preferable, in view of color-image stabilization and the like.

In the present invention, known color mixing-inhibitors may be used. Among these compounds, those described in the following patent publications are preferred.

For example, high molecular weight redox compounds described in JP-A-5-333501; phenidone- or hydrazine-series compounds as described in, for example, WO 98/33760 and U.S. Pat. No. 4,923,787; and white couplers as described in, for example, JP-A-5-249637, JP-A-10-282615, and German Patent No. 19629142 A1, may be used. Particularly, in order to accelerate developing speed by increasing the pH of a developing solution, redox compounds described in for example, German Patent No. 19,618,786 A1, European Patent Nos. 839,623 A1 and 842,975 A1, German Patent No. 19,806,846 A1 and French Patent No. 2,760,460 A1, are also preferably used.

In the present invention, as an ultraviolet ray absorbent, it is preferred to use compounds having a high molar extinction coefficient and a triazine skeleton. For example, compounds described in the following patent publications can be used. These compounds are preferably added to the light-sensitive layer or/and the light-insensitive layer. For example, use can be made of those described, in JP-A46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, German Patent No. 19,739,797A, European Patent No. 0,711,804 A and JP-T-8-501291 ("JP-T" means searched and published International patent application), and the like.

As the binder or protective colloid which can be used in the light-sensitive material of the present invention, gelatin is used advantageously, but another hydrophilic colloid can be used singly or in combination with gelatin. It is preferable for the gelatin that the content of heavy metals, such as Fe, Cu Zn, and M, included as impurities, be reduced to 5 ppm or below, more preferably 3 ppm or below. Further, the amount of calcium contained in the light-sensitive material is preferably 20 mg/$r^2$ or less, more preferably 10 mg/$m^2$ or less, and most preferably 5 mg/$m^2$ or less.

In the present invention, it is preferred to add an antibacterial (fungi-preventing) agent and antimold agent, as described in JP-A-63-271247, in order to destroy various kinds of molds and bacteria which propagate in a hydrophilic colloid layer and deteriorate the image. Further, the film pH of the light-sensitive material is preferably in the range of 4.0 to 7.0, more preferably in the range of 4.0 to 6.5.

As to the photographic constituent layers of the photographic material according to the second embodiment of the present invention, the total coating amount of gelatin is preferably from 3 g/$m^2$ to 6 g/$m^2$, more preferably from 3 g/$m^2$ to 5 g/$m^2$. In order to ensure satisfactory development progress, fixation-bleach properties, and residual color, even when super-rapid processing is carried out, the total thickness of the photographic constituent layers is preferably from 3 μm to 7.5 atm, more preferably from 3 μm to 6.5 μm. Evaluation of dried film thickness can be made by measuring a difference in film thickness between before and after delamination of the dried film or by observing the film profile under an optical microscope or an electron microscope. In the second embodiment of the present invention, for achievement of both expeditious progress of development and increase in drying speed, it is preferable that the swollen film thickness be from 8 μm to 19 μm, more preferably 9 μm to 18 μm. The swollen film thickness can be measured by application of a dotting method to a photosensitive material brought into a condition of swelling equilibrium by immersing the dried photosensitive material in a 35° C. aqueous solution. In the second embodiment of the present invention, the coating amount of silver is preferably from 0.2 g/m$^2$ to 0.5 g/m$^2$, more preferably from 0.2 g/m$^2$ to 0.45 g/m$^2$, particularly preferably from 0.2 g/m$^2$ to 0.40 g/m$^2$.

In the present invention, a surfactant may be added to the light-sensitive material, in view of improvement in coating-stability, prevention of static electricity from being occurred, and adjustment of the charge amount. As the surfactant, mention can be made of anionic, cationic, betaine, and nonionic surfactants. Examples thereof include those described in JP-A-5-333492. As the surfactant that can be used in the present invention, a fluorine-containing surfactant is particularly preferred. The fluorine-containing surfactant may be used singly, or in combination with known other surfactant. The fluorine-containing surfactant is preferably used in combination with known other surfactant. The amount of the surfactant to be added to the light-sensitive material is not particularly limited, but it is generally in the range of $1\times10^{-5}$ to 1 g/m$^2$, preferably in the range of $1\times10^{-4}$ to $1\times10^{-1}$ g/m$^2$, and more preferably in the range of $1\times10^{-3}$ to $1\times10^{-2}$ g/m$^2$.

The photosensitive material of the present invention can form an image, via an exposure step in which the photosensitive material is irradiated with light according to image information, and a development step in which the photosensitive material irradiated with light is developed.

The light-sensitive material of the present invention can preferably be used, in a scanning exposure system using a cathode ray tube (CRT), in addition to the printing system using a usual negative printer. The cathode ray tube exposure apparatus is simpler and more compact, and therefore less expensive than an apparatus using a laser. Further, optical axis and color (hue) can easily be adjusted. In a cathode ray tube which is used for image-wise exposure, various light-emitting materials which emit a light in the spectral region, are used as occasion demands. For example, any one of red-light-emitting materials, green-light-emitting materials, blue-light-emitting materials, or a mixture of two or more of these light-emitting materials may be used. The spectral regions are not limited to the above red, green, and blue, and fluorophoroes which can emit a light in a region of yellow, orange, purple, or infiared can also be used. Particularly, a cathode ray tube which emits a white light by means of a mixture of these light-emitting materials, is often used.

In the case where the light-sensitive material has a plurality of light-sensitive layers each having different spectral sensitivity distribution from each other, and also the cathode ray tube has a fluorescent substance which emits light in a plurality of spectral regions, exposure to a plurality of colors may be carried out at the same time. Namely, a plurality of color image signals may be input into a cathode ray tube, to allow light to be emitted from the surface of the tube. Alternatively, a method in which an image signal of each of colors is successively input and light of each of colors is emitted in order, and then exposure is carried out through a film capable of cutting colors other than the emitted color, i.e., an area (or surface) sequential exposure, may be used. Generally, among these methods, the area sequential exposure is preferred from the viewpoint of high image quality enhancement, because a cathode ray tube having a high resolving power can be used.

The light-sensitive material of the present invention can preferably be used in the digital scanning exposure system using monochromatic high density light, such as a gas laser, a light-emitting diode, a semiconductor laser, a second harmonic generation light source (SHG) comprising a combination of nonlinear optical crystal with a semiconductor laser or a solid state laser using a semiconductor laser as an excitation light source. It is preferred to use a semiconductor laser, or a second harmonic generation light source (SHG) comprising a combination of nonlinear optical crystal with a solid state laser or a semiconductor laser, to make a system more compact and inexpensive. In particular, to design a compact and inexpensive apparatus having a longer duration of life and high stability, use of a semiconductor laser is preferable; and it is preferred that at least one of exposure light sources be a semiconductor laser.

When the present invention is applied to silver halide color photographic materials, it is preferable to perform image-wise exposure using coherent light of blue lasers with emission wavelengths of 420 nm to 460 nm. Of the blue lasers, blue semiconductor lasers are used to particular advantage.

Specific examples of the laser light source that can be preferably used, include a blue-light semiconductor laser having a wavelength of 430 to 450 nm (Presentation by Nichia Corporation at the 48th Applied Physics Related Joint Meeting, in March of 2001); a blue laser at about 470 nm obtained by wavelength modulation of a semiconductor laser (oscillation wavelength about 940 nm) with a SHG crystal of $LiNbO_3$ having a reversed domain structure in the form of a wave guide; a green-light laser at about 530 nm obtained by wavelength modulation of a semiconductor laser (oscillation wavelength about 1,060 nm) with SHG crystal of $LiNbO_3$ having a reversed domain structure in the form of a wave guide; a red-light semiconductor laser of the wavelength at about 685 nm (Type No. HL6738MG (trade name) manufactured by Hitachi, Ltd.); and a red-light semiconductor laser of the wavelength at about 650 nm (Type No. HL6501MG (trade name) manufactured by Hitachi, Ltd.).

When such a scanning exposure light source is used, the maximum spectral sensitivity wavelength of the light-sensitive material of the present invention can be arbitrarily set up in accordance with the wavelength of a scanning exposure light source to be used. Since oscillation wavelength of a laser can be made half, using a SHG light source obtainable by a combination of a nonlinear optical crystal with a semiconductor laser or a solid state laser using a semiconductor as an excitation light source, blue light and green light can be obtained. Accordingly, it is possible to have the spectral sensitivity maximum of a light-sensitive material in usual three wavelength regions of blue, green, and red. In the first embodiment of the present invention, the exposure time in such a scanning exposure is defined as the time period necessary to expose the size of the picture element (pixel) with the density of the picture element being 300 dpi, and a preferred exposure time is $1\times10^{-4}$ sec or less, more preferably $1\times10^{-6}$ sec or less. In the second embodiment of the present invention, the exposure time in such a scanning exposure is defined as the time period necessary to expose the size of the picture element (pixel) with the density of the picture element being 400 dpi, and a preferred exposure time is $1\times10^{-4}$ sec or less, more preferably $1\times10^{-6}$ sec or less.

The silver halide color photosensitive material of the present invention is preferably used in combination with the exposure and development systems described in the following known literatures. Example of the development system include the automatic print and development system described in JP-A-10-333253, the photosensitive material conveying apparatus described in JP-A-2000-10206, a recording system including the image reading apparatus, as described in JP-A-11-215312, exposure systems with the color image recording method, as described in JP-A-11-88619 and JP-A-10-202950, a digital photo print system including the remote diagnosis method, as described in JP-A-10-210206, and a photo print system including the image recording apparatus, as described in JP-A-2000-310822.

The preferred scanning exposure methods which can be applied to the present invention are described in detail in the publications listed in the table shown above.

It is preferred to use a band stop filter, as described in U.S. Pat. No. 4,880,726, when the light-sensitive material of the present invention is subjected to exposure with a printer. Color mixing of light can be excluded and color reproducibility is remarkably improved by the above means.

In the present invention, a yellow microdot pattern may be previously formed by pre-exposure before giving an image information, to thereby perform a copy restraint, as described in European Patent Nos. 0789270 A1 and 0789480 A1.

In order to process the light-sensitive material of the present invention, processing materials and processing methods described in JP-A-2-207250, page 26, right lower column, line 1, to page 34, right upper column, line 9, and in JP-A-4-97355, page 5, left upper column, line 17, to page 18, right lower column, line 20, can be applied. Further, as the preservative for use in the developing solution, compounds described in the patent publications listed in the above table can be used.

The present invention can also be preferably applied to a light-sensitive material having rapid processing suitability. In the case of conducting rapid processing, the color-developing time is preferably 30 sec or less, more preferably 28 sec or less, further more preferably from 25 sec to 6 sec, and most preferably from 20 sec to 6 sec. Likewise, the blix time is preferably 30 sec or less, more preferably from 25 sec to 6 sec, and further preferably from 20 sec to 6 sec. Further, the washing or stabilizing time is preferably 60 sec or less, and more preferably from 40 sec to 6 sec.

Herein, the term "color-developing time" as used herein means a period of time required from the beginning of dipping a light-sensitive material into a color developing solution until the light-sensitive material is dipped into a blix solution in the subsequent processing step. For example, when a processing is carried out using an autoprocessor or the like, the color developing time is the sum total of a time in which a light-sensitive material has been dipped in a color developing solution (so-called "time in the solution") and a time in which the light-sensitive material has left the color developing solution and been conveyed in air toward a bleach-fixing bath in the step subsequent to color development (so-called "time in the air"). Likewise, the term "blix time" as used herein means a period of time required from the beginning of dipping a light-sensitive material into a blix solution until the light-sensitive material is dipped into a washing bath or a stabilizing bath in the subsequent processing step. Further, the term "washing or stabilizing time" as used herein means a period of time required from the beginning of dipping a light-sensitive material into a washing solution or a stabilizing solution until the end of the dipping toward a drying step (soalled "time in the solution").

For the light-sensitive materials of the present invention, the color-developing time is preferably adjusted to 20 seconds or below (more preferably from 6 to 20 seconds, especially preferably from 6 to 15 seconds). Herein, the expression "color-development processing with a color developing time of 20 seconds or below" means that the above-mentioned color-developing time is 20 seconds or below (and does not mean performing the whole processing steps for color development processing within such a time).

Examples of a development method after exposure, applicable to the light-sensitive material of the present invention, include a conventional wet method, such as a development method using a developing solution containing an alkali agent and a developing agent, and a development method wherein a developing agent is incorporated in the light-sensitive material and an activator solution, e.g., an alkaline solution free of developing agent is employed for the development, as well as a heat development method using no processing solution. In particular, the activator method is preferred over the other methods, because the processing solutions contain no developing agent, thereby it enables easy management and handling of the processing solutions and reduction in waste solution disposal or processing-related load to make for environmental preservation.

The preferable developing agents or their precursors incorporated in the light-sensitive materials in the case of adopting the activator method, include the hydrazine-type compounds described in, for example, JP-A-8-234388, JP-A-9-152686, JP-A-9-152693, JP-A-9-211814 and JP-A-9-160193.

Further, the processing method in which the light-sensitive material reduced in the amount of silver to be applied, undergoes the image amplification processing using hydrogen peroxide (intensification processing), can be employed preferably. In particular, it is preferable to apply this processing method to the activator method. Specifically, the image-forming methods utilizing an activator solution containing hydrogen peroxide, as disclosed in JP-A-8-297354 and JP-A-9-152695 can be preferably used. Although the processing with an activator solution is generally followed by a desilvering step in the activator method, the desilvering step can be omitted in the case of applying the image amplification processing method to photographic materials having a reduced silver amount. In such a case, washing or stabilization processing can follow the processing with an activator solution to result in simplification of the processing process. On the other hand, when the system of reading the image information from light-sensitive materials by means of a scanner or the like, is employed, the processing form requiring no desilvering step can be applied, even if the photographic materials are those having a high silver amount, such as photographic materials for shooting.

As the processing materials and processing methods of the activator solution, desilvering solution (bleach/fixing solution), washing solution and stabilizing solution, which can be used in the present invention, known ones can be used. Preferably, those described in *Research Disclosure*, Item 36544, pp. 536-541 (September 1994), and JP-A-8-234388 can be used in the present invention.

The present invention provides silver halide emulsions and silver halide photographic materials which are reduced in fog and have excellent gradation characteristics (especially hard gradation characteristics), high sensitivities and excellent rapid processing suitability. In addition, the present invention overcomes the problems of the related arts and provides silver halide photographic materials, especially suitable for color print materials, which can ensure high sensitivities and hard gradation and excellent latent-image stability even when undergo high-illumination digital exposure using laser scanning. Further, the silver halide photographic materials of the present invention are suitable for rapid processing and successful in achieving satisfactory latent-image stability and hard gradation, notably high sensitivity and hard gradation in the case of high-illumination exposure.

The present invention will be described in more detail based on the following examples, but the invention is not intended to be limited thereto.

EXAMPLE 1-1

(Preparation of Blue-Sensitive Layer Emulsion B-1)

Using a method of simultaneously adding silver nitrate and sodium chloride mixed into stirring deionized distilled water containing a deionized gelatin, high silver chloride cubic grains were prepared. In this preparation, at the step of from 80% to 90% addition of the entire silver nitrate amount, $K_4[Ru(CN)_6]$ was added. At the step of from 80% to 100% addition of the entire silver nitrate amount, potassium bromide (2 mol % per mol of the finished silver halide) was added. Further, $K_2[IrCl_6]$ and $K_2[RhBr_5(H_2O)]$ were added at the step of from 83% to 88% addition of the entire silver nitrate amount. Potassium iodide (0.1 mol % per mol of the finished silver halide) was added with a vigorous stirring, at the step of completion of 90% addition of the entire silver nitrate amount. $K_2[IrCl_5(H_2O)]$ and $K[IrCl_4(H_2O)_2]$ were added at the step of from 92% to 98% addition of the entire silver nitrate amount. The thus-obtained emulsion grains were monodisperse cubic silver iodobromochloride grains having a side length of 0.50 μm and a variation coefficient of 8.0%. After being subjected to a sedimentation desalting treatment, the following were added to the resulting emulsion: gelatin, Compounds Ab-1, Ab-2, and Ab-3, and calcium nitrate, and the emulsion was re-dispersed.

The re-dispersed emulsion was dissolved at 40° C., and Sensitizing dye S-1, Sensitizing dye S-2, and Sensitizing dye S-3 were added for optimal spectral sensitization. Then, the resulting emulsion was ripened by adding Compound I-22, dimethylthiourea as a sulfur sensitizer, sodium tetrachloroaurate as a gold sensitizer, for optimal chemical sensitization. Further, 1-(5-methyl ureidophenyl)-5-mercaptotetrazole; Compound-2; a mixture whose major components are compounds represented by Compound-3 in which the repeating unit (n) is 2 or 3 (both ends $X_1$ and $X_2$ are each a hydroxyl group); Compound-4, and potassium bromide were added, to finalize chemical sensitization. The thus-obtained emulsion was referred to as Emulsion B-1.

(Ab-1) Antiseptic

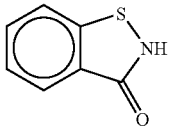

(Ab-2) Antiseptic

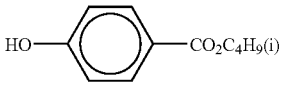

-continued (Ab-3) Antiseptic

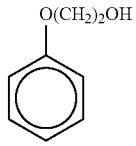

(Ab-4) Antiseptic

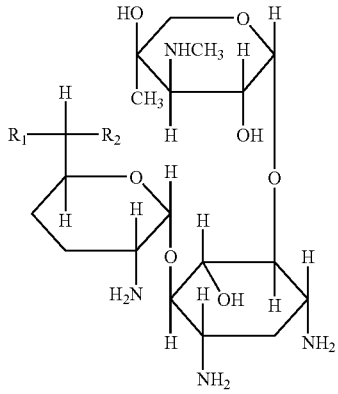

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

A mixture in 1:1:1:1 of a, b, c, and d

Sensitizing dye S-1

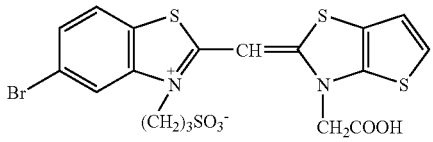

Sensitizing dye S-2

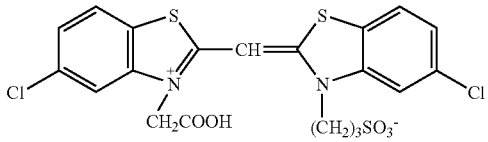

Sensitizing dye S-3

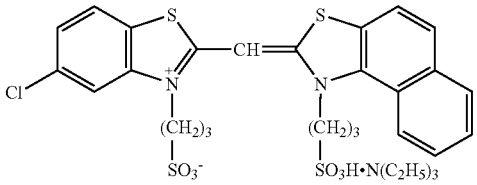

Compound-1

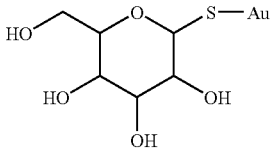

-continued

Compound-2

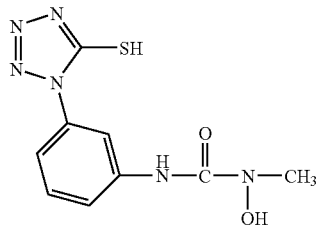

Compound-3

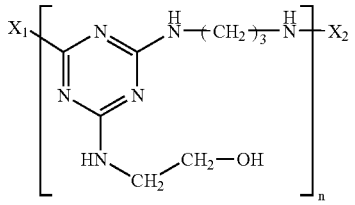

Compound-4

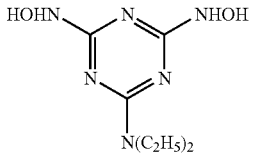

(Preparation of Emulsion B-2)

Emulsion grains were prepared in the same manner as in the preparation of Emulsion B-1, except that the temperature and the addition rate at the step of mixing the silver nitrate and sodium chloride by simultaneous addition were changed, and the amounts of respective metal complexes that were to be added during the addition of silver nitrate and sodium chloride were changed. The thus-obtained emulsion grains were monodisperse cubic silver iodobromochloride grains having a side length of 0.40 μm and a variation coefficient of 9.0%. After reispersion of this emulsion, Emulsion B-2 was prepared in the same manner as Emulsion B-1, except that the amounts of the compounds to be added in the preparation of B-1 were changed.

(Preparation of Emulsion B-3)

An emulsion was prepared in the same manner as Emulsion B-2, except that a selenium compound (SE3-9) was added in an amount of $6\times10^{-6}$ mole per mole of silver halide in place of dimethylthiourea as a sulfur sensitizer, and this emulsion was referred to as Emulsion B-3.

(Preparation of Emulsion B-4)

An emulsion was prepared in the same manner as Emulsion B-2, except that Compound 1-22 and Compound II-8 were added in place of Compound I-22, and this emulsion was referred to as Emulsion B-4.

(Preparation of Emulsion B-5)

An emulsion was prepared in the same manner as Emulsion B-2, except that Compound 1-22 and Compound II-8 were added in place of Compound I-22 and a selenium compound (SE3-9) was added in an amount of $6\times10^{-6}$ mole per mole of silver halide in place of dimethylthiourea as a sulfur sensitizer, and this emulsion was referred to as Emulsion B-5.

(Preparation of Emulsion B-6)

An emulsion was prepared in the same manner as Emulsion B-5, except that Compound 111-1 was added in place of Compound II-8, and this emulsion was referred to as Emulsion B-6.

(Preparation of Emulsion B-7)

An emulsion was prepared in the same manner as Emulsion B-5, except that inorganic sulfuer was added in place of Compound 1-22, and this emulsion was referred to as Emulsion B-7.

(Preparation of Emulsion B-8)

An emulsion was prepared in the same manner as Emulsion B-5, except that sodium p-toluenesulfinate was added in place of Compound II-8, and this emulsion was referred to as Emulsion B-8.

(Preparation of Emulsion B-9)

An emulsion was prepared in the same manner as Emulsion B-5, except that a selenium compound (SE3-29) was added in place of the selenium compound (SE3-9), and this emulsion was referred to as Emulsion B-9.

(Preparation of Green-Sensitive Layer Emulsion G-1)

Using a method of simultaneously adding silver nitrate and sodium chloride mixed into stirring deionized distilled water containing a deionized gelatin, high silver chloride cubic grains were prepared. In this preparation, at the step of from 80% to 90% addition of the entire silver nitrate amount, $K_4[Ru(CN)_6]$ was added. At the step of from 80% to 100% addition of the entire silver nitrate amount, potassium bromide (2 mol % per mol of the finished silver halide) was added. Further, $K_2[IrCl_6]$ and $K_2[RhBr_5(H_2O)]$ were added at the step of from 83% to 88% addition of the entire silver nitrate amount. Potassium iodide (0.1 mol % per mol of the finished silver halide) was added with a vigorous stirring, at the step of completion of 90% addition of the entire silver nitrate amount. $K_2[IrCl_5(H_2O)]$ and $K[IrCl_4(H_2O)_2]$ were added at the step of from 92% to 98% addition of the entire silver nitrate amount The thus-obtained emulsion grains were monodisperse cubic silver iodobromochloride grains having a side length of 0.42 μm and a variation coefficient of 8.0%. The resulting emulsion was subjected to a sedimentation desalting treatment and re-dispersing treatment in the same manner as described in the above.

The redispersed emulsion was dissolved at 40° C., and Compound 1-22, sodium thiosulfate pentahydrate as a sulfur sensitizer, and (bis(1,4,5-trimethyl-1,2,4-triazolium-3-thiolate)aurate(I) tetrafluoroborate) as a gold sensitizer, were added, and the emulsion was ripened for optimal chemical sensitization. Thereafter, 1-(3-acetamidophenyl)-5-mercaptotetrazole, 1-(5-methylureidophenyl)-5-mercaptotetrazole, Compound-2, Compound-4, and potassium bromide were added. Further, in a midway of the emulsion preparation step, Sensitizing dye S-4, Sensitizing dye S-5, Sensitizing dye S-6, and Sensitizing dye S-7 were added as sensitizing dyes, to conduct spectral sensitization. The thus-obtained emulsion was referred to as Emulsion G-1.

Sensitizing dye S-4

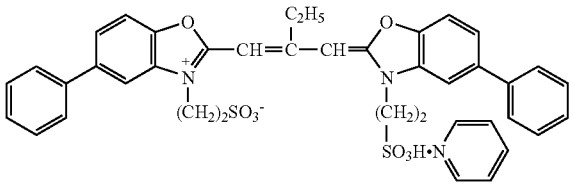

Sensitizing dye S-5

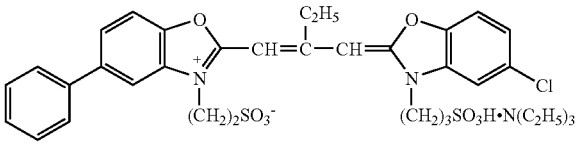

Sensitizing dye S-6

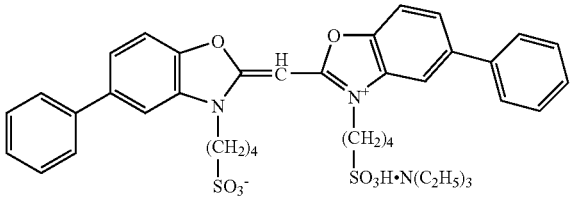

Sensitizing dye S-7

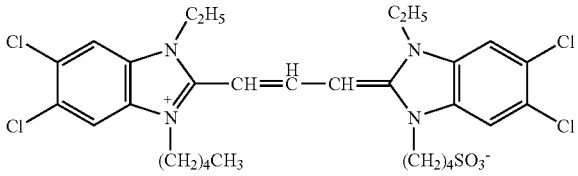

(Preparation of Red-Sensitive Layer Emulsion R-1)

Using a method of simultaneously adding silver nitrate and sodium chloride mixed into stirring deionized distilled water containing deionized gelatin, high silver chloride cubic grains were prepared. In this preparation, at the step of from 60% to 80% addition of the entire silver nitrate amount, $Cs_2[OsCl_5(NO)]$ was added. At the step of from 80% to 90% addition of the entire silver nitrate amount, $K_4[Ru(CN)_6]$ was added. At the step of from 80% to 100% addition of the entire silver nitrate amount, potassium bromide (1.3 mol % per mol of the finished silver halide) was added. Further, $K_2[IrCl_5(5\text{-methylthiazole})]$ was added at the step of from 83% to 88% addition of the entire silver nitrate amount Potassium iodide (0.05 mol % per mol of the finished silver halide) was added, with vigorous stirring, at the step of completion of 88% addition of the entire silver nitrate amount. Further, $K_2[IrCl_5(H_2O)]$ and $K[IrCl_4(H_2O)_2]$ were added at the step of from 92% to 98% addition of the entire silver nitrate amount. The thus-obtained emulsion grains were monodisperse cubic silver iodobromochloride grains having a side length of 0.39 μm and a variation coefficient of 10%. The resulting emulsion was subjected to a sedimentation desalting treatment and re-dispersing treatment in the same manner as described in the above.

The re-dispersed emulsion was dissolved at 40° C., and Sensitizing dye S-8, Compound-5, triethylthiourea as a sulfur sensitizer, and Compound-I as a gold sensitizer were added, and the emulsion was ripened for optimal chemical sensitization. Thereafter, 1-(3-acetamidophenyl)-5-mercaptotetrazole, 1-(5-methylureidophenyl)-5-mercaptotetrazole, Compound-2, Compound-4, and potassium bromide were added. The thus-obtained emulsion was referred to as Emulsion R-1.

Sensitizing dye S-8

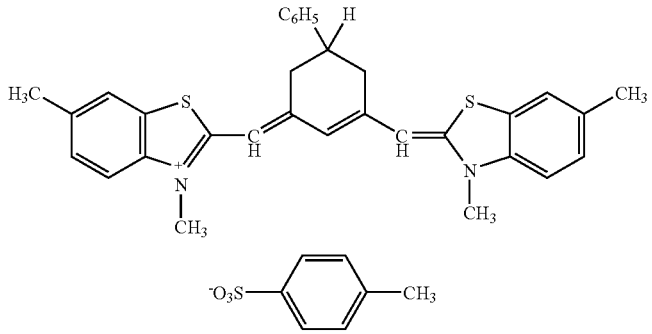

-continued

Compound - 5

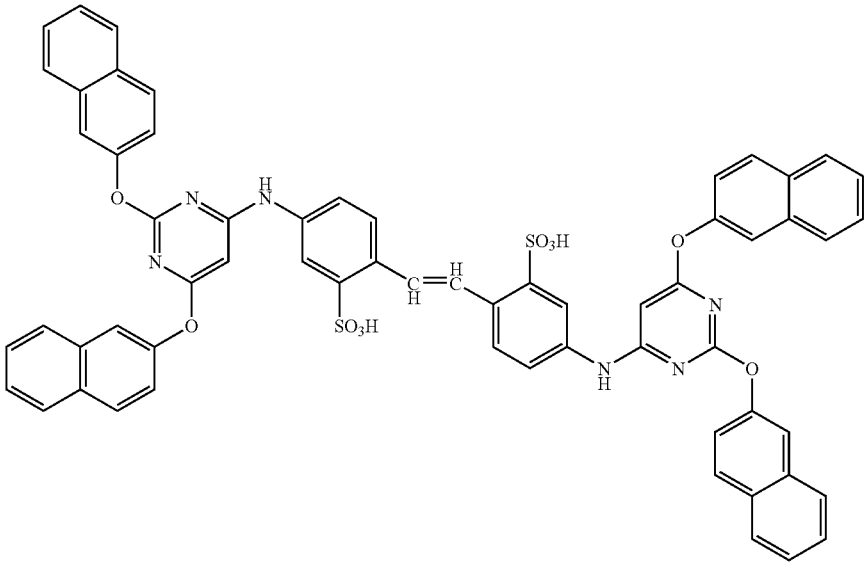

(H-1) Hardener

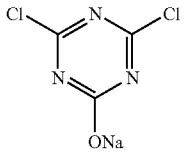

(H-2) Hardener

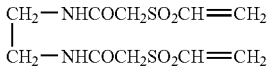

(H-3) Hardener

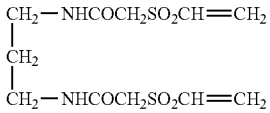

(Preparation of a Coating Solution for the First Layer)

Into 23 g of a solvent (Solv-4), 4 g of a solvent (Solv-6), 23 g of a solvent (Solv-9) and 60 ml of ethyl acetate were dissolved 34 g of a yellow coupler (Ex-Y), 1 g of a color-image stabilizer (Cpd-1), 1 g a color-image stabilizer (Cpd-2), 8 g of a color-image stabilizer (Cpd-8), and 1 g of a color-image stabilizer (Cpd-18), 2 g of a color-image stabilizer (Cpd-19), 15 g of a color-image stabilizer (Cpd-20), 1 g of a color-image stabilizer (Cpd-21), 15 g of a color-image stabilizer (Cpd-23), 0.1 g of an additive (ExC-1), and 1 g of a color-image stabilizer (UV-A). This solution was emulsified and dispersed in 270 g of a 20 mass % aqueous gelatin solution containing 4 g of sodium dodecylbenzenesulfonate with a high-speed stirring emulsifier (dissolver). Water was added thereto, to prepare 900 g of Emulsified dispersion A.

On the other hand, the above Emulsified dispersion A and the prescribed Emulsions B-1 were mixed and dissolved, and the first-layer coating solution was prepared so that it would have the composition shown below. The coating amount of the emulsion is in terms of silver.

The coating solutions for the second layer to the seventh layer were prepared in the similar manner as that for the first-layer coating solution. As a gelatin hardener for each layer, (H-1), (H-2), and (H-3) were used. Further, to each layer, were added Ab-1, Ab-2, Ab-3, and Ab-4, so that the total amounts would be 14.0 mg/m$^2$, 62.0 mg/m$^2$, 5.0 mgtm$^2$, and 10.0 mg/m$^2$, respectively.

Further, to the second layer, the fourth layer, and the sixth layer, was added 1-(3-methylureidophenyl)-5-mercaptotetrazole in amounts of 0.2 mg/m$^2$, 0.2 mg/m$^2$, and 0.6 mgIm$^2$, respectively. Further, to the blue-sensitive emulsion layer and the green-sensitive emulsion layer, was added 4-hydroxy-6-methyl-1,3,3a,7-tetmzaindene in amounts of $1\times10^{-4}$ mol and $2\times10^{-4}$ mol, respectively, per mol of the silver halide. Further, to the red-sensitive emulsion layer, was added a copolymer latex of methacrylic acid and butyl acrylate (1:1 in mass ratio; average molecular weight, 200,000 to 400,000) in an amount of 0.05 g/m$^2$. Disodium salt of catecol-3,5-disulfonic acid was added to the second layer, the fourth layer, and the sixth layer so that coating amounts would be 6 mg/m$^2$, 6 mg/m$^2$, and 18 mg/m$^2$, respectively. Further, to each layer, sodium polystyrene sulfonate was added to adjust viscosity of the coating solutions, if necessary. Further, in order to prevent irradiation, the following dyes (coating amounts are shown in parentheses) were added.

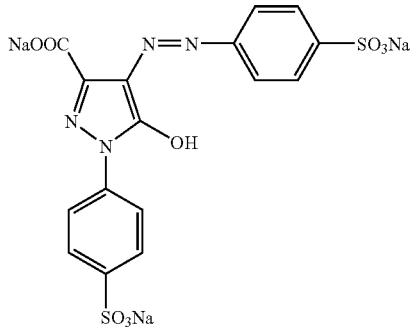

(2 mg/m$^2$)

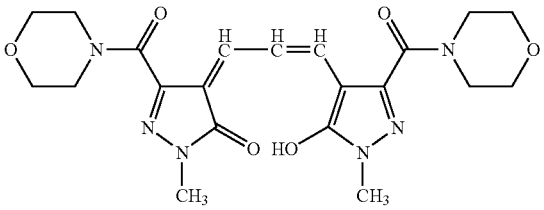

(3 mg/m$^2$)

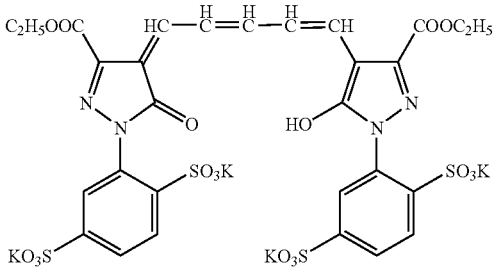

(10 mg/m$^2$)

-continued

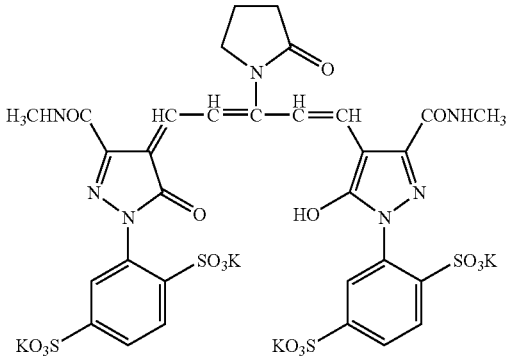

(16 mg/m$^2$)

(Layer Constitution)

The composition of each layer is shown below. The numbers show coating amounts (g/m$^2$). In the case of the silver halide emulsion, the coating amount is in terms of silver.

Support

Polyethylene resin laminated paper {The polyethylene resin on the first layer side contained white pigments ($TiO_2$, content of 16 mass %; ZnO, content of 4 mass %), a fluorescent whitening agent (4,4'-bis(5-methylbenzoxazolyl)stilbene, content of 0.03 mass %) and a bluish dye (ultramarine, content of 0.33 mass %); and the amount of the polyethylene resin was 29.2 g/m$^2$.}

| First layer (Blue-sensitive emulsion layer) | |
|---|---|
| Emulsion (B-1) | 0.16 |
| Gelatin | 1.32 |
| Yellow coupler (Ex-Y) | 0.34 |
| Color-image stabilizer (Cpd-1) | 0.01 |
| Color-image stabilizer (Cpd-2) | 0.01 |
| Color-image stabilizer (Cpd-8) | 0.08 |
| Color-image stabilizer (Cpd-18) | 0.01 |
| Color-image stabilizer (Cpd-19) | 0.02 |
| Color-image stabilizer (Cpd-20) | 0.15 |
| Color-image stabilizer (Cpd-21) | 0.01 |
| Color-image stabilizer (Cpd-23) | 0.15 |
| Additive (ExC-1) | 0.001 |
| Color-image stabilizer (UV-A) | 0.01 |
| Solvent (Solv-4) | 0.23 |
| Solvent (Solv-6) | 0.04 |
| Solvent (Solv-9) | 0.23 |
| **Second layer (Color-mixing-inhibiting layer)** | |
| Gelatin | 0.78 |
| Color-mixing inhibitor (Cpd-4) | 0.05 |
| Color-mixing inhibitor (Cpd-12) | 0.01 |
| Color-image stabilizer (Cpd-5) | 0.006 |
| Color-image stabilizer (Cpd-6) | 0.05 |
| Color-image stabilizer (UV-A) | 0.06 |
| Color-image stabilizer (Cpd-7) | 0.006 |
| Solvent (Solv-1) | 0.06 |
| Solvent (Solv-2) | 0.06 |
| Solvent (Solv-5) | 0.07 |
| Solvent (Solv-8) | 0.07 |

-continued

| | |
|---|---|
| Third layer (Green-sensitive emulsion layer) | |
| Emulsion (G-1) | 0.12 |
| Gelatin | 0.95 |
| Magenta coupler (ExM) | 0.12 |
| Ultraviolet absorber (UV-A) | 0.03 |
| Color-image stabilizer (Cpd-2) | 0.01 |
| Color-image stabilizer (Cpd-6) | 0.08 |
| Color-image stabilizer (Cpd-7) | 0.005 |
| Color-image stabilizer (Cpd-8) | 0.01 |
| Color-image stabilizer (Cpd-9) | 0.01 |
| Color-image stabilizer (Cpd-10) | 0.005 |
| Color-image stabilizer (Cpd-11) | 0.0001 |
| Color-image stabilizer (Cpd-20) | 0.01 |
| Solvent (Solv-3) | 0.06 |
| Solvent (Solv-4) | 0.12 |
| Solvent (Solv-6) | 0.05 |
| Solvent (Solv-9) | 0.16 |
| Fourth layer (Color-mixing-inhibiting layer) | |
| Gelatin | 0.65 |
| Color-mixing inhibitor (Cpd-4) | 0.04 |
| Color-mixing inhibitor (Cpd-12) | 0.01 |
| Color-image stabilizer (Cpd-5) | 0.005 |
| Color-image stabilizer (Cpd-6) | 0.04 |
| Color-image stabilizer (UV-A) | 0.05 |
| Color-image stabilizer (Cpd-7) | 0.005 |
| Solvent (Solv-1) | 0.05 |
| Solvent (SoIv-2) | 0.05 |
| Solvent (Solv-5) | 0.06 |
| Solvent (Solv-8) | 0.06 |
| Fifth layer (Red-sensitive emulsion layer) | |
| Emulsion (R-1) | 0.10 |
| Gelatin | 1.11 |
| Cyan coupler (ExC-1) | 0.11 |
| Cyan coupler (ExC-2) | 0.01 |
| Cyan coupler (ExC-3) | 0.04 |
| Color-image stabilizer (Cpd-1) | 0.03 |
| Color-image stabilizer (Cpd-7) | 0.01 |
| Color-image stabilizer (Cpd-9) | 0.04 |
| Color-image stabilizer (Cpd-10) | 0.001 |
| Color-image stabilizer (Cpd-14) | 0.001 |
| Color-image stabilizer (Cpd-15) | 0.18 |
| Color-image stabilizer (Cpd-16) | 0.002 |
| Color-image stabilizer (Cpd-17) | 0.001 |
| Color-image stabilizer (Cpd-18) | 0.05 |
| Color-image stabilizer (Cpd-19) | 0.04 |
| Color-image stabilizer (UV-5) | 0.10 |
| Solvent (Solv-5) | 0.19 |
| Sixth layer (Ultraviolet absorbing layer) | |
| Gelatin | 0.34 |
| Ultmviolet absorber (UV-B) | 0.24 |
| Compound (S1-4) | 0.0015 |
| Solvent (Solv-7) | 0.11 |
| Seventh layer (Protective layer) | |
| Gelatin | 0.82 |
| Additive (Cpd-22) | 0.03 |
| Liquid paraffin | 0.02 |
| Surfactant (Cpd-13) | 0.02 |

(Ex-Y) Yellow coupler

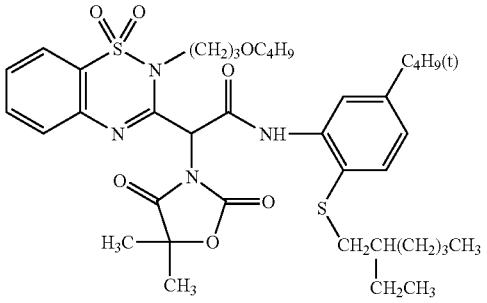

-continued
(Ex-M) Magenta coupler
A mixture in 40:40:20 (mol ratio) of
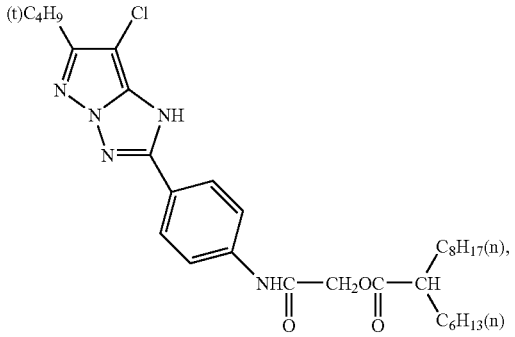
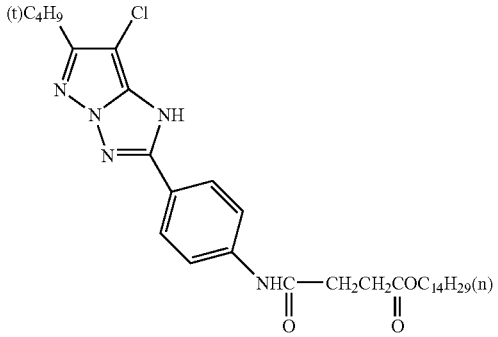
and
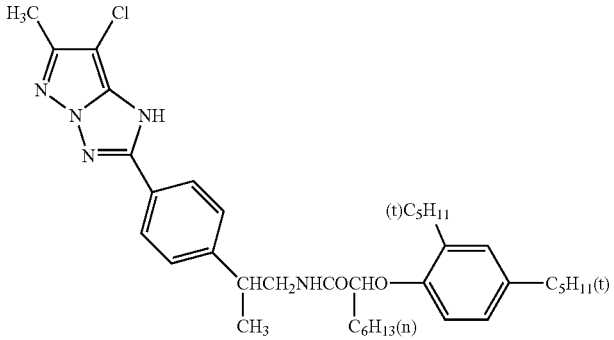
(ExC-1) Cyan coupler
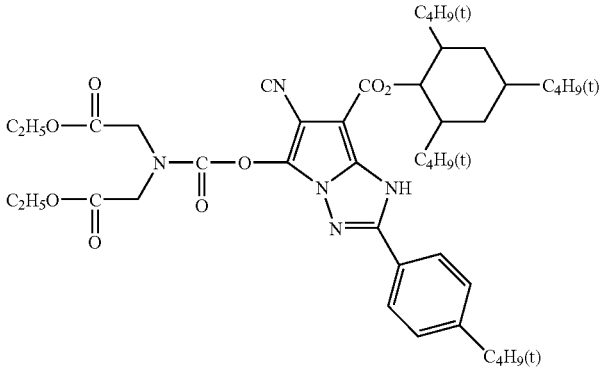

-continued
(ExC-2) Cyan coupler
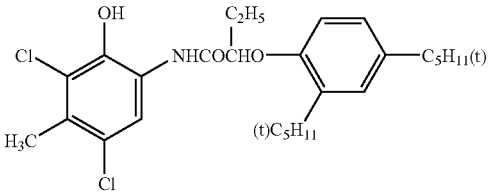
(ExC-3) Cyan coupler
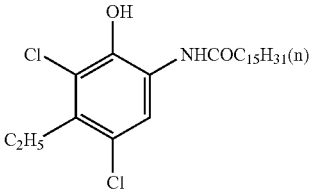
(Cpd-1) Color-image stabilizer
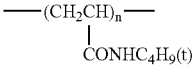
Number-average molecular mass
60,000
(Cpd-2) Color-image stabilizer
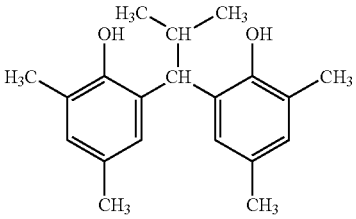
(Cpd-3) Color-image stabilizer
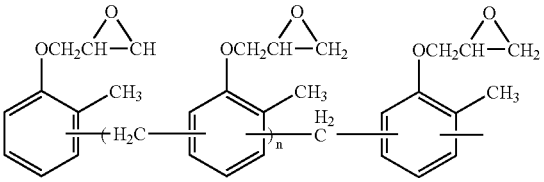
n = 7~8 (Average value)
(Cpd-4) Color-image stabilizer
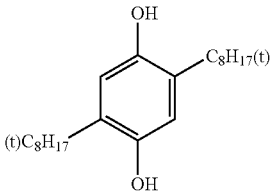
(Cpd-5) Color-image stabilizer
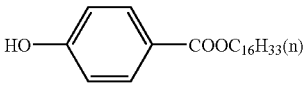

-continued
(Cpd-6) Color-image stabilizer
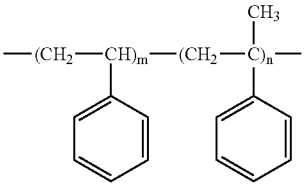
Number-average molecular mass 600
m/n = 10/90
(Cpd-7) Color-image stabilizer
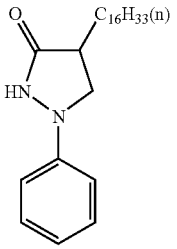
(Cpd-8) Color-image stabilizer
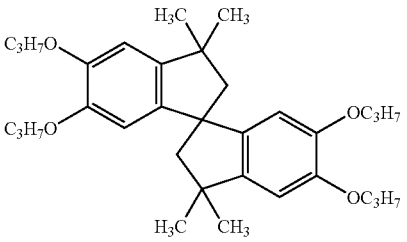
(Cpd-9) Color-image stabilizer
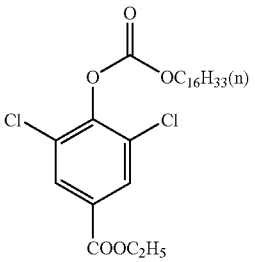
(Cpd-10) Color-image stabilizer
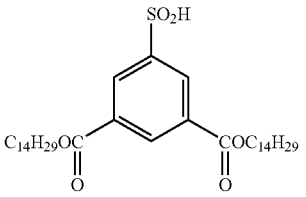

-continued
(Cpd-11)
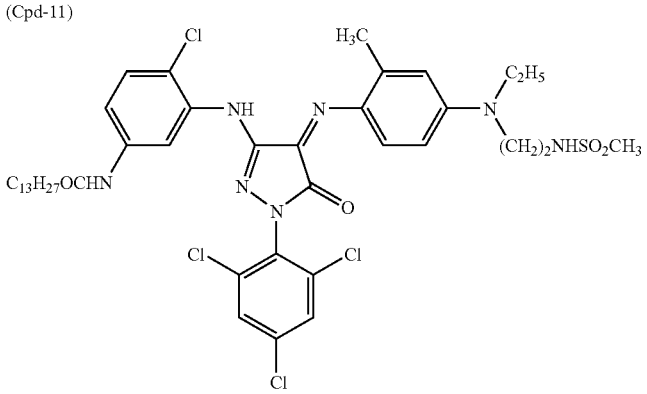
(Cpd-12)
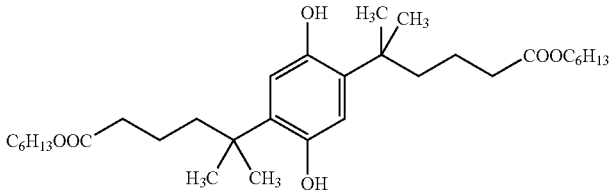
(Cpd-13)
A mixture in 6:2:2 (molar ratio) of (a), (b), and (c)
(a)
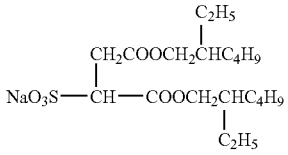
(b)
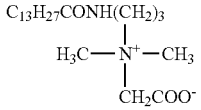
(c)
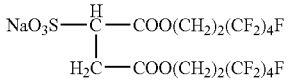
(Cpd-14)
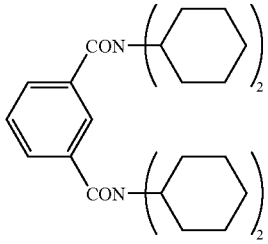
(Cpd-15)
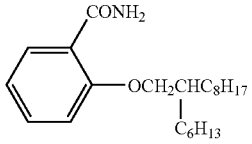

-continued
(Cpd-16)
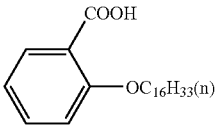
(Cpd-17)
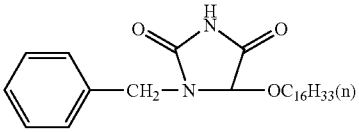
(Cpd-18)
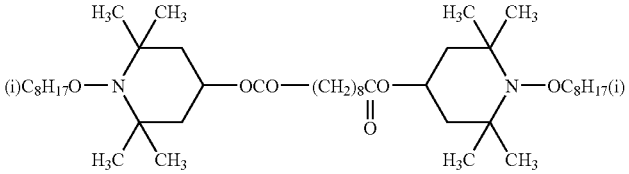
(Cpd-19)
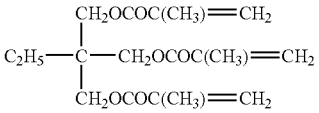
(Cpd-20)
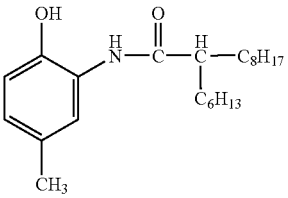
(Cpd-21)
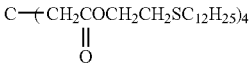
(Cpd-22)
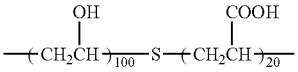
(Mass ratio)
(Cpd-23)
KAYARAD DPCA-30
(trade name, manufactured by Nippon Kayaku Go., Ltd.)
(Solv-1)
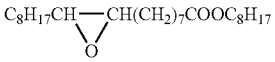
(Solv-2)
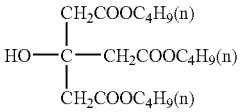
(Solv-3)
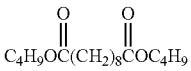

-continued
(Solv-4)
$O{=}P{-}(OC_6H_{13}(n))_3$
(Solv-5)
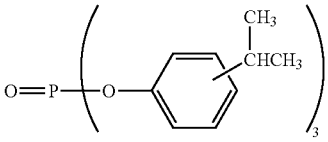
(Solv-6)
$C_8H_{17}CH{=}CH(CH_2)_8OH$
(Solv-7)
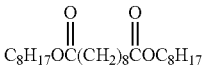
(Solv-8)
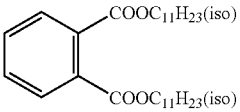
(Solv-9)
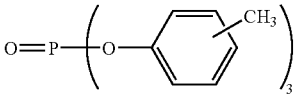
(S1-4)
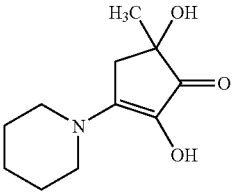
UV-A:
A mixture of (UV-1)/(UV-4)/(UV-5) = 1/7/2 (mass ratio)
UV-B:
A mixture of (UV-1)/(UV2)/(UV-3)/(UV-4)/(UV-5) = 1/1/2/3/3 (mass ratio)
(UV-1)
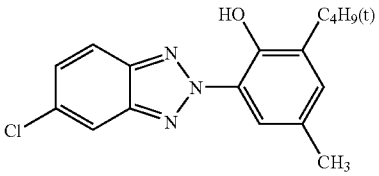
(UV-2)
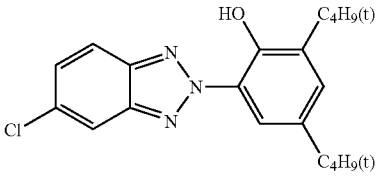

-continued (UV-3)

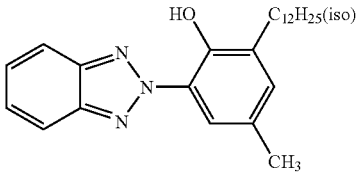

(UV-4)

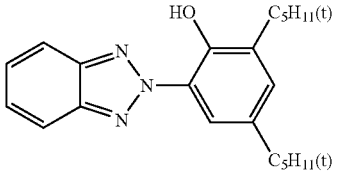

(UV-5)

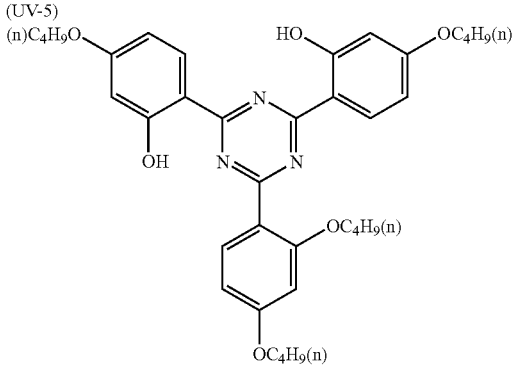

The thus-prepared sample is referred to as Sample 101. Further, Samples 102 to 109 were prepared in the same manner as Sample 101, except that the Emulsion B-1 in the blue-sensitive emulsion layer was replaced with the Emulsions B-2 to B-9, respectively.

In order to examine photographic characteristics of these samples, the following experiments were carried out. Each coating sample was subjected to 10-second low-illumination exposure by means of a sensitometer (Model FWH, made by Fuji Photo Film Co., Ltd.) equipped with a filter SP-1. After the exposure, each sample was subjected to the following color-development processing A:

Processing A

The aforementioned Sample 101 was made into a roll with a width of 127 mm; the resultant sample was exposed to light with a standard photographic image, using Digital Minilab Frontier 350 (trade name, manufactured by Fuji Photo Film Co., Ltd.); and then, the exposed sample was continuously processed (running test) in the following processing steps, until an accumulated replenisher amount of the color developing solution reached to be equal to twice the color developer tank volume. A processing with this running processing solutions was named processing A.

| Processing step | Temperature | Time | Replenishment rate* |
|---|---|---|---|
| Color development | 38.5° C. | 45 sec | 45 ml |
| Bleach-fixing | 38.0° C. | 45 sec | 35 ml |

-continued

| Processing step | Temperature | Time | Replenishment rate* |
|---|---|---|---|
| Rinse (1)** | 38.0° C. | 20 sec | — |
| Rinse (2)** | 38.0° C. | 20 sec | — |
| Rinse (3)** | 38.0° C. | 20 sec | — |
| Rinse (4)** | 38.0° C. | 20 sec | 121 ml |
| Drying | 80° C. | | |

(Note)

*Replenishment rate per $m^2$ of the photosensitive material to be processed

**A rinse cleaning system RC50D, trade name, manufactured by Fuji Photo Film Co., Ltd., was installed in the rinse (3), and the rinse solution was taken out from the rinse (3) and sent to a reverse osmosis membrane module (RC50D) by using a pump. The permeated water obtained in that tank was supplied to the rinse (4), and the concentrated liquid was returned to the rinse (3). Pump pressure was controlled such that the permeated water in the reverse osmosis module would be maintained in an amount of 50 to 300 ml/min, and the rinse solution was circulated under controlled temperature for 10 hours a day. The rinse was made in a four-tank counter-current system from (1) to (4).

The compositions of each processing solution were as follows.

| | (Tank solution) | (Replenisher) |
|---|---|---|
| (Color developer) | | |
| Water | 800 ml | 800 ml |
| Fluorescent whitening agent (FL-1) | 2.2 g | 5.1 g |

-continued

| | (Tank solution) | (Replenisher) |
|---|---|---|
| Fluorescent whitening agent (FL-2) | 0.35 g | 1.75 g |
| Triisopropanolamine | 8.8 g | 8.8 g |
| Polyethyleneglycol (Average molecular weight: 300) | 10.0 g | 10.0 g |
| Ethylenediaminetetraacetic acid | 4.0 g | 4.0 g |
| Sodium sulfite | 0.10 g | 0.20 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl)-hydroxylamine | 8.5 g | 14.0 g |
| 4-Amino-3-methyl-N-ethyl-N-(β-methanesulfonamidoethyl)aniline · 3/2 sulfate · monohydrate | 4.8 g | 14.0 g |
| Potassium carbonate | 26.3 g | 26.3 g |
| Water to make | 1,000 ml | 1,000 ml |
| pH (25° C., adjusted using sulfuric acid and KOH) | 10.15 | 12.40 |
| (Bleach-fixing solution) | | |
| Water | 800 ml | 300 ml |
| Ammonium thiosulfate (750 g/l) | 107 ml | 214 ml |

-continued

| | (Tank solution) | (Replenisher) |
|---|---|---|
| m-Carboxybenzenesulfinic acid | 8.3 g | 16.5 g |
| Ammonium iron (III) ethylenediaminetetraacetate | 47.0 g | 94.0 g |
| Ethylenediaminetetraacetic acid | 1.4 g | 2.8 g |
| Nitric acid (67%) | 16.5 g | 33.0 g |
| Imidazole | 14.6 g | 29.2 g |
| Ammonium sulfite | 16.0 g | 32.0 g |
| Potassium metabisulfite | 23.1 g | 46.2 g |
| Water to make | 1,000 ml | 1,000 ml |
| pH (25° C., adjusted using nitric acid and aqueous ammonia) | 6.5 | 6.5 |
| (Rinse solution) | | |
| Sodium chlorinated-isocyanurate | 0.02 g | 0.02 g |
| Deionized water (conductivity: 5 μS/cm or less) | 1,000 ml | 1,000 ml |
| pH (25° C.) | 6.5 | 6.5 |

The following experiments were done on each of the thus obtained samples.

(Experiment 1)

Developed yellow densities of each sample after processing were measured, and thereby the characteristic curve of 10-second low-illumination exposure was obtained for each sample. The sensitivity (S) was defined as antilogarithm of the reciprocal of the amount of light exposure providing a developed-color density 1.0 higher than the lowest developed-color density; the sensitivities of the samples concerned are shown as relative values, with the sensitivity of Sample 101 being taken as 100. The greater value a sample shows, the higher sensitivity it has and the more preferred it is. The gradation (y) is defined as the difference between the sensitivity corresponding to the density 0.5 and the sensitivity corresponding to the density 1.5. The gradations of the samples concerned are shown as relative values, with the gradation of Sample 101 being taken as 100. The smaller value a sample shows, the harder gradation it has and the more preferred it is. The fog density (Dmin) was defined as the value obtained by subtracting the base density from the yellow density in the unexposed area. So a smaller value means the more beautiful white background, so the smaller the better. The densities corresponding to the shoulder portions of the characteristic curves (Dmax) were compared. A greater value means the higher density, so the greater the better. The results on the sensitivity (S), the gradation (y), the fog density (Dmin), and the shoulder-portion density (Dmax) are shown in Table 2.

TABLE 2

| Sample | Side length of the emulsion grains | Sensitivity | Gradation | Fog | Dmax | Compound group | |
|---|---|---|---|---|---|---|---|
| 101 | 0.50 μm | 100 | 100 | 0.02 | 2.00 | A | — |
| 102 | 0.40 μm | 63 | 100 | 0.02 | 2.06 | A | — |
| 103 | 0.40 μm | 105 | 95 | 0.10 | 2.07 | A | — |
| 104 | 0.40 μm | 63 | 85 | 0.01 | 2.06 | A | B |
| 105 | 0.40 μm | 102 | 103 | 0.02 | 2.06 | A | B |
| 106 | 0.40 μm | 100 | 99 | 0.04 | 2.07 | A | C |
| 107 | 0.40 μm | 102 | 100 | 0.03 | 2.06 | B | F |
| 108 | 0.40 μm | 105 | 95 | 0.10 | 2.06 | A | — |
| 109 | 0.40 μm | 103 | 104 | 0.02 | 2.06 | A | B |

As can be seen from Table 2, compared with Sample 101 having undergone sulfur sensitization, Samples 105 to 107 and Sample 109 which employed the silver halide emulsions according to the first embodiment of the present invention, respectively, each exhibited an almost equivalent or somewhat higher sensitivity, an almost equivalent or somewhat harder gradation, an equivalent fog value, and a higher Dmax value. So these samples are preferable to Sample 101. In comparison with Sample 102 which contained emulsion grains having the same side length as Samples 105 to 107 and Sample 109 and had undergone sulfuer sensitization, the sensitivities of Samples 105 to 107 and Sample 109 were very high and satisfactory. In further comparison with Sample 103 which had undergone selenium sensitization as in the case of Samples 105 to 107 and 109, and with Sample 108 which employed the compound not belonging to Groups A to F according to the first embodiment of the present invention, Samples 105 to 107 and Sample 109 were greatly improved in fog values. In addition, the comparison with Sample 104 indicates that application of the first embodiment of the present invention to selenium-sensitized emulsions can produce greater effects than application to sulfur-sensitized emulsion.

(Experiment 2)

In order to evaluate a whiteness change in each sample by natural radiation during storage, each of the samples was uniformuly irradiated with X-rays (120 KV, 1/10 second), and then the irradiated sample and the not-irradiated sample were both subjected to color processing in accordance with Processing A; and agreeableness of the white background after processing was evaluated. The whiteness was expressed in terms of the value obtained by subtracting the density of the sample not irradiated with X-rays from the density of the corresponding sample irradiated with X-rays. A smaller value means that pure whiteness has a higher immunity to natural radiation, so the smaller the better. The results obtained are shown in Table 3.

TABLE 3

| Sample | Fog |
|---|---|
| 101 | 0.10 |
| 105 | 0.02 |
| 106 | 0.03 |
| 107 | 0.02 |
| 109 | 0.02 |

As can be seen from Table 3, Samples 105 to 107 and Sample 109 which employed the silver halide emulsions according to the first embodiment of the present invention, respectively, had low fog densities after irradiation with X-rays and their whiteness was highly resistant to natural radiation, compared with Sample 101.

EXAMPLE 1-2

In order to examine photographic characteristics of the foregoing Samples 101 to 109 in super-rapid processing, the following experiments were carried out.

Each sample was subjected to gradation exposure to impart gray in the following color-development processing B, with the following exposure apparatus; and then, at five seconds after the exposure was finished, the sample was subject to color-development processing by the processing B. As the laser light sources, a blue-light laser having a wavelength of about 470 nm which was taken out of a semiconductor laser (oscillation wavelength: about 940 nm) by converting the wavelength by a SHG crystal of $LiNbO_3$ having a waveguide-like inverse domain structure, a green-light laser having a wavelength of about 530 nm which was taken out of a semiconductor laser (oscillation wavelength: about 1,060 nm) by converting the wavelength by a SHG crystal of $LiNbO_3$ having a waveguide-like inverse domain structure, and a red-light semiconductor laser (Type No. HL6501 MG, manufactured by Hitachi, Ltd.) having a wavelength of about 650 nm, were used. Each of these three color laser lights was moved in a direction perpendicular to the scanning direction by a polygon mirror so that it could be scanned to expose successively on a sample. Each of the semiconductor lasers is maintained at a constant temperature by means of a Peltier element, to obviate light intensity variations associated with temperature variations. The laser beam had an effective diameter of 80 μm and a scanning pitch of 42.3 μm (600 dpi), and an average exposure time per pixel was $1.7\times10^{-7}$ seconds. The temperature of the semiconductor laser was kept constant by using a Peltier device to prevent the quantity of light from being changed by temperature.

Processing B

The aforementioned Sample 101 was made into a roll with a width of 127 mm; the resultant sample was exposed to light with a standard photographic image, using Digital Minilab Frontier 330 (trade name, manufactured by Fuji Photo Film Co., Ltd.); and then, the exposed sample was continuously processed (running test) in the following processing steps, until an accumulated replenisher amount of the color developing solution reached to be equal to twice the color developer tank volume. A processing with this running processing solutions was named processing B.

| Processing step | Temperature | Time | Replenisher amount* |
|---|---|---|---|
| Color development | 45.0° C. | 17 sec | 35 ml |
| Bleach-fixing | 40.0° C. | 17 sec | 30 ml |
| Rinse (1)** | 45.0° C. | 4 sec | — |
| Rinse (2)** | 45.0° C. | 4 sec | — |
| Rinse (3)** | 45.0° C. | 3 sec | — |
| Rinse (4)** | 45.0° C. | 5 sec | 121 ml |
| Drying | 80° C. | 15 sec | |

(Note)
*Replenisher amount per $m^2$ of the light-sensitive material to be processed.
**A rinse cleaning system RC50D (trade name), manufactured by Fuji Photo Film Co., Ltd., was installed in the rinse (3), and the rinse solution was taken out from the rinse (3) and sent to a reverse osmosis membrane module (RC50D) by using a pump. The permeated water obtained in that tank was supplied to the rinse (4), and the concentrated water was returned to the rinse (3). Pump pressure was controlled such that the water to be permeated in the reverse osmosis module would be maintained in an amount of 50 to 300 ml/min, and the rinse solution was circulated under controlled temperature for 10 hours a day. The rinse was made in a four-tank counter-current system from Rinse (1) to (4).

The composition of each processing solution was as follows.

| | (Tank solution) | (Replenisher) |
|---|---|---|
| (Color developer) | | |
| Water | 800 ml | 800 ml |
| Fluorescent whitening agent (FL-3) | 4.0 g | 8.0 g |
| Residual color reducing agent (SR-1) | 3.0 g | 5.5 g |
| Triisopropanolamine | 8.8 g | 8.8 g |
| Sodium p-toluenesulfonate | 10.0 g | 10.0 g |
| Ethylenediamine tetraacetic acid | 4.0 g | 4.0 g |
| Sodium sulfite | 0.10 g | 0.10 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl)hydroxylamine | 8.5 g | 14.0 g |
| 4-Amino-3-methyl-N-ethyl-N-(β-methanesulfonamidoethyl) aniline · 3/2 sulfate · monohydrate | 7.0 g | 19.0 g |

-continued

| | (Tank solution) | (Replenisher) |
|---|---|---|
| Potassium carbonate | 26.3 g | 26.3 g |
| Water to make | 1,000 ml | 1,000 ml |
| pH (25° C./adjusted using sulfuric acid and KOH) | 10.25 12.6 | |
| (Bleach-fixing solution) | | |
| Water | 800 ml | 300 ml |
| Ammonium thiosulfate (750 g/l) | 107 ml | 214 ml |
| Succinic acid | 29.5 g | 59.0 g |
| Ammonium iron (III) ethylenediaminetetraacetate | 47.0 g | 94.0 g |
| Ethylenediamine tetraacetic acid | 1.4 g | 2.8 g |
| Nitric acid (67%) | 17.5 g | 35.0 g |
| Imidazole | 14.6 g | 29.2 g |
| Aimnonium sulfite | 16.0 g | 32.0 g |
| Potassium metabisulfite | 23.1 g | 46.2 g |
| Water to make | 1,000 ml | 1,000 ml |
| pH (25° C./adjusted using nitric acid and aqua ammonia) | 6.00 6.00 | |
| (Rinse solution) | | |
| Sodium chlorinated-isocyanurate | 0.02 g | 0.02 g |
| Deionized water (conductivity: 5 μS/cm or less) | 1,000 ml | 1,000 ml |
| pH (25° C.) | 6.5 6.5 | |

FL-1

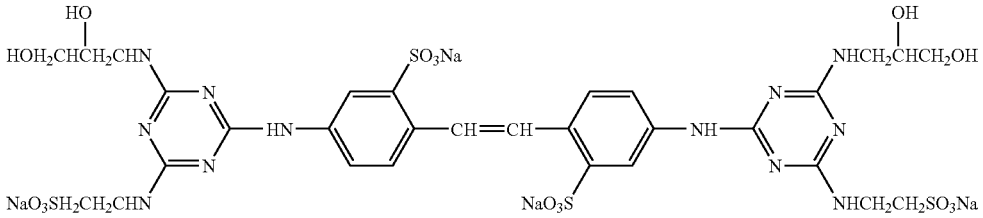

FL-2

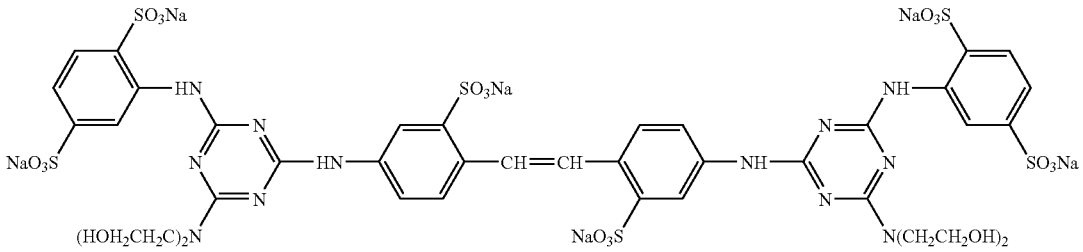

FL-3

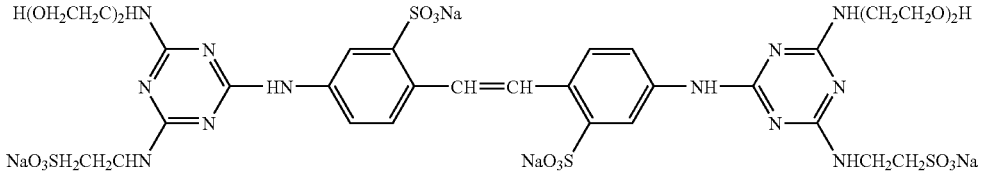

SR-1

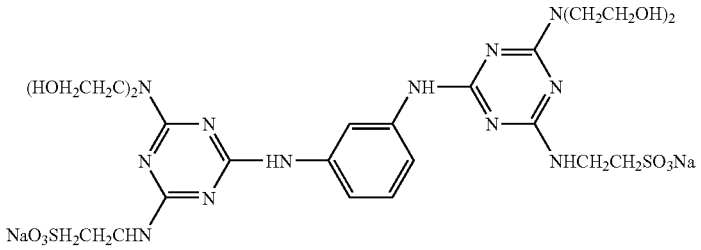

After the processing, the developed yellow-color densities of each sample were measured. When the same experiments as in Example 1-1 were performed, it was found that Samples 105 to 107 and Sample 109 according to the first embodiment of the present invention exhibited similar results as in Example 1-1. Therefore, they proved to be also suited for image formation utilizing laser scanning exposure and super-rapid processing.

EXAMPLE 2-1

(Preparation of Blue-Sensitive Layer Emulsion BH-1)

Using a method of simultaneously adding silver nitrate and sodium chloride mixed into stirring deionized distilled water containing deionized gelatin, high silver chloride cubic grains were prepared. In this preparation, at the step of from 60% to 80% addition of the entire silver nitrate amount, $Cs_2[OsCl_5(NO)]$ was added. At the step of from 80% to 90% addition of the entire silver nitrate amount, potassium bromide (1.5 mol % per mol of the finished silver halide) and $K_4[Fe(CN)_6]$ were added. $K_2[IrCl_6]$ was added at the step of from 83% to 88% addition of the entire silver nitrate amount. Further, $K_2[IrCl_5(H_2O)]$ and $K[IrCl_4(H_2O)_2]$ were added at the step of from 92% to 98% addition of the entire silver nitrate amount. Potassium iodide (0.27 mol % per mol of the finished silver halide) was added, with vigorous stirring, at the step of completion of 94% addition of the entire silver nitrate amount. The thus-obtained emulsion grains were monodisperse cubic silver iodobromochloride grains having a side length of 0.54 μm and a variation coefficient of 8.5%. After being subjected to a sedimentation desalting treatment, the following were added to the resulting emulsion: gelatin, Compounds Ab-1, Ab-2, and Ab-3, and calcium nitrate, and the emulsion was re-dispersed.

(Ab-1)

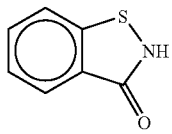

(Ab-2)

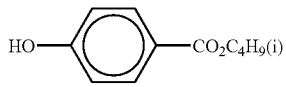

(Ab-3)

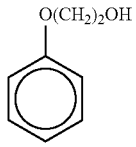

The re-dispersed emulsion was dissolved at 40° C., and Sensitizing dye S—I, Sensitizing dye S-2, and Sensitizing dye S-3 were added, for optimal spectral sensitization. Then, the resulting emulsion was ripened by adding sodium benzene thiosulfate, triethylthiourea as a sulfur sensitizer, and Compound-1 as a gold sensitizer for optimal chemical sensitization. Further, 1-(5-methyl ureidophenyl)-5-mercaptotetrazole, Compound-2, a mixture whose major components are compounds represented by Compound-3 in which the repeating unit (n) is 2 or 3 (both ends $X_1$ and $X_2$ are each a hydroxyl group); Compound-4, and potassium bromide were added, to finalize chemical sensitization. The thus-obtained emulsion was referred to as Emulsion BH-1.

Sensitizing dye S-1

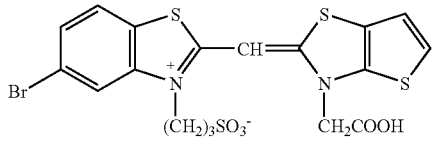

Sensitizing dye S-2

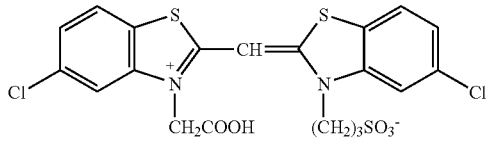

Sensitizing dye S-3

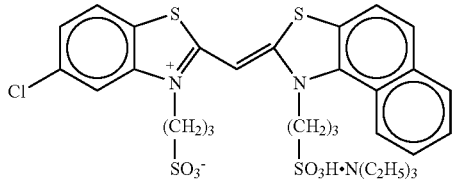

Compound-1

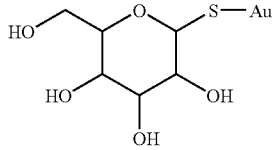

Compound-2

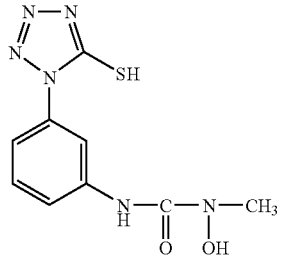

Compound-3

Compound-4

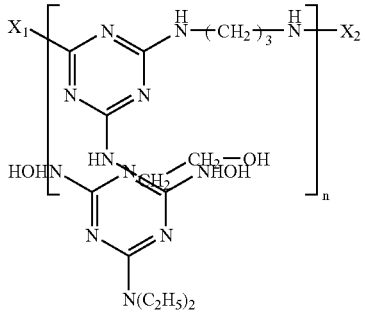

(Preparation of Blue-Sensitive Layer Emulsion BL-1)

Emulsion grains were prepared in the same manner as in the preparation of Emulsion BH-1, except that the temperature and the addition rate at the step of mixing silver nitrate and sodium chloride by simultaneous addition were changed, and the amounts of respective metal complexes that were to be added during the addition of the silver nitrate and sodium chloride were changed. The thus-obtained emulsion grains were monodisperse cubic silver iodobromochloride grains having a side length of 0.44 μm and a variation coefficient of 9.5%. After redispersion of this emulsion, Emulsion BL-1 was prepared in the same manner as Emulsion BH-1, except that the amounts of compounds to be added in the preparation of BH-1 were changed.

(Preparation of Green-Sensitive Layer Emulsion GH-1)

High silver chloride cubic grains were prepared by adding an aqueous silver nitrate solution and sodium chloride simultaneously to stirring deionized distilled water containing deionized gelatin, in accordance with a controlled double jet (CDJ) method. In this grain-preparation process, potassium bromide was added (2 mol % per mole of the finished silver halide) over a period from 80% to 90% addition of the entire silver nitrate amount. Further, $K_4[Ru(CN)_6]$ was added over a period from 80% to 90% addition of the entire silver nitrate amount, so that the addition amount thereof reached $1\times10^{-5}$ mole/mole μg to the total amount of silver. Furthermore, $K_2[IrCl_6]$ was added over a period from 83% to 88% addition of the entire silver nitrate amount, so that the addition amount thereof reached $1\times10^{-7}$ mole/mole Ag to the total amount of silver. The thus-obtained emulsion grains were monodisperse cubic silver iodobromochloride grains having a side length of 0.42 μm and a variation coefficient of 8.0%. After being subjected to a sedimentation desalting treatment according to a usual flocculation method, the following were added to the resulting emulsion: gelatin, Compounds Ab-1, Ab-2, and Ab-3, and calcium nitrate, and the emulsion was re-dispersed.

The re-dispersed emulsion was dissolved at 40° C., and sodium benzenethiosulfate, p-glutaramidophenyldisulfide, sodium thiosulfate pentahydrate as a sulfur sensitizer, and (bis(1,4,5-trimethyl-1,2,4-triazolium-3-thiolate)aurate(I)tetrafluoroborate) as a gold sensitizer were added, and the emulsion was ripened for optimal chemical sensitization. Thereafter, 1-(3-acetamidophenyl)-5-mercaptotetrazole, 1-(5-methylureidophenyl)-5-mercaptotetrazole, Compound-2, Compound-4, and potassium bromide were added. Further, in a midway of the emulsion preparation step, Sensitizing dye S-4, Sensitizing dye S-5, Sensitizing dye S6, and Sensitizing dye S-7 were added as sensitizing dyes, to conduct spectral sensitization. The thus-obtained emulsion was referred to as Emulsion GH-1.

Sensitizing dye S-4

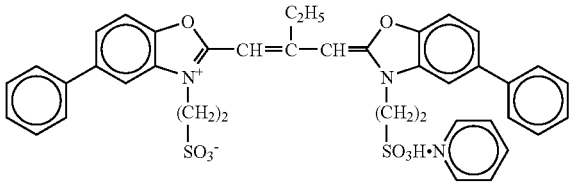

Sensitizing dye S-5

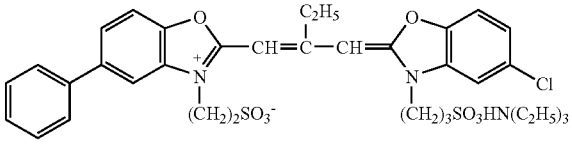

-continued

Sensitizing dye S-6

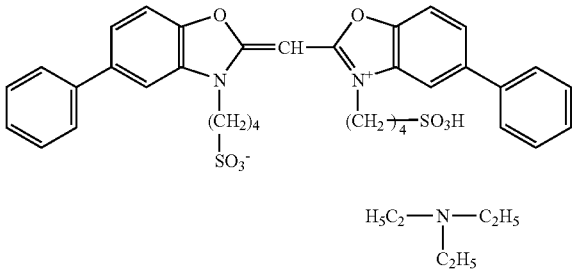

Sensitizing dye S-7

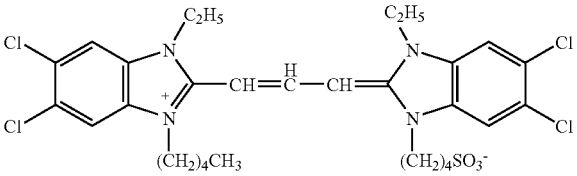

(Preparation of Red-Sensitive Layer Emulsion RH-1)

Using a method of simultaneously adding silver nitrate and sodium chloride mixed into stirring deionized distilled water containing deionized gelatin, high silver chloride cubic grains were prepared. In this preparation, at the step of from 60% to 80% addition of the entire silver nitrate amount, $Cs_2[OsCl_5(NO)]$ was added. At the step of from 80% to 90% addition of the entire silver nitrate amount, $K_4[Ru(CN)_6]$ was added. At the step of from 80% to 100% addition of the entire silver nitrate amount, potassium bromide (1.3 mol % per mol of the finished silver halide) was added. Further, $K_2[IrCl_5(5\text{-methylthiazole})]$ was added at the step of from 83% to 88% addition of the entire silver nitrate amount. Potassium iodide (0.05 mol % per mol of the finished silver halide) was added, with vigorous stirring, at the step of completion of 88% addition of the entire silver nitrate amount. Further, $K_2[IrCl_5(H_2O)]$ and $K[IrCl_4(H_2O)_2]$ were added at the step of from 92% to 98% addition of the entire silver nitrate amount. The thus-obtained emulsion grains were monodisperse cubic silver iodobromochloride grains having a side length of 0.39 μm and a variation coefficient of 10%. The resulting emulsion was subjected to a sedimentation desalting treatment and re-dispersing treatment in the same manner as described in the above.

The re-dispersed emulsion was dissolved at 40° C., and Sensitizing dye S-8, Compound-5, triethylthiourea as a sulfur sensitizer, and Compound-1 as a gold sensitizer were added, and the emulsion was ripened for optimal chemical sensitization. Thereafter, 1-(3-acetamidophenyl)-5-mercaptotetrazole, 1-(5-methylureidophenyl)-5-mercaptotetrazole, Compound-2, Compound-4, and potassium bromide were added. The thus-obtained emulsion was referred to as Emulsion RH-1.

Sensitizing dye S-8

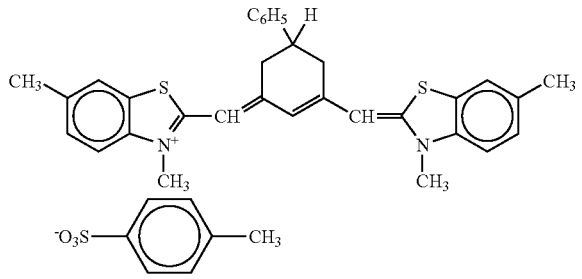

Compound-5

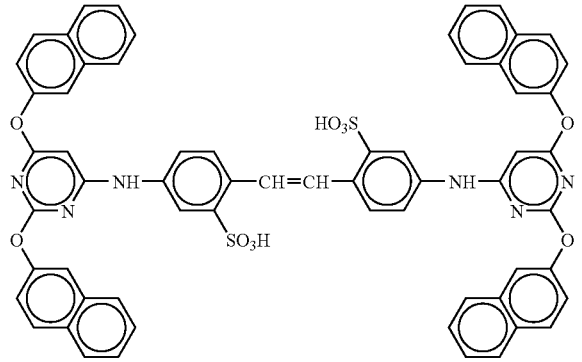

(Preparation of Red-Sensitive Layer Emulsion RL-1)

Emulsion grains were prepared in the same manner as in the preparation of Emulsion RH-1, except that the temperature and the addition rate at the step of mixing silver nitrate and sodium chloride by simultaneous addition were changed, and the amounts of respective metal complexes that were to be added during the addition of silver nitrate and sodium chloride were changed. The thus-obtained emulsion grains were monodisperse cubic silver iodobromochloride grains having a side length of 0.29 μm and a variation coefficient of 9.9%. After this emulsion was subjected to a sedimentation desalting treatment and re-dispersion, Emulsion RL-1 was prepared in the same manner as Emulsion RH-1, except that the amounts of compounds in the preparation of RH—I were changed.

(Preparation of a Coating Solution for the First Layer)

Into 23 g of a solvent (Solv-4), 4 g of a solvent (Solv-6), 23 g of a solvent (Solv-9) and 60 ml of ethyl acetate were dissolved 34 g of a yellow coupler (Ex-Y), 1 g of a color-image stabilizer (Cpd-1), 1 g of a color-image stabilizer (Cpd-2), 8 g of a color-image stabilizer (Cpd-8), and 1 g of a color-image stabilizer (Cpd-18), 2 g of a color-image stabilizer (Cpd-19), 15 g of a color-image stabilizer (Cpd-20), 1 g of a color-image stabilizer (Cpd-21), 15 g of a color-image stabilizer (Cpd-23), 0.1 g of an additive (ExC-1), and 1 g of a color-image stabilizer (UV-A). This solution was emulsified and dispersed in 270 g of a 20 mass % aqueous gelatin solution containing 4 g of sodium dodecylbenzenesulfonate with a high-speed stirring emulsifier (dissolver). Water was added thereto, to prepare 900 g of Emulsified dispersion A1.

On the other hand, the above emulsified dispersion A1 and the prescribed emulsions BH-1 and BL-1 were mixed and dissolved, and the first-layer coating solution was prepared so that it would have the composition shown below. The coating amount of the emulsion is in terms of silver.

The coating solutions for the second layer to the seventh layer were prepared in the similar manner as that for the first-layer coating solution. As a gelatin hardener for each layer, 1-oxy-3,5-dichloro-s-triazine sodium salt (H-1), (H-2), and (H-3) were used. Further, to each layer, were added Ab-1, Ab-2, and Ab-3, so that the total amounts would be 15.0 mg/m$^2$, 60.0 mg/m$^2$, 5.0 mg/m$^2$, and 10.0 mg/m$^2$, respectively.

(H-1) Hardener

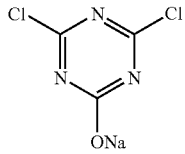

(H-2) Hardener

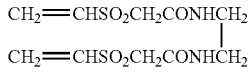

(H-3) Hardener

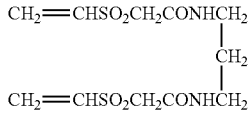

Further, to the second layer, the fourth layer, and the sixth layer, was added 1-(3-methylureidophenyl)-5-mercaptotetrazole in amounts of 0.2 mg/m$^2$, 0.2 mg/m$^2$, and 0.6 mg/m$^2$, respectively. Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of silver halide. Further, to the red-sensitive emulsion layer, was added a copolymer latex of methacrylic acid and butyl acrylate (1:1 in mass ratio; average molecular weight, 200,000 to 400,000) in an amount of 0.05 g/m$^2$. Disodium salt of catecol-3,5-disulfonic acid was added to the second layer, the fourth layer and the sixth layer so that coating amounts would be 6 mg/m$^2$, 6 mg/m$^2$ and 18 mg/m$^2$, respectively. Further, to each layer, sodium polystyrene sulfonate was added to adjust viscosity of the coating solutions, if necessary. Further, in order to prevent irradiation, the following dyes (coating amounts are shown in parentheses) were added.

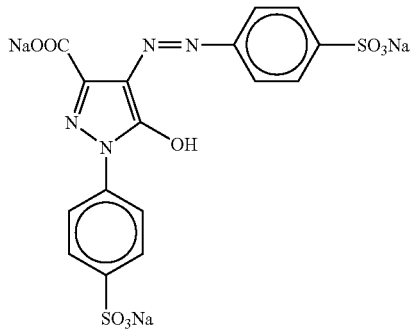

(2 mg/m$^2$)

-continued

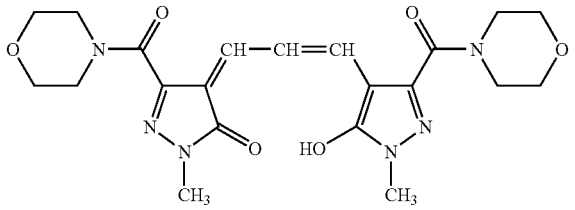

(2 mg/m$^2$)

-continued

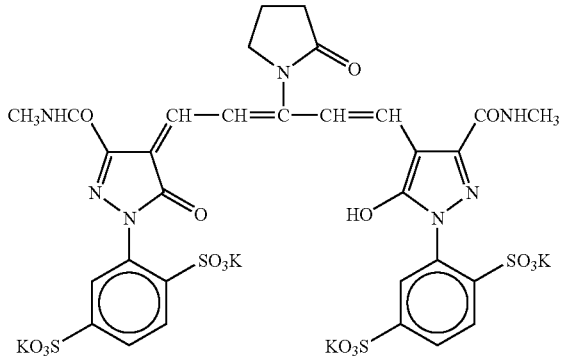

(3 mg/m$^2$)

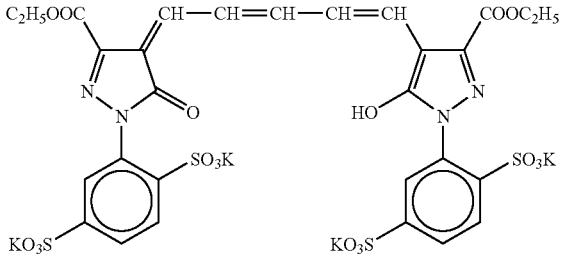

(24 mg/m$^2$)

(Layer Constitution)

The composition of each layer is shown below. The numbers show coating amounts (g/m$^2$). In the case of the silver halide emulsion, the coating amount is in terms of silver.

Support

Polyethylene resin laminated paper {The polyethylene resin on the first layer side contained white pigments ($TiO_2$, content of 16 mass %; ZnO, content of 4 mass %), a fluorescent whitening agent (4,4'-bis(5-methylbenzoxazolyl)stilbene, content of 0.03 mass %) and a bluish dye (ultramarine, content of 0.33 mass %); and the amount of the polyethylene resin was 29.2 g/m$^2$.}

| | |
|---|---|
| First Layer (Blue-sensitive emulsion layer) | |
| Emulsion (a 5:5 mixture of BH-1 and BL-1 (mol ratio of silver)) | 0.16 |
| Gelatin | 1.32 |
| Yellow coupler (Ex-Y) | 0.34 |
| Color-image stabilizer (Cpd-1) | 0.01 |
| Color-image stabilizer (Cpd-2) | 0.01 |
| Color-image stabilizer (Cpd-8) | 0.08 |
| Color-image stabilizer (Cpd-18) | 0.01 |
| Color-image stabilizer (Cpd-19) | 0.02 |
| Color-image stabilizer (Cpd-20) | 0.15 |
| Color-image stabilizer (Cpd-21) | 0.01 |
| Color-image stabilizer (Cpd-23) | 0.15 |
| Additive (ExC-1) | 0.001 |
| Color-image stabilizer (UV-A) | 0.01 |
| Solvent (Solv-4) | 0.23 |
| Solvent (Solv-6) | 0.04 |
| Solvent (Solv-9) | 0.23 |
| Second layer (Color-mixing-inhibiting layer) | |
| Gelatin | 0.78 |
| Color-mixing inhibitor (Cpd-4) | 0.05 |
| Color-mixing inhibitor (Cpd-12) | 0.01 |
| Color-image stabilizer (Cpd-5) | 0.006 |
| Color-image stabilizer (Cpd-6) | 0.05 |
| Color-image stabilizer (UV-A) | 0.06 |
| Color-image stabilizer (Cpd-7) | 0.006 |
| Antiseptic (Cpd-24) | 0.006 |
| Solvent (Solv-1) | 0.06 |
| Solvent (Solv-2) | 0.06 |
| Solvent (Solv-5) | 0.07 |
| Solvent (Solv-8) | 0.07 |
| Third layer (Green-sensitive emulsion layer) | |
| Emulsion (GH-1) | 0.12 |
| Gelatin | 0.95 |
| Magenta coupler (ExM) | 0.12 |
| Ultraviolet absorber (UV-A) | 0.03 |

-continued

| | |
|---|---|
| Color-image stabilizer (Cpd-2) | 0.01 |
| Color-image stabilizer (Cpd-6) | 0.08 |
| Color-image stabilizer (Cpd-7) | 0.005 |
| Color-image stabilizer (Cpd-8) | 0.01 |
| Color-image stabilizer (Cpd-9) | 0.01 |
| Color-image stabilizer (Cpd-10) | 0.005 |
| Color-image stabilizer (Cpd-11) | 0.0001 |
| Color-image stabilizer (Cpd-20) | 0.01 |
| Solvent (Solv-3) | 0.06 |
| Solvent (Solv-4) | 0.12 |
| Solvent (Solv-6) | 0.05 |
| Solvent (Solv-9) | 0.16 |
| Fourth layer (Color-mixing-inhibiting layer) | |
| Gelatin | 0.65 |
| Color-mixing inhibitor (Cpd-4) | 0.04 |
| Color-mixing inhibitor (Cpd-12) | 0.01 |
| Color-image stabilizer (Cpd-5) | 0.005 |
| Color-image stabilizer (Cpd-6) | 0.04 |
| Color-image stabilizer (UV-A) | 0.05 |
| Color-image stabilizer (Cpd-7) | 0.005 |
| Antiseptic (Cpd-24) | 0.005 |
| Solvent (Solv-1) | 0.05 |
| Solvent (Solv-2) | 0.05 |
| Solvent (Solv-5) | 0.06 |
| Solvent (Solv-8) | 0.06 |
| Fifth layer (Red-sensitive emulsion layer) | |
| Emulsion (a 4:6 mixture of RH-1 and RL-1 (mol ratio of silver)) | 0.10 |
| Gelatin | 1.11 |
| Cyan coupler (ExC-1) | 0.11 |
| Cyan coupler (ExC-2) | 0.01 |
| Cyan coupler (ExC-3) | 0.04 |
| Color-image stabilizer (Cpd-1) | 0.03 |
| Color-image stabilizer (Cpd-7) | 0.01 |
| Color-image stabilizer (Cpd-9) | 0.04 |
| Color-image stabilizer (Cpd-10) | 0.001 |
| Color-image stabilizer (Cpd-14) | 0.001 |
| Color-image stabilizer (Cpd-15) | 0.18 |
| Color-image stabilizer (Cpd-16) | 0.002 |
| Color-image stabilizer (Cpd-17) | 0.001 |
| Color-image stabilizer (Cpd-18) | 0.05 |
| Color-image stabilizer (Cpd-19) | 0.04 |
| Color-image stabilizer (UV-5) | 0.10 |
| Solvent (Solv-5) | 0.19 |
| Sixth layer (Ultraviolet absorbing layer) | |
| Gelatin | 0.34 |
| Ultraviolet absorber (UV-B) | 0.24 |
| Compound (S1-4) | 0.0015 |
| Solvent (Solv-7) | 0.11 |
| Seventh layer (Protective layer) | |
| Gelatin | 0.82 |
| Additive (Cpd-22) | 0.03 |
| Liquid paraffin | 0.02 |
| Surfactant (Cpd-13) | 0.02 |

(Ex-Y)

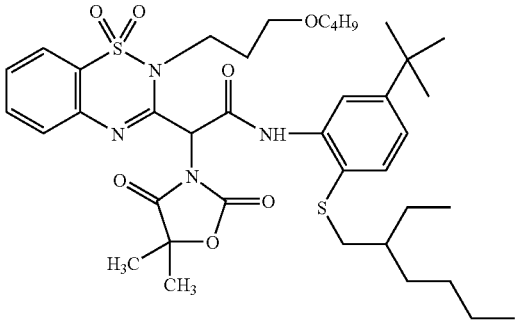

(E x M) Magenta coupler
A mixture in 40:40:20 (mol ratio) of

-continued
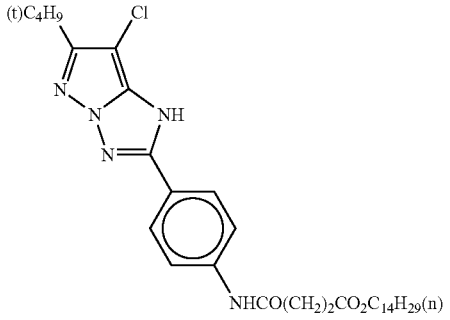
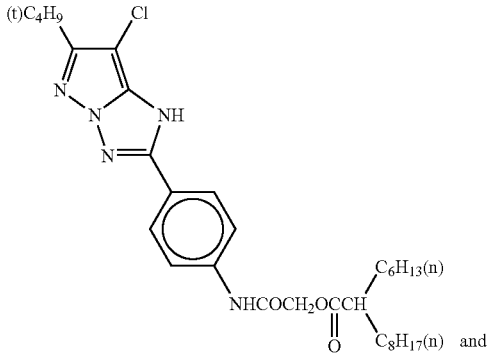
and
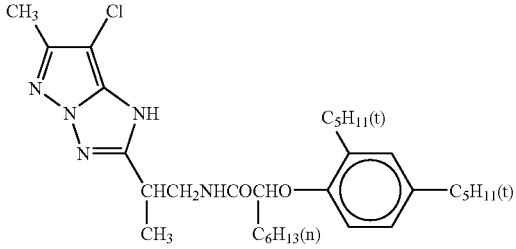
(ExC-1) Cyan coupler
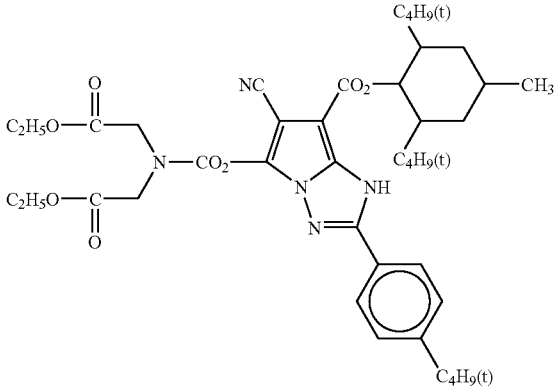
(ExC-2) Cyan coupler
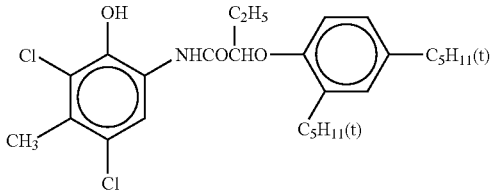

-continued
(ExC-3) Cyan coupler
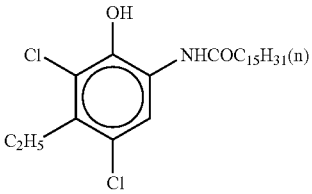
(Cpd-1) Color-image stabilizer
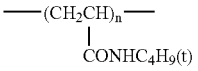
Number-average molecular mass
60,000
(Cpd-2) Color-image stabilizer
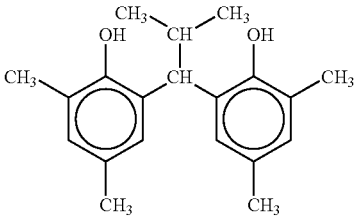
(Cpd-3) Color-image stabilizer
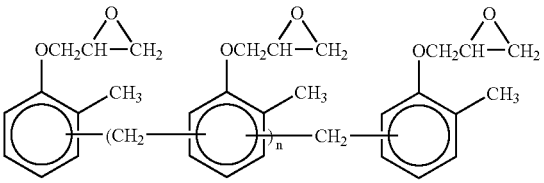
n = 7~8
(Average value)
(Cpd-4) Color-mixing inhibitor
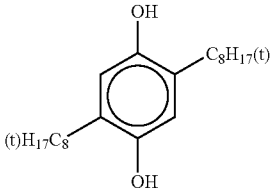
(Cpd-5) Color-image stabilizer
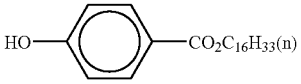
(Cpd-6) Color-image stabilizer
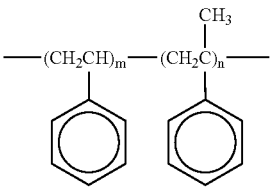
Number-average molecular mass 600
m/n = 10/90

-continued
(Cpd-7) Color-image stabilizer
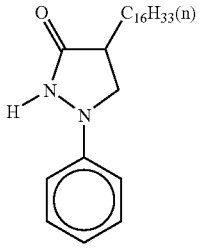
(Cpd-8) Color-image stabilizer
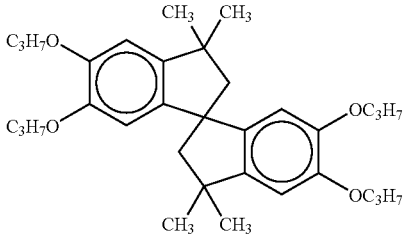
(Cpd-9) Color-image stabilizer
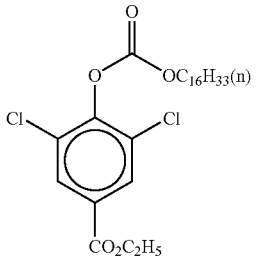
(Cpd-10) Color-image stabilizer
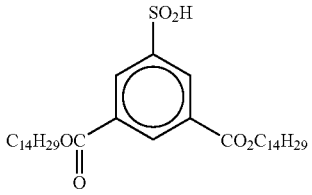
(Cpd-11)
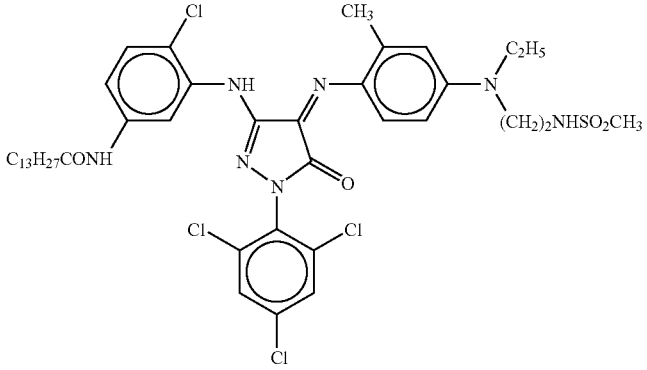

-continued
(Cpd-12)
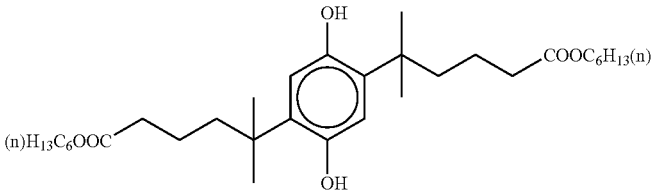
(Cpd-13) Surfactant
A mixture in 6:2:2 (molar ratio) of
(a). (b). and (c)
(a)
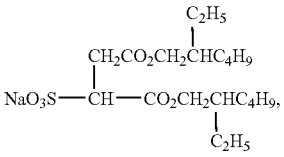
(b)
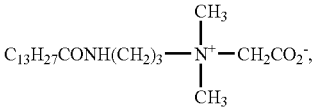
(c)
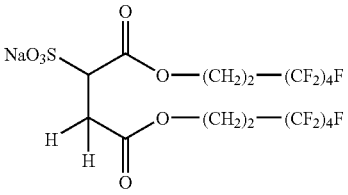
(Cpd-14)
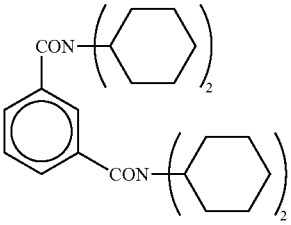
(Cpd-15)
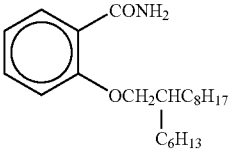
(Cpd-16)
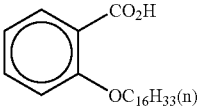

-continued
(Cpd-17)
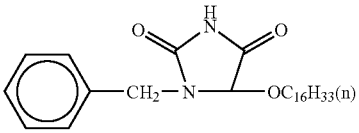
(Cpd-18)
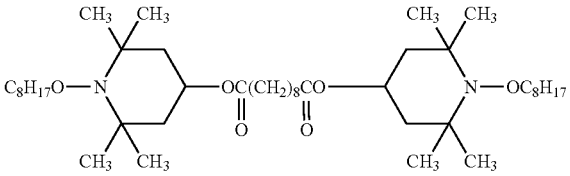
(Cpd-19)
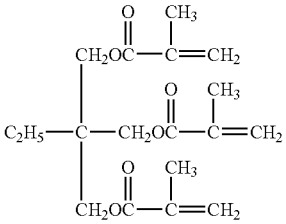
(Cpd-20)
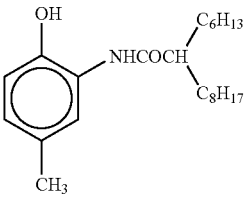
(Cpd-21)
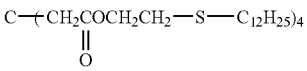
(Cpd-22)
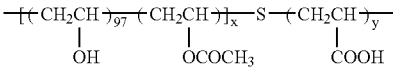
x:y = 5:1 (Mass ratio)
(Cpd-23)
KAYARAD DPCA-30
(trade name, manufactured by Nippon Kayaku Co., Ltd.)
(Cpd-24)
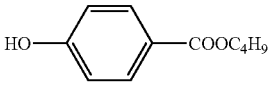
(Solv-1)
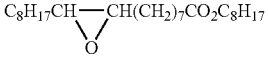

-continued
(Solv-2)
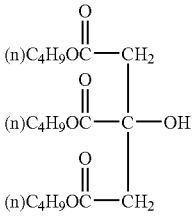
(Solv-3)
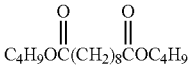
(Solv-4)
$O{=}P(OC_6H_{13}(n))_3$
(Solv-5)
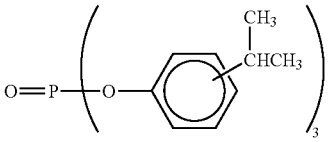
(Solv-6)
$C_8H_{17}CH{=}CHC_8H_{16}OH$
(Solv-7)
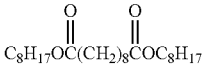
(Solv-8)
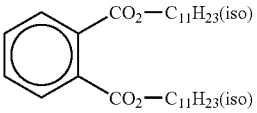
(Solv-9)
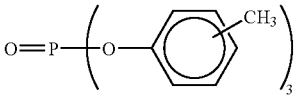
(S1-4)
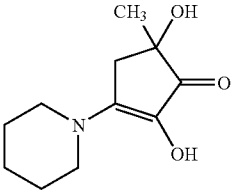
(UV-1) Ultraviolet absorber
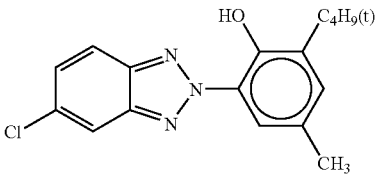

-continued (UV-2) Ultraviolet absorber

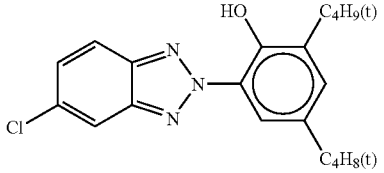

(UV-3) Ultraviolet absorber

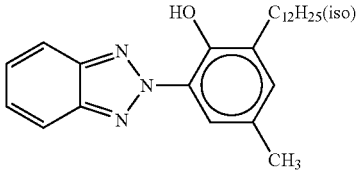

(UV-4) Ultraviolet absorber

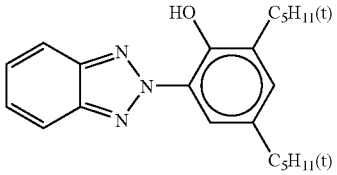

(UV-5) Ultraviolet absorber

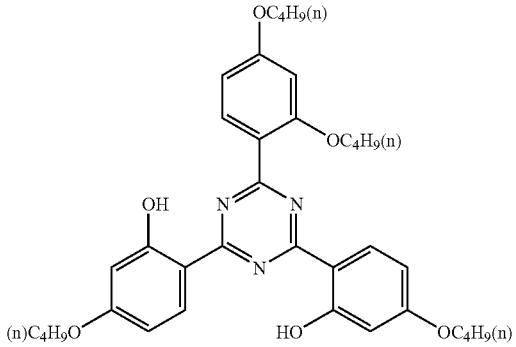

UV-A:
A mixture of UV-1/UV-4/UV-5 = 1/7/2 (mass ratio)
UV-B:
A mixture of UV-1/UV-3/UV-4/UV-5 = 1/3/5/1 (mass ratio)

The thus-prepared sample is referred to as Sample 1101.

(Preparation of Sample 1102)

A green-sensitive emulsion GH-2 was prepared in the same manner as GH-1, except that $K_2[RhBr_5(H_2O)]$ was added over a period from 83 to 88% addition of the entire silver nitrate amount in the emulsion preparation, so that the addition amount thereof reached $5\times10^{-9}$ mole/mole Ag to the total amount of silver. Further, Sample 1102 was prepared in the same manner as Sample 1101, except that Emulsion GH-1 was replaced with Emulsion GH-2.

(Preparation of Sample 1103)

A green-sensitive emulsion GH-3 was prepared in the same manner as GH-1, except that the selenium compound SE3-9 was used in place of sodium thiosulfate pentahydrate in the preparation of the emulsion. Further, Sample 1103 was prepared in the same manner as Sample 1101, except that Emulsion GH-1 was replaced with Emulsion GH-3.

(Preparation of Sample 1104)

A green-sensitive emulsion GH4 was prepared in the same manner as GH-3, except that $K_2[RhBr_5(H_2O)]$ was added over a period from 83% to 88% addition of the entire silver nitrate amount in the emulsion preparation, so that the addition amount thereof reached $5\times10^{-9}$ mole/mole Ag to the total amount of silver. Further, Sample 1104 was prepared in the same manner as Sample 1101, except that Emulsion GH-1 was replaced with Emulsion GH-4.

(Preparation of Sample 1105)

A green-sensitive emulsion GH-5 was prepared in the same manner as GH-3, except that potassium iodide was added with vigorous stinring (so as to have an iodide content of 2 mole % per mole of the finished silver halide) over a period from 90% to 100% addition of the entire silver nitrate amount in the emulsion preparation. Further, Sample 1105 was prepared in the same manner as Sample 1101, except that Emulsion GH-1 was replaced with Emulsion GH-5.

(Preparation of Sample 1106)

A green-sensitive emulsion GH-6 was prepared in the same manner as GH-5, except that $K_2[RhBr_5(H_2O)]$ was added over a period from 83 to 88% addition of the entire silver nitrate amount in the emulsion preparation so that the addition amount thereof reached $5\times10^{-5}$ mole/mole Ag to the total amount of silver. Further, Sample 1106 was prepared in the same manner as Sample 1101, except that Emulsion GH-1 was replaced with Emulsion GH-6.

(Preparation of Sample 1107)

A green-sensitive emulsion GH-7 was prepared in the same manner as GH-5, except that $K_2[RhBr_5(H_2O)]$ was added over a period from 83 to 88% addition of the entire silver nitrate amount in the emulsion preparation so that the addition amount thereof reached $1\times10^{-5}$ mole/mole Ag to the total amount of silver. Further, Sample 1107 was prepared in the same manner as Sample 1101, except that Emulsion GH-1 was replaced with Emulsion GH-7.

Each of the coating samples was subjected to $1\times10^{-4}$-second gradation exposure for sensitometry via a green filter by use of a sensitometer for high-illumination exposure (Model HIE, made by YAMASHITA DENSO CORPORATION). The thus exposed samples underwent the following rapid processing for color development (Processing C) after a 6-second lapse from the exposure.

(Rapid Processing)

The aforementioned Sample 1101 was made into a roll with a width of 127 mm; the resultant sample was exposed to light with a standard photographic image, using Digital Minilab Frontier 330 (trade name, manufactured by Fuji Photo Film Co., Ltd.); and then, the exposed sample was continuously processed (running test) in the following processing steps, until an accumulated replenisher amount of the color developing solution reached to be equal to twice the color developer tank volume. A processing with this running processing solutions was named processing C.

| Processing step | Temperature | Time | Replenisher amount* |
|---|---|---|---|
| Color development | 45.0° C. | 17 sec | 35 ml |
| Bleach-fixing | 40.0° C. | 17 sec | 30 ml |
| Rinse (1)** | 45.0° C. | 4 sec | — |
| Rinse (2)** | 45.0° C. | 4 sec | — |
| Rinse (3)** | 45.0° C. | 3 sec | — |
| Rinse (4)** | 45.0° C. | 5 sec | 121 ml |
| Drying | 80° C. | 15 sec | |

(Note)

*Replenisher amount per $m^2$ of the light-sensitive material to be processed.

**A rinse cleaning system RC50D (trade name), manufactured by Fuji Photo Film Co., Ltd., was installed in the rinse (3), and the rinse solution was taken out from the rinse (3) and sent to a reverse osmosis membrane module (RC50D) by using a pump. The permeated water obtained in that tank was supplied to the rinse (4), and the concentrated water was returned to the rinse (3). Pump pressure was controlled such that the water to be permeated in the reverse osmosis module would be maintained in an amount of 50 to 300 ml/min, and the rinse solution was circulated under controlled temperature for 10 hours a day. The rinse was made in a four-tank counter-current system from Rinse (1) to (4).

The composition of each processing solution was as follows.

| | (Tank solution) | (Replenisher) |
|---|---|---|
| (Color developer) | | |
| Water | 800 ml | 800 ml |
| Fluorescent whitening agent (FL-3) | 4.0 g | 8.0 g |
| Residual color reducing agent (SR-1) | 3.0 g | 5.5 g |
| Triisopropanolamine | 8.8 g | 8.8 g |
| Sodium p-toluenesulfonate | 10.0 g | 10.0 g |
| Ethylenediamine tetraacetic acid | 4.0 g | 4.0 g |
| Sodium sulfite | 0.10 g | 0.10 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl)hydroxylamine | 8.5 g | 14.0 g |
| 4-Amino-3-methyl-N-ethyl-N-(β-methanesulfonamidoethyl) aniline · 3/2 sulfate · monohydrate | 7.0 g | 19.0 g |
| Potassium carbonate | 26.3 g | 26.3 g |
| Water to make | 1,000 ml | 1,000 ml |
| pH (25° C./adjusted using sulfuric acid and KOH) | 10.25 | 12.6 |
| (Bleach-fixing solution) | | |
| Water | 800 ml | 300 ml |
| Ammonium thiosulfate (750 g/l) | 107 ml | 214 ml |
| Succinic acid | 29.5 g | 59.0 g |
| Ammonium iron (III) ethylenediaminetetraacetate | 47.0 g | 94.0 g |
| Ethylenediamine tetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water to make | 1,000 ml | 1,000 ml |
| pH (25° C./adjusted using nitric acid and aqua ammonia) | 6.00 | 6.00 |
| (Rinse solution) | | |
| Sodium chlorinated-isocyanurate | 0.02 g | 0.02 g |
| Deionized water (conductivity: 5 μS/cm or less) | 1,000 ml | 1,000 ml |
| pH (25° C.) | 6.5 | 6.5 |

-continued

| | (Tank solution) | (Replenisher) |
|---|---|---|

FL-1

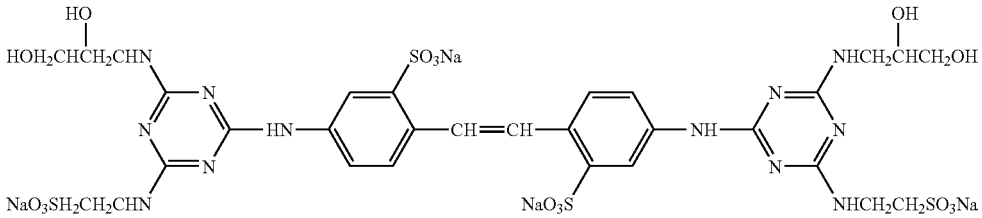

FL-2

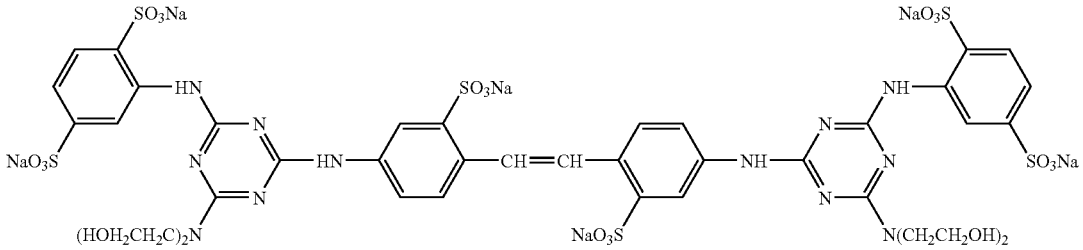

FL-3

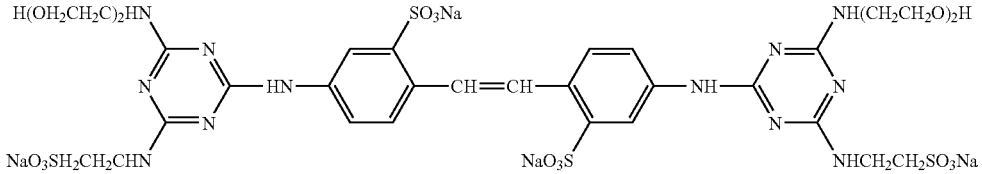

SR-1

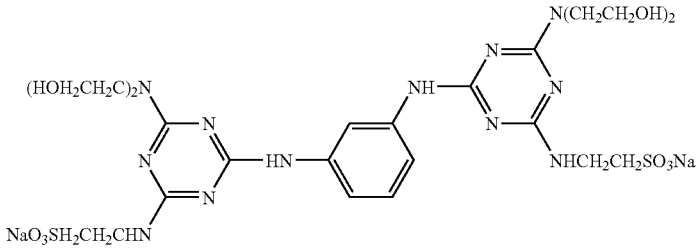

Developed magenta densities of each sample after Processing C were measured, and thereby the characteristic curve in the case of $1\times10^{-4}$-second exposure was obtained for each sample. The high-illumination sensitivity of each sample was read from logarithm of the exposure amount E required for giving a developed color density of 0.2 to each sample. The relative value to the sensitivity of Sample 101 was expressed in logE and referred to as relative high-illumination sensitivity SH. The more positive the nunerical value, the higher the sensitivity. Further, the developed-color density D corresponding to the exposure amount 0.5 greater, expressed in terms of logE, than the exposure amount required for providing a developed-color density of 0.3 was read, and (D−0.3)/0.5 was determined as gradation γ. In the case of digital exposure utilizing laser scanning exposure, such a value is preferably in the range of 2.2±0.2, more preferably in the range of 2.2±0.1. The results obtained are shown in Table 4.

TABLE 4

| Sample | Green-sensitive emulsion | Chalcogen sensitizer | Compound of formula (D1) | Potassium iodide | SH | γ |
|---|---|---|---|---|---|---|
| 1101 | GH-1 | Sodium thiosulfate | — | — | 0 | 1.2 |
| 1102 | GH-2 | Sodium thiosulfate | $K_2[RhBr_5(H_2O)]$ | — | −0.15 | 1.7 |
| 1103 | GH-3 | SE3-9 | — | — | 0.12 | 1.35 |
| 1104 | GH-4 | SE3-9 | $K_2[RhBr_5(H_2O)]$ | — | 0.05 | 1.9 |
| 1105 | GH-5 | SE3-9 | — | 0.2 mol % | 0.18 | 1.3 |

TABLE 4-continued

| Sample | Green-sensitive emulsion | Chalcogen sensitizer | Compound of formula (D1) | Potassium iodide | SH | γ |
|---|---|---|---|---|---|---|
| 1106 | GH-6 | SE3-9 | $K_2[RhBr_5(H_2O)]$ | 0.2 mol % | 0.13 | 1.9 |
| 1107 | GH-7 | SE3-9 | $K_2[RhBr_5(H_2O)]$ (added in excess amount) | 0.2 mol % | −0.46 | 3.0 |

The use of compounds represented by formula (D1) involves desensitization although it can enhance hard gradation. The extent of this desensitization was found to be reducible by combined use with selenium sensitizers. Namely, the sensitizing effect of selenium compounds became remarkable when used in combination with compounds represented by formula (D1). In other words, photosensitive materials with hard gradation and high sensitivity were obtained by combined use of hard-gradation-enhancing metal complexes and selenium sensitization. In addition, it was also found that the introduction of a silver iodide layer had a great effect on reduction of desensitization. When the sample (Sample 1107) wherein the metal complex was used in a large amount as described in JP-A-8-95184, high degree of desensitization occurred and the effect of the second embodiment of the present invention was not obtained.

Additionally, coating samples were prepared in the same manner as Samples 1103 to 1106, except that SE3-9 was replaced with SE1-2 or SE2-12, and evaluation was made thereon in the same manner as Samples 1103 to 1106. As a result, it was found that the samples prepared were photosensitive materials with hard gradation and reduced desensitization, compared with Sample 1102.

EXAMPLE 2-2

(Preparation of Sample 1108)

A green-sensitive emulsion GH-8 was prepared in the same manner as GH-1, except that $K_2[IrCl_5(H_2O)]$ was added over a period from 90 to 100% addition of the entire silver nitrate amount in the emulsion preparation so that the addition amount thereof reached $8\times10^{-6}$ mole/mole Ag to the total amount of silver. Further, Sample 1108 was prepared in the same manner as Sample 1101, except that Emulsion GH-1 was replaced with Emulsion GH-8.

(Preparation of Sample 1109)

A green-sensitive emulsion GH-9 was prepared in the same manner as GH-8, except that $K_2[RhBr_5(H_2O)]$ was added over a period from 83 to 88% addition of the entire silver nitrate amount in the emulsion preparation so that the addition amount thereof reached $5\times10^{-9}$ mole/mole Ag to the total amount of silver. Further, Sample 1109 was prepared in the same manner as Sample 1101, except that Emulsion GH-1 was replaced with Emulsion GH-9.

(Preparation of Sample 1110)

A green-sensitive emulsion GH-10 was prepared in the same manner as GH-8, except that the selenium compound SE3-9 was used in place of sodium thiosulfate pentahydrate in the preparation of the emulsion. Further, Sample 1110 was prepared in the same manner as Sample 1101, except that Emulsion GH-1 was replaced with Emulsion GH-10.

(Preparation of Sample 1111)

A green-sensitive emulsion GH-11 was prepared in the same manner as GH-10, except that $K_2[RhBr_5(H_2O)]$ was added over a period from 83 to 88% addition of the entire silver nitrate amount in the emulsion preparation so that the addition amount thereof reached $5\times10^{-9}$ mole/mole Ag to the total amount of silver. Further, Sample 1111 was prepared in the same manner as Sample 1101, except that Emulsion GH-1 was replaced with Emulsion GH-11.

Samples 1101 to 1104 and Samples 1108 to 1111 were each exposed in accordance with the same method as in Example 2-1, and their individual high-illumination sensitivities and gradations were measured. Separately, after a 60-minute lapse from the exposure, these samples were subjected to Processing C, to determine sensitivity; and then, using these values, the sensitization amplitude relative to the case where Processing C was carried out after a 6-second lapse from the exposure, ΔS, was determined. Separately, each coating sample was subjected to 10-second low-illumination exposure by means of a sensitometer (Model FWH, made by Fuji Photo Film Co., Ltd.) equipped with a filter SP-1. After a 6-second lapse, Processing C was performed, and low-illumination characteristic curves were determined, From each of the low-illumination characteristic curves, a low-illumination gradation γL was determined in the same manner as in Example 2-1. The results obtained are shown in Table 5.

TABLE 5

| Sample | Green-sensitive emulsion | Chalcogen sensitizer | Compound of formula (D1) | Compound of formula (D2) | SH | γ | ΔS | γL |
|---|---|---|---|---|---|---|---|---|
| 1101 | GH-1 | Sodium thiosulfate | — | — | 0 | 1.2 | 0.15 | 2.1 |
| 1102 | GH-2 | Sodium thiosulfate | $K_2[RhBr_5(H_2O)]$ | — | −0.15 | 1.7 | 0.13 | 2.2 |
| 1103 | GH-3 | SE3-9 | — | — | 0.12 | 1.35 | 0.13 | 2.2 |
| 1104 | GH-4 | SE3-9 | $K_2[RhBr_5(H_2O)]$ | — | 0.05 | 1.9 | 0.10 | 2.3 |
| 1108 | GH-8 | Sodium thiosulfate | — | $K_2[IrCl_5(H_2O)]$ | 0.34 | 1.8 | 0.12 | 1.9 |
| 1109 | GH-9 | Sodium thiosulfate | $K_2[RhBr_5(H_2O)]$ | $K_2[IrCl_5(H_2O)]$ | 0.05 | 2.1 | 0.10 | 2.1 |

TABLE 5-continued

| Sample | Green-sensitive emulsion | Chalcogen sensitizer | Compound of formula (D1) | Compound of formula (D2) | SH | γ | ΔS | γL |
|---|---|---|---|---|---|---|---|---|
| 1110 | GH-10 | SE3-9 | — | $K_2[IrCl_5(H_2O)]$ | 0.48 | 2.0 | 0.10 | 2.1 |
| 1111 | GH-11 | SE3-9 | $K_2[RhBr_5(H_2O)]$ | $K_2[IrCl_5(H_2O)]$ | 0.40 | 2.3 | 0.05 | 2.3 |

As shown in Table 5, the compounds represented by formula (D2) were able to adjust the gradations of the samples using them to the desirable range in the case of high-illumination exposure. So the use of those compounds is desirable. Further, it was found that the combined use with the compounds represented by formula (D2) in the samples according to the second embodiment of the present invention, enhanced latent-image stability in particular. However, it was also found that the combined use with compounds represented by formula (D2) caused a problem of soft gradation in the case of low-illumination exposure. In the samples in accordance with the second embodiment of the present invention, on the other hand, such soft gradation did not occur. So the second embodiment of the invention has proved to be excellent. In addition, the sensitivity was increased by the combined use with compounds represented by formula (D2).

Furthermore, the effect of the second embodiment of the present invention has proved to be specific to the combined use of compounds represented by formula (D1) and selenium compounds.

EXAMPLE 2-3

(Preparation of Sample 1112)

A green-sensitive emulsion GL 1 was prepared in the same manner as GH-10, except that $K_2[RhBr5(H_2O)]$ was added over a period from 83 to 88% addition of the entire silver nitrate amount in the emulsion preparation so that the addition amount thereof reached $1.8\times10^{-8}$ mole/mole Ag to the total amount of silver. Further, Sample 1112 was prepared in the same manner as Sample 1101, except that Emulsion GH-1 was replaced with Emulsion GL-1.

(Preparation of Sample 1113)

Sample 1113 was prepared in the same manner as Sample 1101, except that Emulsion GH-1 was replaced with a mixture of Emulsion GH-11 and Emulsion GL-1 (mixed at a ratio of 1:1 on a silver basis).

Samples 1112 and 1113 were processed in the same manner as in Example 2-1, and their SHs and γs were determined. The results obtained are shown in Table 6. The sensitivities of these samples were determined in the same manner as in Example 2-1, except that they were expressed as values relative to the sensitivity of Sample 1111 instead of that of Sample 1101.

TABLE 6

| Sample | Green-sensitive emulsion | Chalcogen sensitizer | Compound of formula (D1) | Compound of formula (D2) | SH | γ |
|---|---|---|---|---|---|---|
| 1111 | GH-11 | SE3-9 | $K_2[RhBr_5(H_2O)]$ | $K_2[IrCl_5(H_2O)]$ | 0.00 | 2.30 |
| 1112 | GL-1 | SE3-9 | $K_2[RhBr_5(H_2O)]$ | $K_2[IrCl_5(H_2O)]$ | −0.15 | 2.40 |
| 1113 | GH-11/GL-1 | SE3-9 | $K_2[RhBr_5(H_2O)]$ | $K_2[IrCl_5(H_2O)]$ | −0.07 | 2.20 |

As shown in Table 6, optimization of gradation was achieved by use of two varieties of emulsions.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. § 119 (a) on Patent Application No. 2004-68408 filed in Japan on Mar. 11, 2004, and Patent Application No. 2004-89336 filed in Japan on Mar. 25, 2004, each of which is entirely herein incorporated by reference.

What we claim is:

1. A silver halide emulsion containing silver halide grains with a silver chloride content of at least 95 mole %, being sensitized with selenium and gold, and further comprising at least two kinds of compounds each having a function of oxidizing metallic silver clusters.

2. The silver halide emulsion as claimed in claim 1, wherein the silver halide grains have an average side length ranging from 0.10 μm to 0.60 μm.

3. A silver halide color photographic light-sensitive material having, on a support, a yellow-dye-forming silver halide emulsion layer, a magenta-dye-forming silver halide emulsion layer, and a cyan-dye-forming silver halide emulsion layer, wherein at least one silver halide emulsion layer contains the silver halide emulsion as claimed in claim 1.

4. A silver halide color photographic light-sensitive material having, on a support, a yellow-dye-forming silver halide emulsion layer, a magenta-dye-forming silver halide emulsion layer, and a cyan-dye-forming silver halide emulsion layer, wherein the yellow-dye-forming silver halide emulsion layer contains the silver halide emulsion as claimed in claim 1.

5. A silver halide color photographic light-sensitive material having, on a support, a yellow-dye-forming silver halide emulsion layer, a magenta-dye-forming silver halide emulsion layer, and a cyan-dye-forming silver halide emulsion layer, wherein the silver halide emulsion layer nearest to the support contains the silver halide emulsion as claimed in claim 1.

6. A silver halide emulsion containing silver halide grains with a silver chloride content of at least 95 mole %, being sensitized with selenium and gold, and further comprising at least two compounds selected from the following Groups A to F;

Group A: a compound represented by the following formula (I),

Group B: a compound represented by the following formula (II),

Group C: a compound represented by the following formula (III),

Group D: hydrogen peroxide or a hydrogen peroxide adduct,

Group E: chlorous acid,

Group F: an inorganic sulfur;

Formula (I)

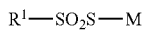

Formula (II)

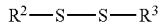

Formula (III)

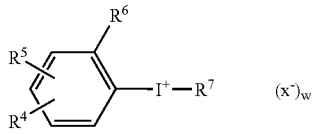

wherein $R^1$, $R^2$, and $R^3$ each independently represent an aliphatic group, an aromatic group, or a heterocyclic group, and $R^2$ and $R^3$ may combine with each other to form a ring; M represents a cation; $R^4$, $R^5$, and $R^6$ each independently represent a hydrogen atom, an aliphatic group, an aromatic group, a heterocyclic group, an alkoxy group, a hydroxyl group, a halogen atom, an aryloxy group, an alkylthio group, an arylthio group, an acyl group, a sulfonyl group, an acyloxy group, a carboxyl group, a cyano group, a nitro group, a sulfo group, an alkylsulfoxido group, or a trifluoroalkyl group, and any two groups among $R^4$, $R^5$, and $R^6$ may combine with each other to form a 5- or 6-membered ring or a polycyclic system; $R^7$ represents a carboxylate or $O^-$; $X^-$ represents an anion as a counter ion; and w represents 0 or 1; provided that w is 0 and $R^7$ is $O^-$ when $R^6$ is a carboxyl group or a sulfo group.

7. The silver halide emulsion as claimed in claim 6, wherein the at least two compounds are selected from different groups of Groups A to F.

8. The silver halide emulsion as claimed in claim 6, wherein the silver halide grains have an average side length ranging from 0.10 μm to 0.60 μm.

9. A silver halide color photographic light-sensitive material having, on a support, a yellow-dye-forming silver halide emulsion layer, a magenta-dye-forming silver halide emulsion layer, and a cyan-dye-forming silver halide emulsion layer, wherein at least one silver halide emulsion layer contains the silver halide emulsion as claimed in claim 6.

10. A silver halide color photographic light-sensitive material having, on a support, a yellow-dye-forming silver halide emulsion layer, a magenta-dye-forming silver halide emulsion layer, and a cyan-dye-forming silver halide emulsion layer, wherein the yellow-dye-forming silver halide emulsion layer contains the silver halide emulsion as claimed in claim 6.

11. A silver halide color photographic light-sensitive material having, on a support, a yellow-dye-forming silver halide emulsion layer, a magenta-dye-forming silver halide emulsion layer, and a cyan-dye-forming silver halide emulsion layer, wherein the silver halide emulsion layer nearest to the support contains the silver halide emulsion as claimed in claim 6.

12. The silver halide emulsion as claimed in claim 1, wherein the silver halide grains are cubic or tetradecahedral grains.

13. The silver halide emulsion as claimed in claim 1, wherein the silver halide grains contain a hexacoordinate complex containing iridium as a central metal.

14. The silver halide emulsion as claimed in claim 13, wherein the complex is represented by the formula (D2B):

$$[IrX^{D2B}{}_nL^{D2B}{}_{(6-n)}]^m \qquad \text{formula (D2B)}$$

wherein $X^{D2B}$ represents a halogen ion or a pseudohalogen ion other than a cyanate ion; $L^{D2B}$ represents a heterocyclic compound; n represents 3, 4, or 5; m represents 5−, 4−, 3−, 2−, 1−, 0, or 1+.

15. The silver halide emulsion as claimed in claim 1, wherein the silver halide grains contain at least one kind of hexacoordinate complex containing iridium as a central metal and at least one kind of a metal complex represented by formula (D1):

$$[M^{D1}X^{D1}{}_nL^{D1}{}_{(6-n)}]^m \qquad \text{formula (D1)}$$

wherein, in formula (D1), $M^{D1}$ represents Cr, Mo, Re, Fe, Ru, Os, Co, Rh, Pd, or Pt; $X^{D1}$ represents a halogen ion; $L^{D1}$ represents a ligand other than $X^{D1}$; n represents 3, 4, 5, or 6; and m is an electric charge of the metal complex and represents 4−, 3−, 2−, 1−, 0, or 1+; plural $X^{D1}$s may be the same or different; and when plural $L^{D1}$s exist, the plural $L^{D1}$s may be the same or different; provided that the metal complex represented by formula (D1) has no or only one CN ion as a ligand.

16. The silver halide emulsion as claimed in claim 1, wherein the silver halide grains having at least one of a silver iodide-containing phase at any of positions ranging from 85 to 100% of the grain volume measured from the inside of the respective grains and a silver bromide-containing phase at any of positions ranging from 70 to 95% of the grain volume measured from the inside of the respective grains.

17. The silver halide emulsion as claimed in claim 1, wherein the silver halide grains have a silver iodide-containing phase which is formed by adding iodide ions or fine silver halide grains containing silver iodide and by finishing said addition at any of positions ranging up to 98% of the grain volume measured from the inside of the respective grains.

18. The silver halide emulsion as claimed in claim 6, comprising a compound represented by formula (I) and a compound represented by formula (II).

19. The silver halide emulsion as claimed in claim 6, comprising a compound represented by formula (I) and a compound represented by formula (III).

20. The silver halide emulsion as claimed in claim 6, comprising an inorganic sulfur and a compound represented by formula (II).

* * * * *